US009217248B2

(12) United States Patent
Knepp et al.

(10) Patent No.: US 9,217,248 B2
(45) Date of Patent: Dec. 22, 2015

(54) COLUMN ASSEMBLY FOR USE IN BUILDING FOUNDATION SYSTEMS AND METHODS OF ASSEMBLING SAME

(71) Applicant: Morton Buildings, Inc., Morton, IL (US)

(72) Inventors: Wayne A. Knepp, Morton, IL (US); Paul Remmele, Morton, IL (US); John Leesman, East Peoria, IL (US)

(73) Assignee: MORTON BUILDINGS, INC., Morton, IL (US)

( * ) Notice: Subject to any disclaimer, the term of this patent is extended or adjusted under 35 U.S.C. 154(b) by 0 days.

(21) Appl. No.: 14/310,849

(22) Filed: Jun. 20, 2014

(65) Prior Publication Data

US 2014/0373471 A1 Dec. 25, 2014

Related U.S. Application Data

(60) Provisional application No. 61/837,284, filed on Jun. 20, 2013, provisional application No. 61/915,714, filed on Dec. 13, 2013.

(51) Int. Cl.

| | |
|---|---|
| ***E04B 1/16*** | (2006.01) |
| ***E04C 3/00*** | (2006.01) |
| ***E02D 27/42*** | (2006.01) |
| ***E04C 3/34*** | (2006.01) |

(52) U.S. Cl.

CPC ..... *E04C 3/005* (2013.01); *E02D 27/42* (2013.01); *E04C 3/34* (2013.01)

(58) Field of Classification Search

CPC ..... E04C 3/005; E04C 3/34; E04B 1/41; E04B 2001/2684; E02D 27/42

See application file for complete search history.

(56) References Cited

U.S. PATENT DOCUMENTS

| | | | | |
|---|---|---|---|---|
| 3,905,486 | A | 9/1975 | Genson | |
| 4,198,175 | A | 4/1980 | Knepp et al. | |
| 4,662,146 | A | 5/1987 | Parry | |
| 6,964,139 | B2 | 11/2005 | Meyer et al. | |
| 7,275,351 | B2 * | 10/2007 | Knepp | 52/848 |
| 7,343,713 | B2 | 3/2008 | Knepp et al. | |
| 7,793,476 | B2 * | 9/2010 | Sanders et al. | 52/296 |

* cited by examiner

*Primary Examiner* — Patrick Maestri

(74) *Attorney, Agent, or Firm* — Howard & Howard Attorneys PLLC

(57) ABSTRACT

A column assembly for use in a building foundation system is described herein. The column assembly includes a height adjustment assembly for use in adjusting an overall length of the column assembly. The height adjustment assembly includes an access tube assembly and a rod assembly. The access tube assembly includes a tube cavity that extends along a longitudinal axis. The rod assembly is rotatably coupled to the access tube assembly and extends outwardly from the access tube assembly along the longitudinal axis. A reinforcement assembly is coupled to the height adjustment assembly. A column connector assembly is coupled to the reinforcement assembly and includes a baseplate that is coupled to the access tube assembly. The baseplate includes an access opening extending therethrough that provides access to the tube cavity through the access opening.

20 Claims, 59 Drawing Sheets

FIG - 12
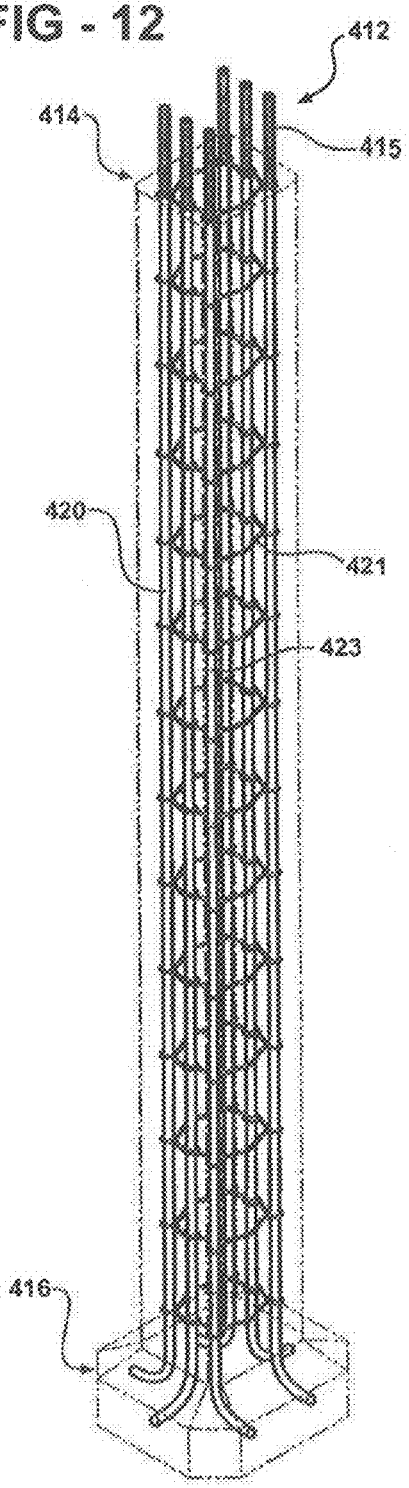
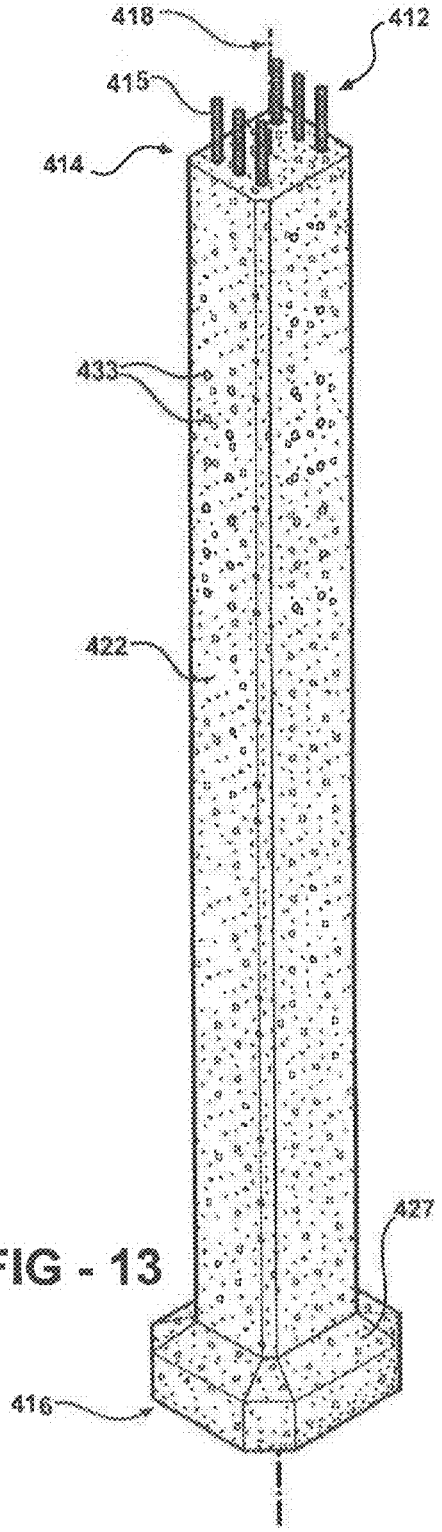
FIG - 13

FIG - 14
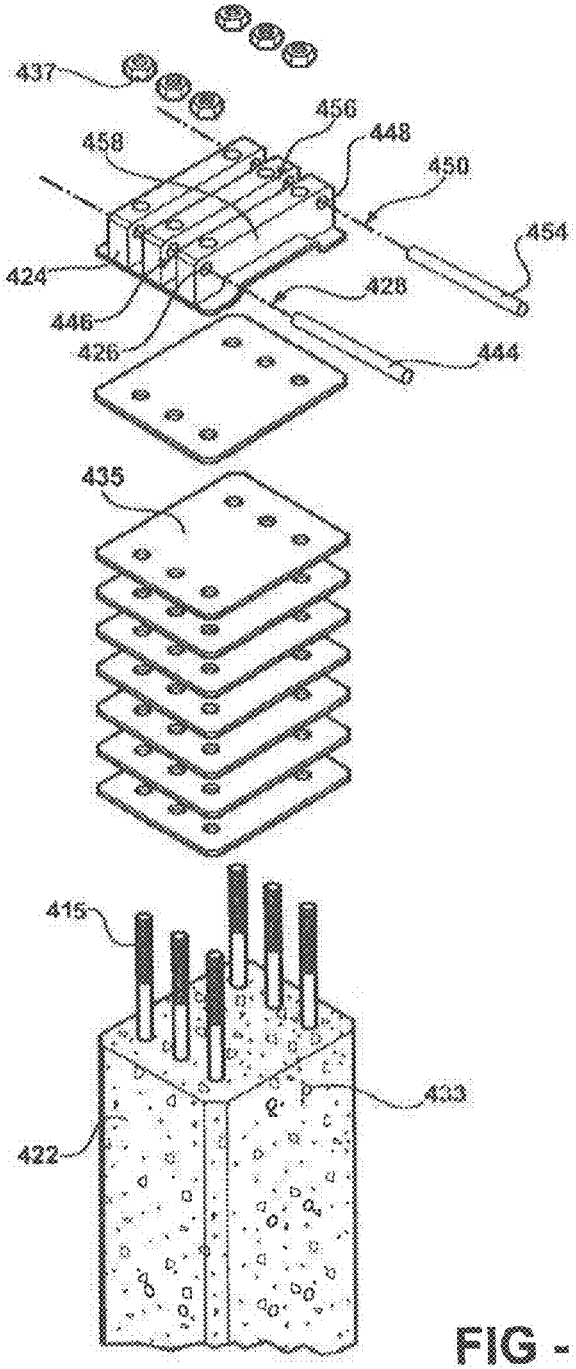
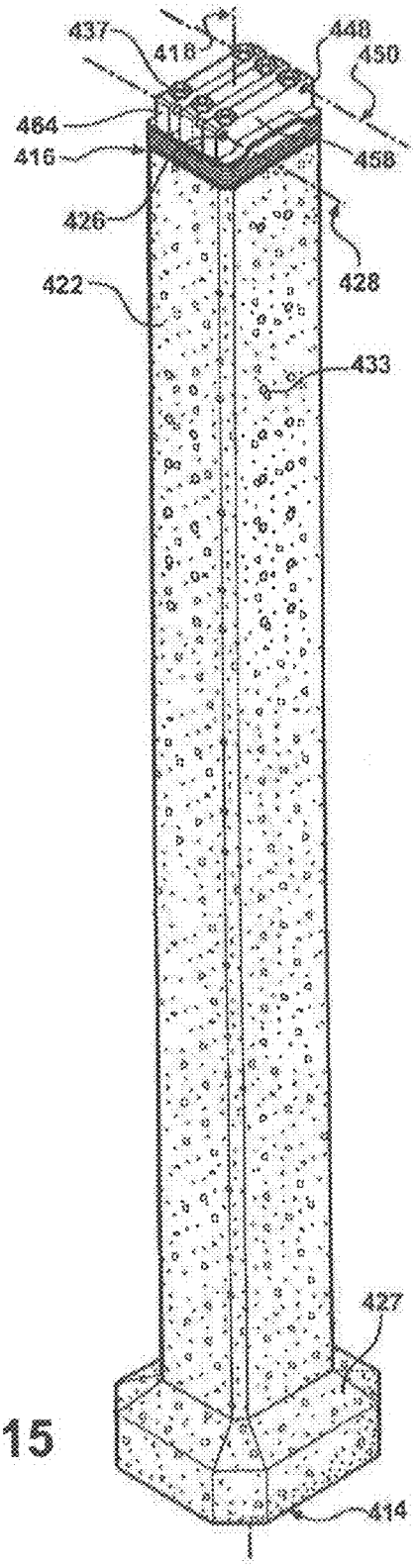
FIG - 15

COLUMN ASSEMBLY FOR USE IN BUILDING FOUNDATION SYSTEMS AND METHODS OF ASSEMBLING SAME

CROSS REFERENCE TO RELATED APPLICATION

This application claims the benefit of U.S. Provisional Patent Application Ser. No. 61/837,284, filed Jun. 20, 2013, and claims the benefit of U.S. Provisional Patent Application Ser. No. 61/915,714, filed Dec. 13, 2013, the disclosures of which are hereby incorporated by reference in its entirety for all purposes.

TECHNICAL FIELD

The subject invention relates to a foundation system for a building. More specifically, the subject invention relates to a column assembly having an adjustable length for use in a building foundation system.

BACKGROUND OF THE INVENTION

Typically, post-frame construction of buildings employs setting a series of pilings, usually made of wood, into the earth to define the perimeter of the building. Once the perimeter is set with the pilings, the building is framed in an upright position by connecting wall gifts to the adjacent pilings. A disadvantage of using wood piling is that they can break down in the earth over time and, in the case of chemically treated wood, the pilings can release chemicals into the ground. To overcome this particular problem, it is known in the art to use a two-piece piling assembly having an upper and a lower piling where the lower piling is reinforced concrete. Once the lower piling is set into the ground, the upper piling is attached to the upper piling and framing of the building commences.

To facilitate this type of construction, the upper and lower pilings can be connected at a hinge. The building walls are framed on the ground using the upper pilings. Following construction of the frame, each wall is rotated upward about the hinged connection and pinned for retention.

An example of this type of construction can be seen in U.S. Pat. No. 4,662,146 to Parry ("the '146 patent"). A lower hinge plate is connected to the top of the lower piling by fasteners. The hinge plate is a generally flat plate having a pair of opposing walls that extend vertically from edges of the hinge plate. A pair of opposing grooves are defined in front edges of the opposing walls, at the plate. Similarly, a pair of opposing holes are defined near the rear edges of the opposing walls. A shoe is attached to a lower end of the upper piling by fasteners. The shoe has a flat bottom and three walls that extend vertically from edges of the bottom. Two of the walls are opposing with the third wall extending between the rear edges. A pair of opposing pins extend from the lower front edge of the opposing walls, at the bottom. Similarly, a pair of opposing holes are defined in the opposing walls near the rear of the walls, spaced from the bottom.

The lower end of the lower piling is set in the ground, leaving the upper end of the piling exposed. On the ground, frames, made up of columns with rafters or beams, are connected together at a gable. The shoes are attached to the lower ends of the columns. Each frame is positioned such that the pins of the shoe are slid into the corresponding grooves on the lower hinge plate. Using a cable assembly, the frame is pulled into an upright position, rotating about the pins. This brings the holes on the shoe into alignment with the holes on the lower hinge plate. The frame is retained in an upright position by inserting pins through the holes.

This type of construction increases the amount of work that can be performed at ground level and could conceivably allow a single individual to hoist the frame into an upright position. However, it would still require more than one person to align the pins of the frame to the hinge plates of the lower pilings that are pre-set into the ground. The present invention is aimed at one or more of the problems identified above.

SUMMARY OF THE INVENTION

The invention is generally directed to an adjustable height column assembly for use in building foundation systems and methods of assembling adjustable height column assemblies.

In one aspect of the invention, a column assembly for use in a building foundation system is provided. The column assembly includes a height adjustment assembly for use in adjusting an overall length of the column assembly. The height adjustment assembly includes an access tube assembly and a rod assembly. The access tube assembly includes an inner surface and an outer surface. The inner surface defines a tube cavity that extends between a first end and a second end along a longitudinal axis. The rod assembly rotatably is coupled to the access tube assembly and extends outwardly from the second end along the longitudinal axis. A reinforcement assembly is coupled to the height adjustment assembly. The reinforcement assembly includes at least one reinforcement member that extends between a top portion and a bottom portion and is orientated with respect to the longitudinal axis. A column connector assembly is coupled to the reinforcement assembly and includes a baseplate that is coupled to the first end of the access tube assembly. The baseplate includes an opening extending therethrough that provides access to the tube cavity through the opening.

In another aspect of the invention, a column assembly used in a building foundation system is provided. The column assembly includes an upper column assembly and a lower column assembly that is coupled to the upper column assembly. The lower column assembly includes a height adjustment assembly for use in adjusting an overall length of the column assembly. The height adjustment assembly includes an access tube assembly and a rod assembly. The access tube assembly includes an inner surface and an outer surface. The inner surface defines a tube cavity that extends between a first end and a second end along a longitudinal axis. The rod assembly is rotatably coupled to the access tube assembly and extends outwardly from the second end along the longitudinal axis. A reinforcement assembly is coupled to the height adjustment assembly and includes at least one reinforcement member. The at least one reinforcement member extends between a top portion and a bottom portion and is orientated with respect to the longitudinal axis. A column connector assembly is coupled to the reinforcement assembly and the upper column assembly. The column connector assembly includes a baseplate that is coupled to the first end of the access tube assembly and includes an opening that is positioned with respect to the access tube assembly to provide access to the tube cavity through the opening.

In yet another aspect of the invention, a method of assembling a column assembly having an adjustable length is provided. The method includes coupling a sideplate to a baseplate to form a column connector assembly, coupling an access tube assembly to the baseplate, coupling a reinforcement member to the sideplate, and rotatably coupling a rod assembly to the access tube assembly. The sideplate includes a pair of engagement teeth extending through a slot formed in the baseplate. The baseplate includes an access opening extending therethrough. The access tube assembly includes an inner surface that defines a tube cavity extending between a first end and a second end along a longitudinal axis. The access tube assembly is positioned with respect to the access opening to provide access to the tube cavity through the access opening. The reinforcement member extends between a top portion and a bottom portion and is orientated with respect to the longitudinal axis. The top portion of the reinforcement member is positioned within a recess formed between the pair of engagement teeth to facilitate coupling the reinforcement member to the sideplate. The rod assembly is rotatable coupled to the second end of the access tube assembly such that a rotation of the rod assembly adjusts an overall length of the column assembly.

BRIEF DESCRIPTION OF THE DRAWINGS

Other advantages of the present invention will be readily appreciated as the same becomes better understood by reference to the following detailed description when considered in connection with the accompanying drawings wherein:

FIG. 12 is a perspective view of a reinforcing cage for a fourth alternative of a lower piling;

FIG. 13 is a perspective view of a lower piling for a fourth alternative of a lower piling with the reinforcing cage encased in concrete;

FIG. 14 is a exploded view of the adjustable hinge of a lower reinforcing cage encased in concrete for a fourth alternative of a lower piling;

FIG. 15 is a perspective view of an assembled adjustable hinge for a fourth alternative of a lower piling;

Corresponding reference characters indicate corresponding parts throughout the drawings.

DETAILED DESCRIPTION OF THE INVENTION

Figure 1A:
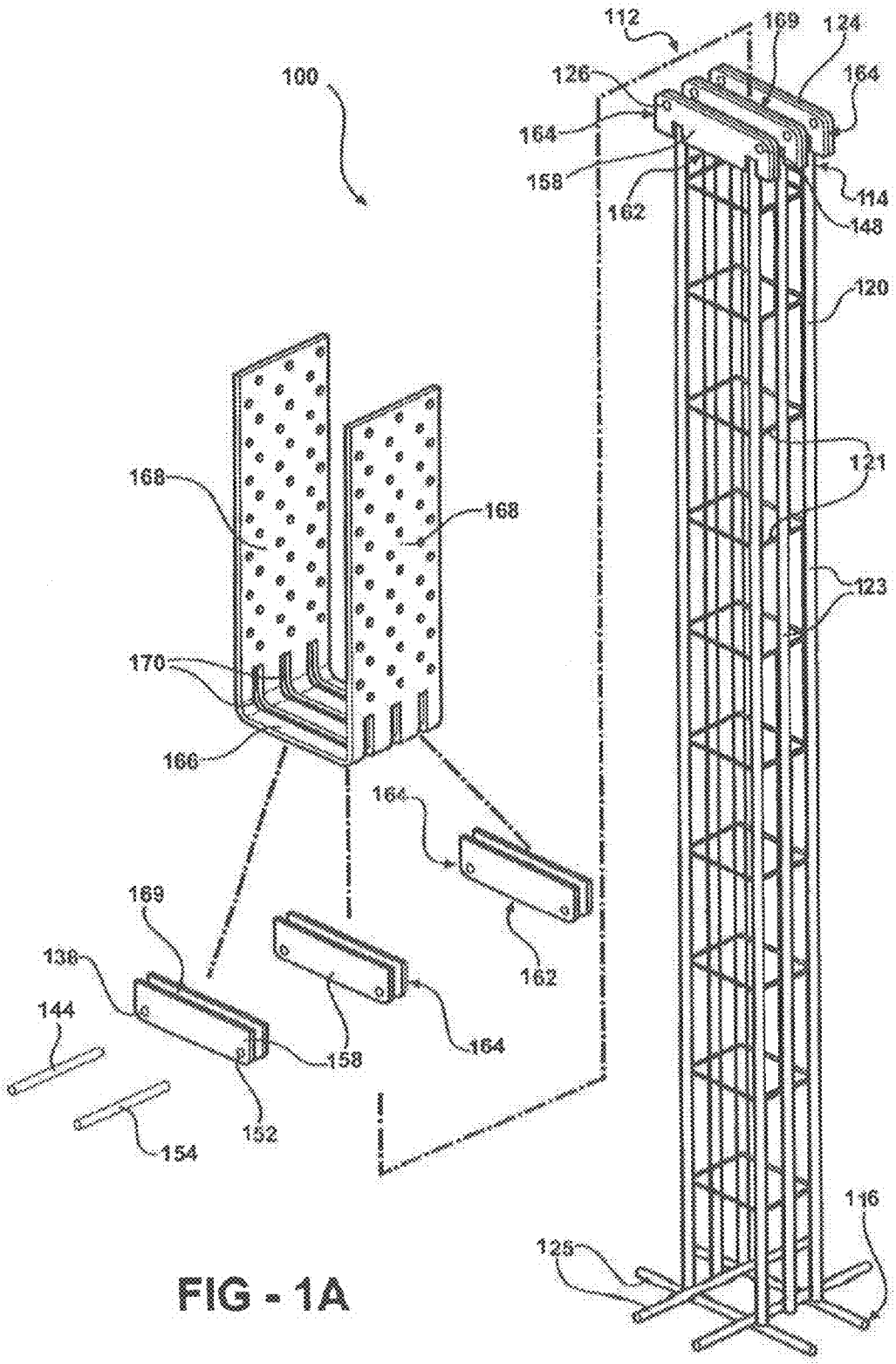
FIG. 1A is an exploded perspective view of a piling assembly according to an embodiment of the present invention.

With reference to the drawings and in operation, the present invention overcomes at least some of the disadvantages of known building foundation systems by providing a column assembly that includes an adjustable length. More specifically, the column assembly includes a height adjustment assembly for adjusting an overall length of the piling assembly to facilitate installation of the piling assembly for use in a building foundation system. In addition, the column assembly includes a lower column and an upper column that is coupled to the lower column and extends outwardly from the lower column along a longitudinal axis. The upper column and the lower column each include substantially similar cross-sectional areas such that the column assembly has a uniform cross-section along the longitudinal axis.

The column assembly also includes a threaded height adjusting bracket that allows for seamless foundation column height adjustment during construction and gives an aesthetically pleasing interior look for the building. The system starts each column location at a flush and level framing point repetitively. In addition, the column assembly includes a precast lower column assembly and exposed re-bar dowels encased in the lower column assembly to increase the uplift capacity over known columns. This sockets the precast member into the cast-in-place footing and decreases the overall weight of the precast column, making handling and shipping easier. In addition, an additional tie-plate has been positioned on the exposed re-bar to further stabilize the threaded adjustment rod and bracket during construction, making installation of the system easier for the crews by reducing the "wobbliness" of the column before the cast-in-place footing is poured. By providing an adjustable length column assembly having a uniform cross-section, the cost of installing a building foundation is reduced.

In addition, in one embodiment, the column assembly 100 includes a lower piling 112 hingedly connected to an upper piling 130. The lower piling has a first and a second end 114, 116 with a first longitudinal axis 118 extending therethrough. The upper piling 130 has a column 132 with a second longitudinal axis 134 extending therethrough.

Figure 1B:
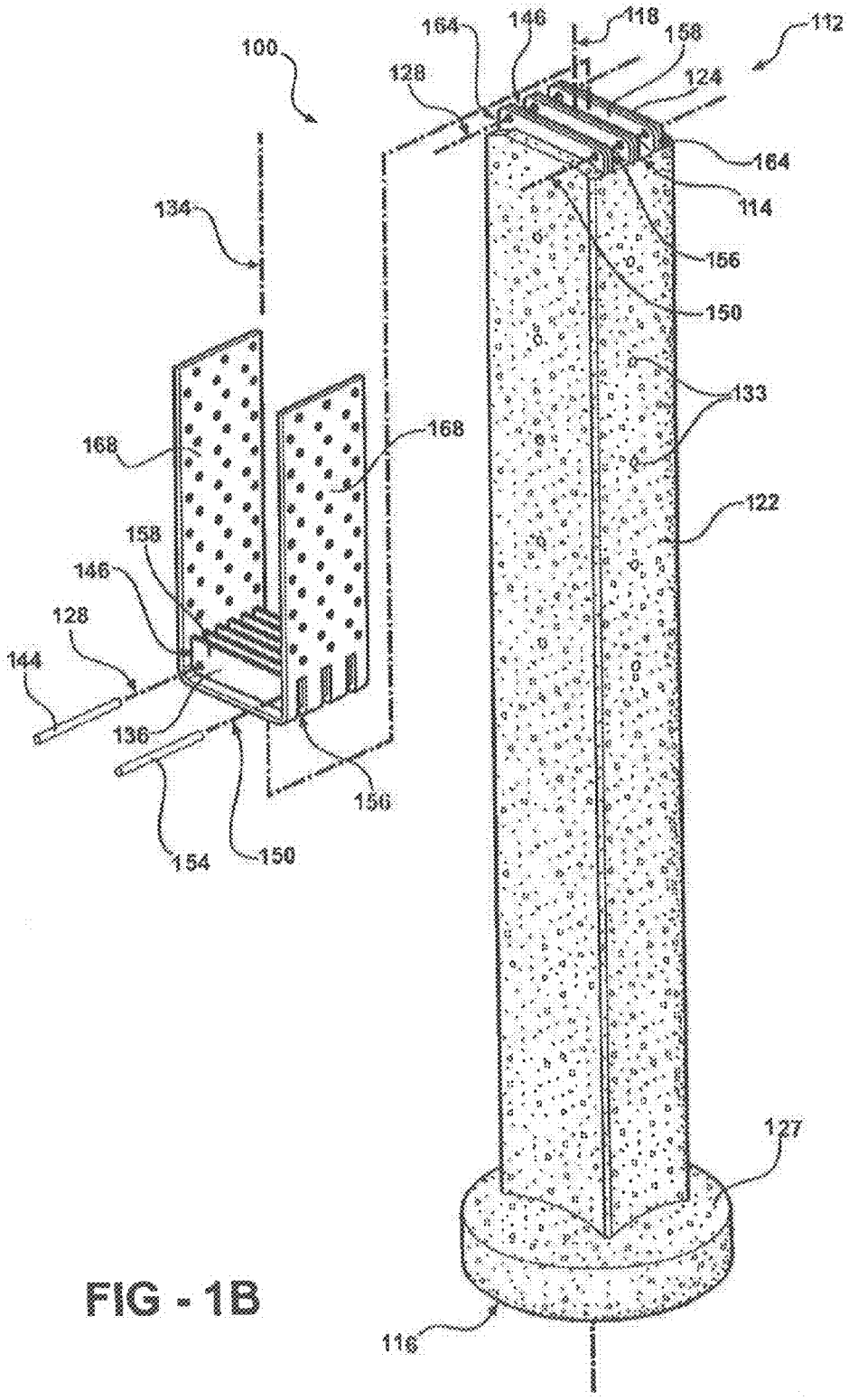
FIG. 1B is an perspective view of an unassembled piling assembly with the reinforcing cage encased in concrete.

A reinforcing cage 120 extends between the ends 114, 116, and concrete 122 encases the reinforcing cage 120. Many types of reinforcing cages 120 are known in the area of pilings. One type of reinforcing cage 120 is shown in FIG. 1A. Here, a plurality of vertically extending reinforcing rods 123 defines the perimeter of the reinforcing cage 120. A plurality of reinforcing hoops 121, i.e., cross-members, formed from wire or rods, are rigidly connected to the vertically extending reinforcing rods 123 at the inside of the perimeter of the reinforcing cage 120 to provide additional reinforcement. The reinforcing rods 123 are rigidly connected to a plurality of horizontally placed rods 125 to form a footing 127. In one aspect of the present invention, shown in FIG. 1B, the lower piling 112 is precast off-site and transported to the job site. A plurality of thru-holes 133 can be precast into the concrete 122 to attach various framing pieces F, concrete anchors, etc. to the lower piling 112. Typically, a hole is dug into the earth for receiving a portion of the lower piling 112. Following excavation of the hole, the second end 116, and a portion of the lower piling 112, is buried below ground. Finally, the hole is back filled with dirt, concrete or any other suitable material.

To provide an attachment scheme for the upper piling 130, a lower hinge 124 extends from the first end 114 and defines at least one lower first hole 126 on a first axis 128 that is spaced from the first end 114. The upper piling 130 has a column 132 and a second longitudinal axis 134 extending therethrough. Typically, the column 132 is comprised of wood, steel, aluminum or a composite. The upper hinge 136 extends from the column 132 and defines at least one upper first hole 138 on the first axis 128. The lower hinge 124 also defines a lower second hole 148, on a second axis 150 which is spaced transversely across the lower piling 112 from the lower first hole 126 and spaced from the first end 114. The upper hinge 136 also defines an upper second hole 152, on the second axis 150, which is spaced transversely across the upper piling 130 from the upper first hole 138.

Figure 2:
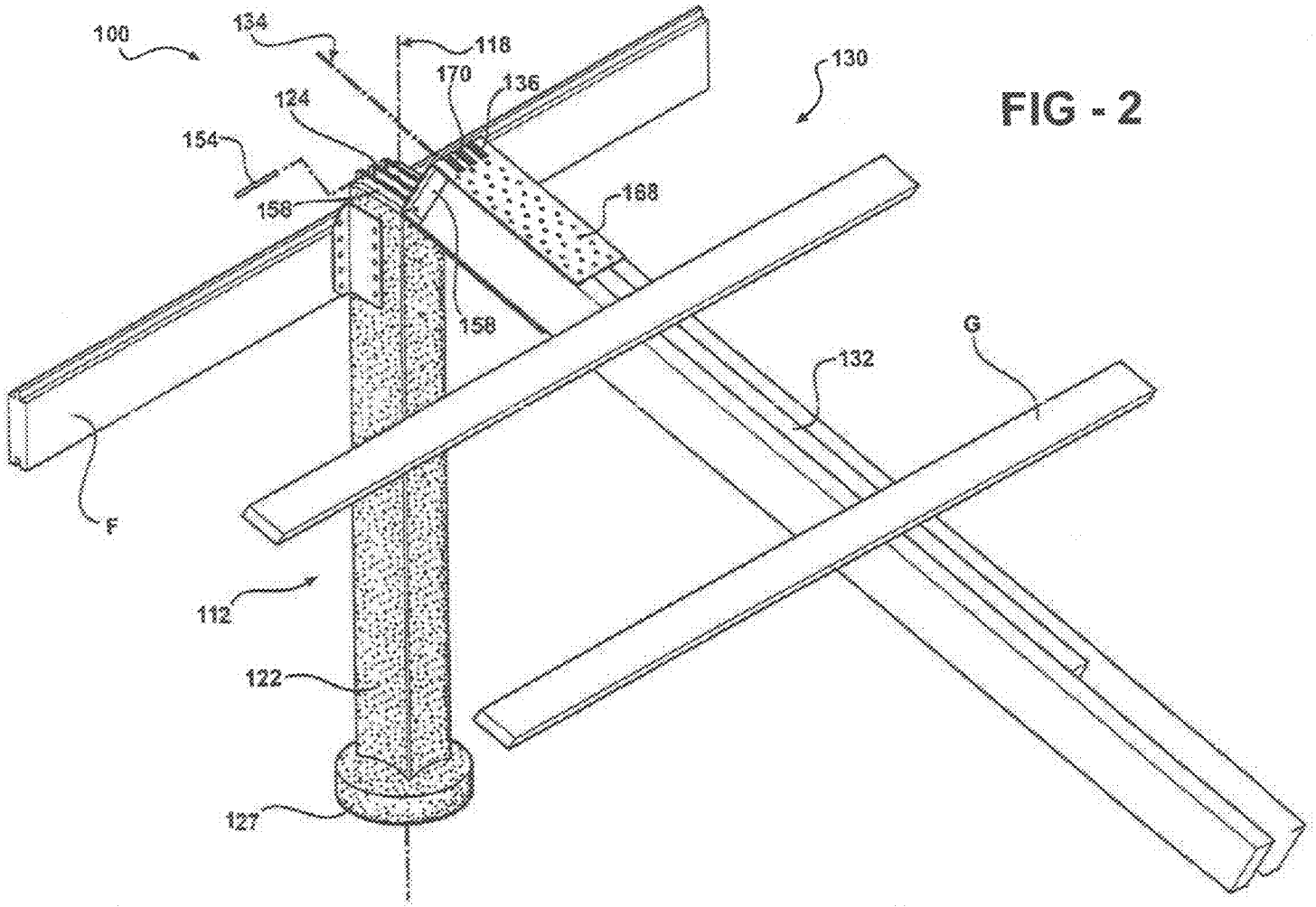
FIG. 2 is perspective view of the assembled piling assembly with various framing pieces attached to the upper and lower pilings and with the upper piling in a downward tilted position.
Figure 3:
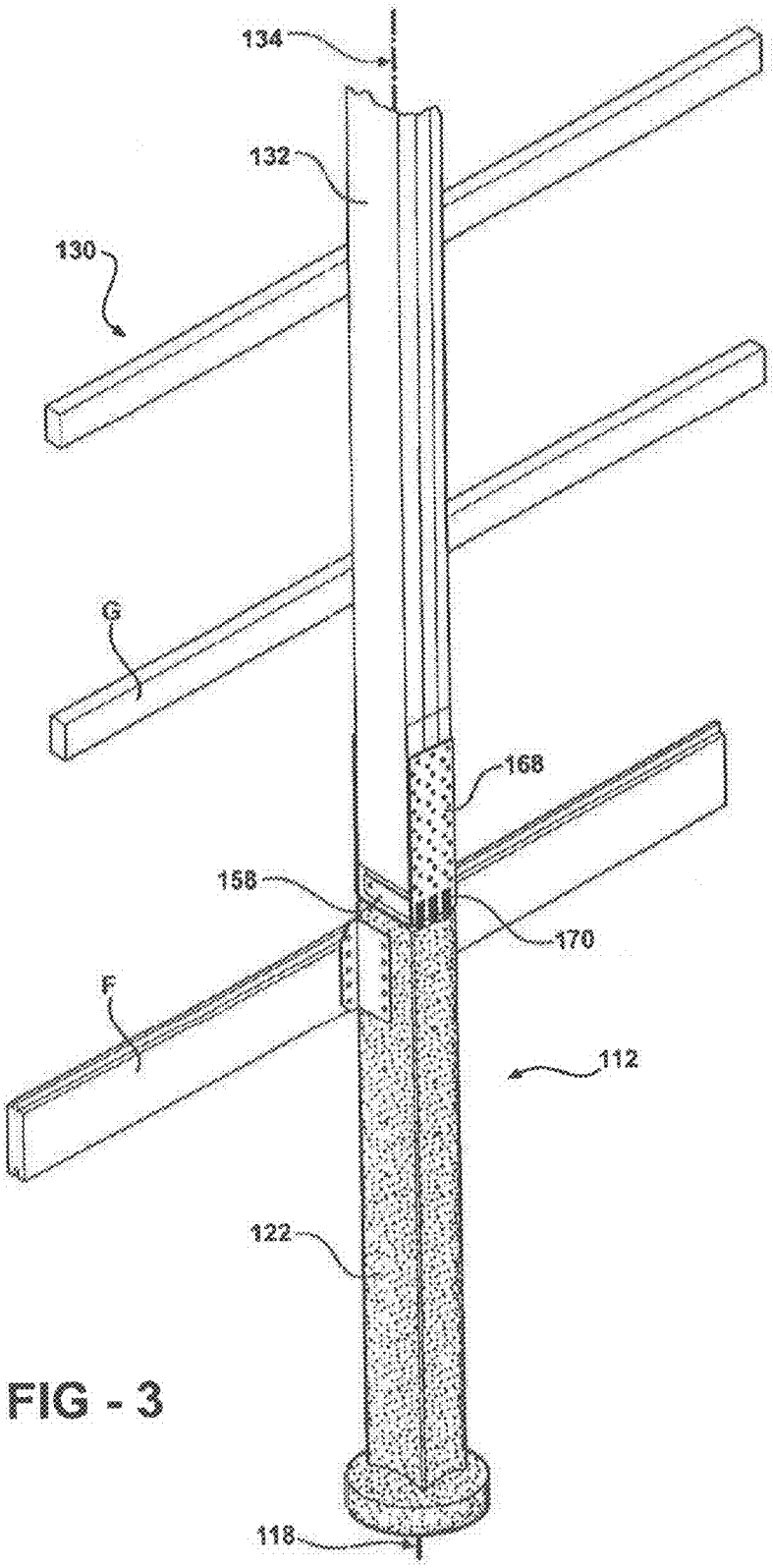
FIG. 3 is a perspective view of the assembled piling assembly with various framing pieces attached to the upper and lower pilings and with the upper piling in an upright and locked position.

In the early stages of building construction, the upper and lower hinges 136, 124 are partially interleaved, as shown in FIG. 2, such that only a first pin 144 connects the upper hinge 136 to the lower hinge 124, along the first axis 128, and the second longitudinal axis 134, for the upper piling 130, is at an angle to the first longitudinal axis 118, for the lower piling 112. As a result, the columns 132 for the building can set tilted onto the ground. This position allows wall girts G to be connected to the columns 132 to facilitate the framing of an entire wall, or at least a portion of a wall, at ground level. Once the framing with the wall girts G is completed, the upper pilings 130 that form an entire wall, or a portion of a wall, are hoisted upward as a single unit, pivoting about the first pin 144 on the first axis 128. Then, the upper pilings 130 are hoisted upward, about the first axis 128, until the upper and lower hinges 136, 124 are completely interleaved with one another and the second axes 150, for the upper and lower second holes 152, 148, are aligned. When the hinges 136, 124 are completely interleaved, the first pin 144 is extending through the upper and lower first holes 126, 138, on the first axis 128, to engage and support the hinges 136, 124. Likewise, a second pin 154 is extending through the upper and lower second holes 152, 148, on the second axis 150, to engage and support the hinges 136, 124 when the longitudinal axes 118, 134 are aligned, as shown in FIG. 3.

Each of the upper and lower hinges 136, 124 include a first plurality of hinge knuckles 146, disposed about the first pin 144, where the knuckles 146 of the upper hinge 136 are interleaved with the knuckles 146 of the lower hinge 124. The knuckles 146 hold the first pin 144 in spaced relationship to the upper and lower pilings 130, 112 to transmit longitudinal forces between the pilings 130, 112 through the first pin 144. These forces include the loads resulting from the weight of the wall girts G, the roof, various other building materials and environmental factors. Similarly, the hinges 136, 124 include a second plurality of locking knuckles 156 that are disposed about the second pin 154 with the locking knuckles 156 of the upper hinge 136 interleaved with the locking knuckles 156 of the lower hinge 124. The locking knuckles 156 hold the second pin 154 in spaced relationship to the pilings 130, 112 to transmit longitudinal forces between the pilings 130, 112 totally through the first and second pins 144, 154. Therefore, the pins 144, 154 support the entire load provided by the upper pilings 130, wall girts G, the roof, various other building materials and environmental factors.

Each of the hinges 136, 124 includes a plurality of plates 158 that are in spaced and parallel relationship. A gap 169 is defined between each of the plates 158 to facilitate the upper hinge 136 interleaving with the lower hinge 124. The first hole 126 or 138 is defined through each of the plates 158, along the first axis 128. The second hole 148 or 152 is also defined through each of the plates 158, along the second axis 150, and spaced transversely across each of the plates 158 from the first hole 126 or 138 respectively. Furthermore, the plates 158 define a bottom edge 162 and end edges 164.

The lower hinge 124 is attached to the lower piling 112 at the bottom edge 162 and the holes 126, 148 are in spaced relationship from the lower piling 112. The upper hinge 136 includes a bottom 166 and a pair of opposing walls 168 that extend upward from the bottom 166, along the column 132. The bottom edge 162 of each of the plates 158 are attached to the bottom 166 of the upper hinge 136 and the end edges 164 of each of the plates 158 are attached to the opposing walls 168. Furthermore, the bottom 166 and the opposing walls 168 define a plurality of grooves 170 that extend in spaced and parallel relationship across the bottom 166 and into a portion of the walls 168, between each of the plates 158. The grooves 170 allow the hinge plates 158 of the lower hinge 124 to interleave with the plates 158 of the upper hinge 136.

Another embodiment of the piling assembly 200, shown in FIGS. 4A-E, comprises a lower piling 212 hingedly connected to an upper piling 230. The lower piling 212 has a first and a second end 214, 216 and a first longitudinal axis 218 extending therethrough. The upper piling 230 has a column 232 and a second longitudinal axis 234 extending therethrough.

Figure 4A:
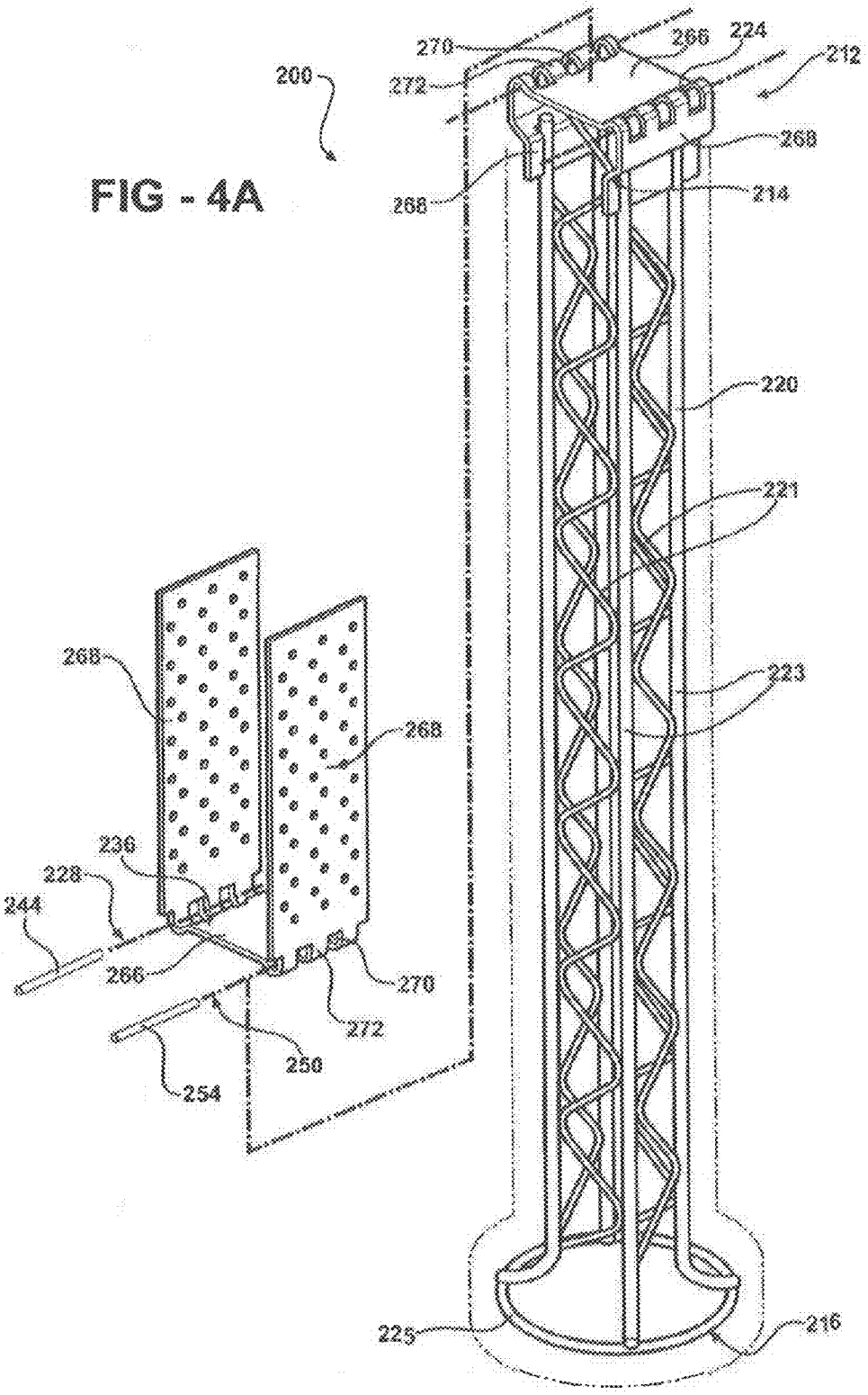
FIG. 4A is a perspective view of a second alternative piling assembly.

A reinforcing cage 220, as shown in FIG. 4A, extends between the ends 214, 216 and concrete 222 encases the cage 220. This embodiment of the lower piling 212 discloses another type of reinforcing cage that can be precast off-site. The reinforcing cage 220 has four vertically extending rods 223 that define an outer perimeter of the reinforcing cage 220.

Figure 4B:
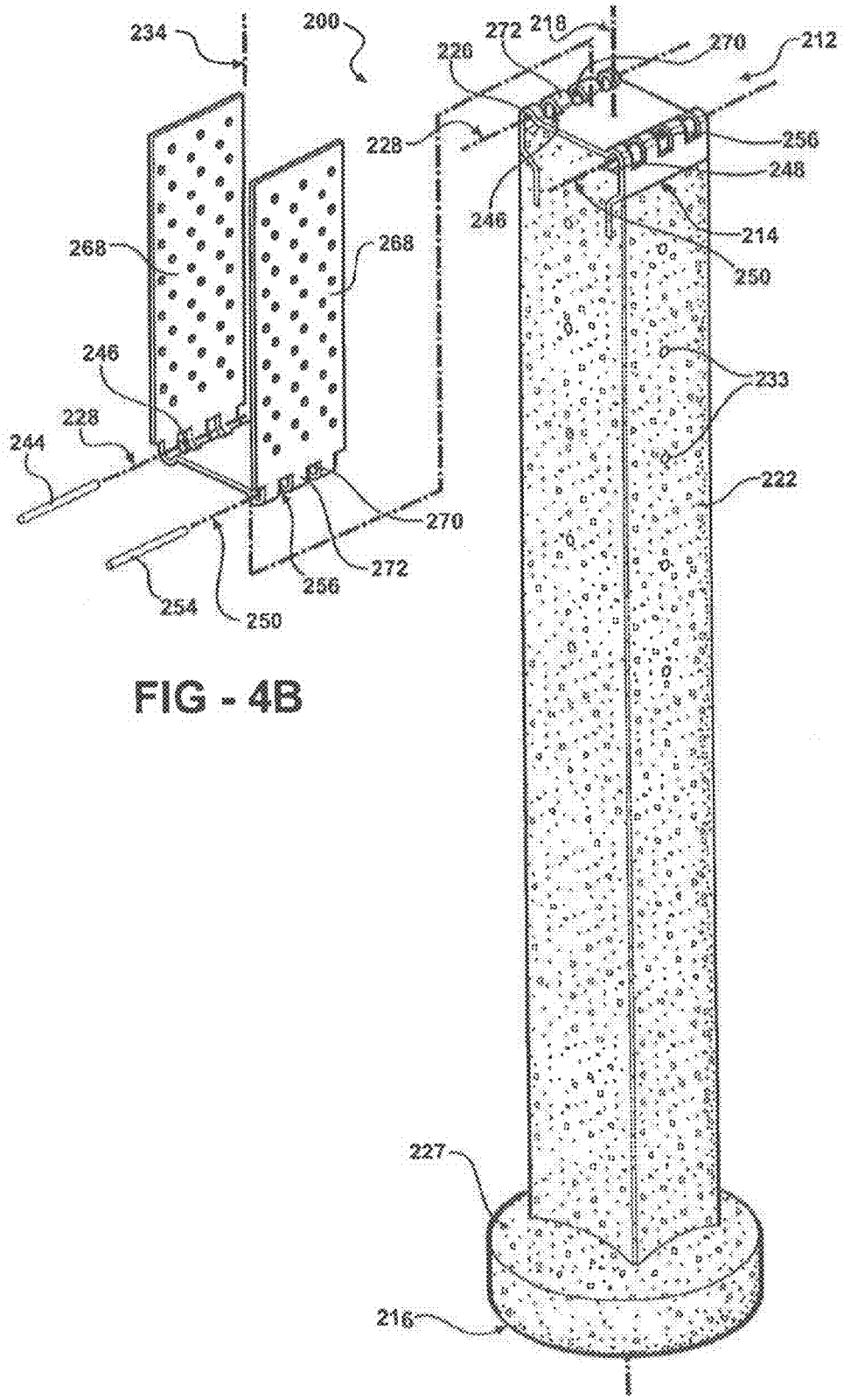
FIG. 4B is a perspective view of a second alternative piling assembly with the reinforcing cage encased in concrete.

The rods 223 curve outward at the second end 216 and are attached to a hooped rod 225 to define a footing 227. Corrugated support rods 221 are disposed between each pair of adjacent vertical rods 223 along the outer perimeter of the reinforcing cage 220, to provide additional reinforcement to the reinforcing cage 220. A plurality of thru-holes 233, for attaching various framing pieces F to the lower piling 212, can also be precast into the lower piling 212, as shown in FIG. 4B.

To provide an attaching scheme, a lower hinge 224 extends from the first end 214 and defines at least one lower first hole 226 on a first axis 228 that is spaced from the first end 214. Similarly, the upper piling 230 has an upper hinge 236 that extends from the column 232 and defines at least one upper first hole 238 on the first axis 228. The lower hinge 224 also defines a lower second hole 248, on a second axis 250, and is spaced transversely across the lower piling 212 from the lower first hole 226 and spaced from the first end 214. Likewise, the upper hinge 236 defines an upper second hole 252, on the second axis 250, and is spaced transversely across the upper piling 230 from the upper first hole 238.

Figure 4C:
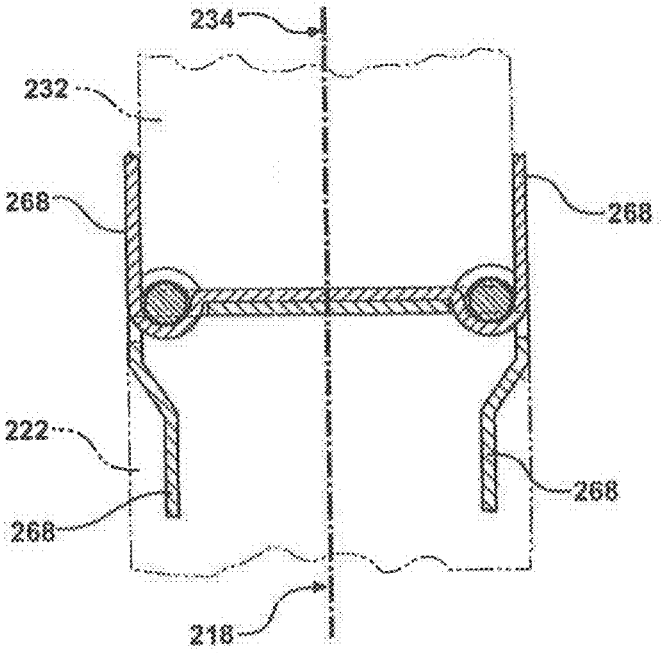
FIG. 4C is a sectional side view of the hinged and pinned connection between the upper and lower hinges for a second alternative piling assembly.
Figure 4D:
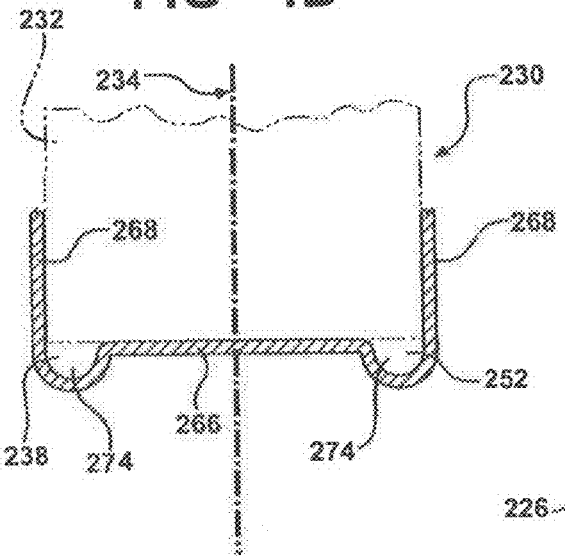
FIG. 4D is a sectional side view of the upper piling for a second alternative piling assembly.
Figure 4E:
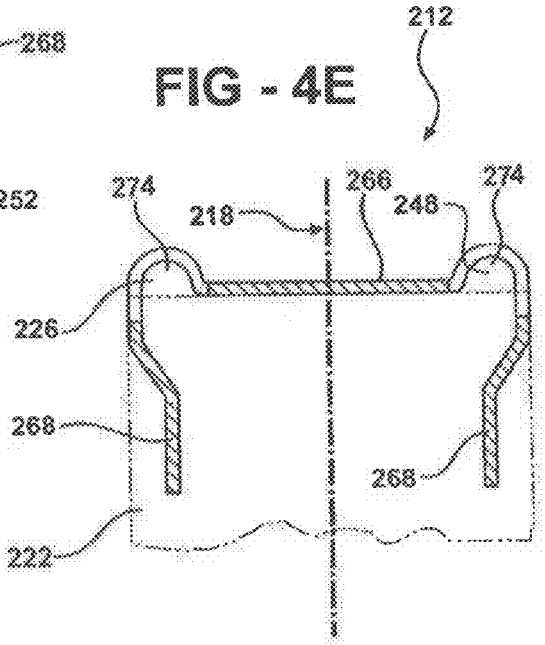
FIG. 4E is a sectional side view of the lower piling for a second alternative piling assembly.
Figure 5:
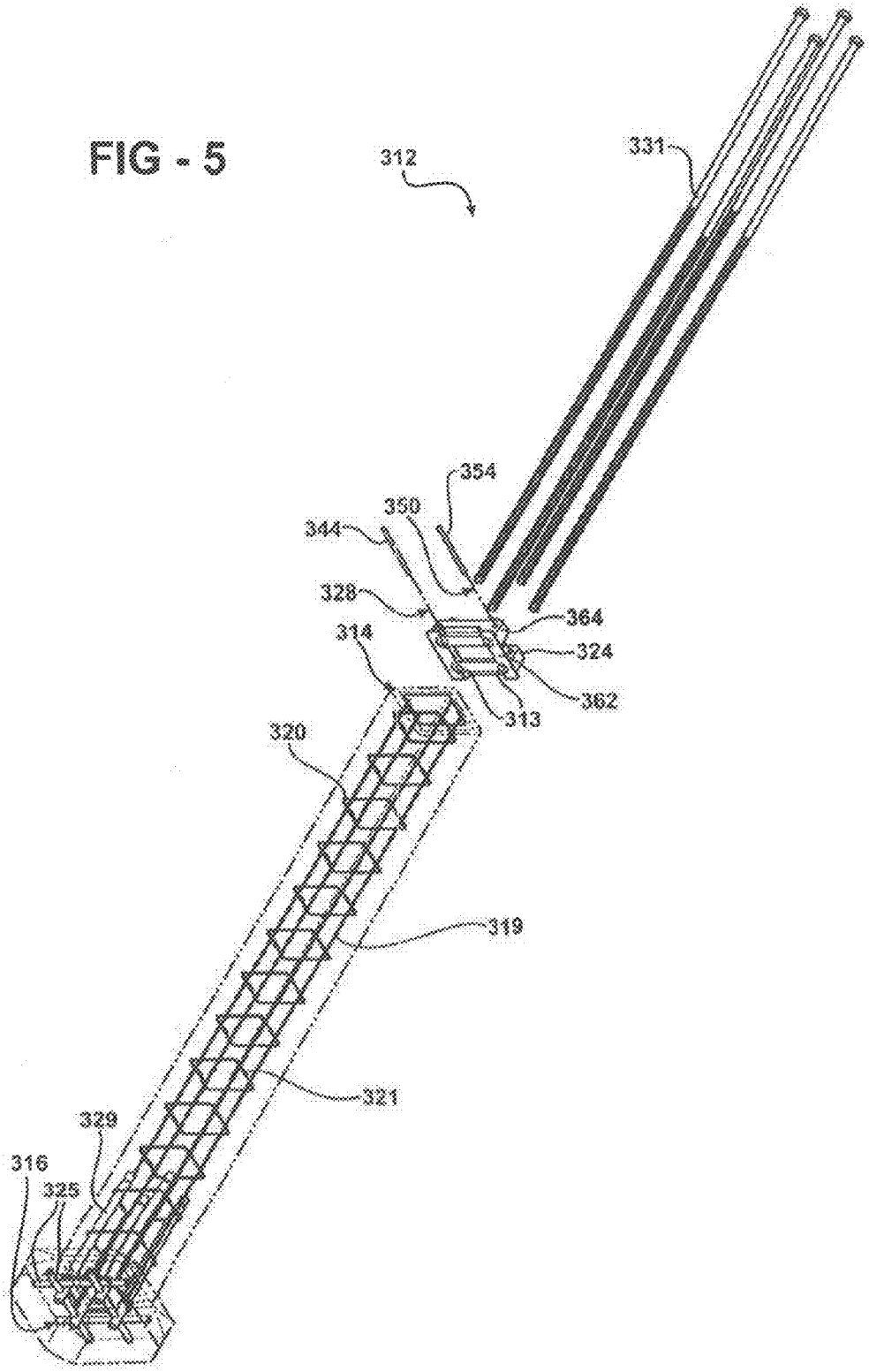
FIG. 5 is an exploded perspective view of a reinforcing cage for a third alternative of a lower piling.

In the early stages of building construction, the upper and lower hinges 236, 224 are partially interleaved such that only a first pin 244 connects the upper hinge 236 to the lower hinge 224, along the first axis 228, and the second longitudinal axis 234, for the upper piling 230, is at an angle to the first longitudinal axis 218, for the lower piling 212. As a result, the columns 232 for the building can set tilted onto the ground. This position allows wall girts G to be connected to the columns 232 to facilitate the framing of an entire wall, or a partial wall, at ground level. Once the framing with the wall girts G is completed, the upper pilings 230 that form an entire wall, or a partial wall, are hoisted upward as a single unit, pivoting about the first pin 244 on the first axis 228. Then, the upper pilings 230 are hoisted upward, about the first axis 228, until the upper and lower hinges 236, 224 are completely interleaved with one another and the second axes 250, for the upper and lower second holes 252, 248 are aligned. When the hinges 236, 224 are completely interleaved, the first pin 244 extends through the upper and lower first holes 236, 226 on the first axis 228 to engage and support the hinges 236, 224. Likewise, a second pin 254 extends through the upper and lower second holes 252, 248 on the second axis 250 to engage and support the hinges 236, 224 when the longitudinal axes 218, 234 are aligned, as shown in FIG. 4C.

The hinges 236, 224 include a first plurality of hinge knuckles 246 that are disposed about the first pin 244, where the knuckles 246 of the upper hinge 236 are interleaved with the knuckles 246 of the lower hinge 224. The knuckles 246 hold the first pin 244 in spaced relationship to the pilings 212, 230 to transmit longitudinal forces between the pilings 212, 230 through the first pin 244. These forces include those resulting from the wall girts G, the roof of the building structure, and various other building materials and environmental factors. The hinges 236, 224 also include a second plurality of locking knuckles 256 that are disposed about the second pin 254 with the locking knuckles 256 of the upper hinge 236 interleaved with the locking knuckles 256 of the lower hinge 224. The locking knuckles 256 hold the second pin 254 in spaced relationship to the pilings 230, 212 for transmitting forces between the pilings 230, 212 through the first and second pins 244, 254.

Each of the knuckles 246, 256 on each of the hinges 236, 224 comprise a plurality of straps 272 that define a pin pocket 274 for encompassing at least a portion of the circumference of one of the pins 244, 254 extending therethrough. The pin pocket 274 defines the first hole 238, 226 in one of the knuckles 246 along the first axis 228. The pin pocket 274 also defines the second hole 252, 248 in another one of the locking knuckles 256 along the second axis 250 which is spaced transversely across one of the hinges 236, 224 from the first hole 238, 226. Grooves 270 are defined between each of the straps 272 of one hinge 236, 224 for interleaving of the upper and lower hinges 236, 224.

Additionally, the upper hinge 236 includes a bottom 266 and a pair of opposing walls 268 that extend from the bottom 266 and across the upper pilings 230. The first and locking knuckles 246, 256 are disposed between the walls 268 and the bottom 266. In the upper piling 230, the knuckles 246, 256 are disposed in spaced relationship on the upper hinges 236 across the upper piling 230 and are also in spaced relationship to the column 232. Similarly, the lower hinge 224 is attached to the lower piling 212 at the walls 268. The lower holes 226, 248 are in spaced relationship to the first end 214 of the lower piling 212.

In yet another embodiment, as shown in FIGS. 5-11, the piling assembly 300 comprises a height-adjustable lower piling 312 hingedly connected to an upper piling 330. The lower piling 312 has a first and a second end 314, 316 with a first longitudinal axis 318 extending therethrough. The upper piling 330 has a column 332 with a second longitudinal axis 334 extending therethrough.

Figure 6:
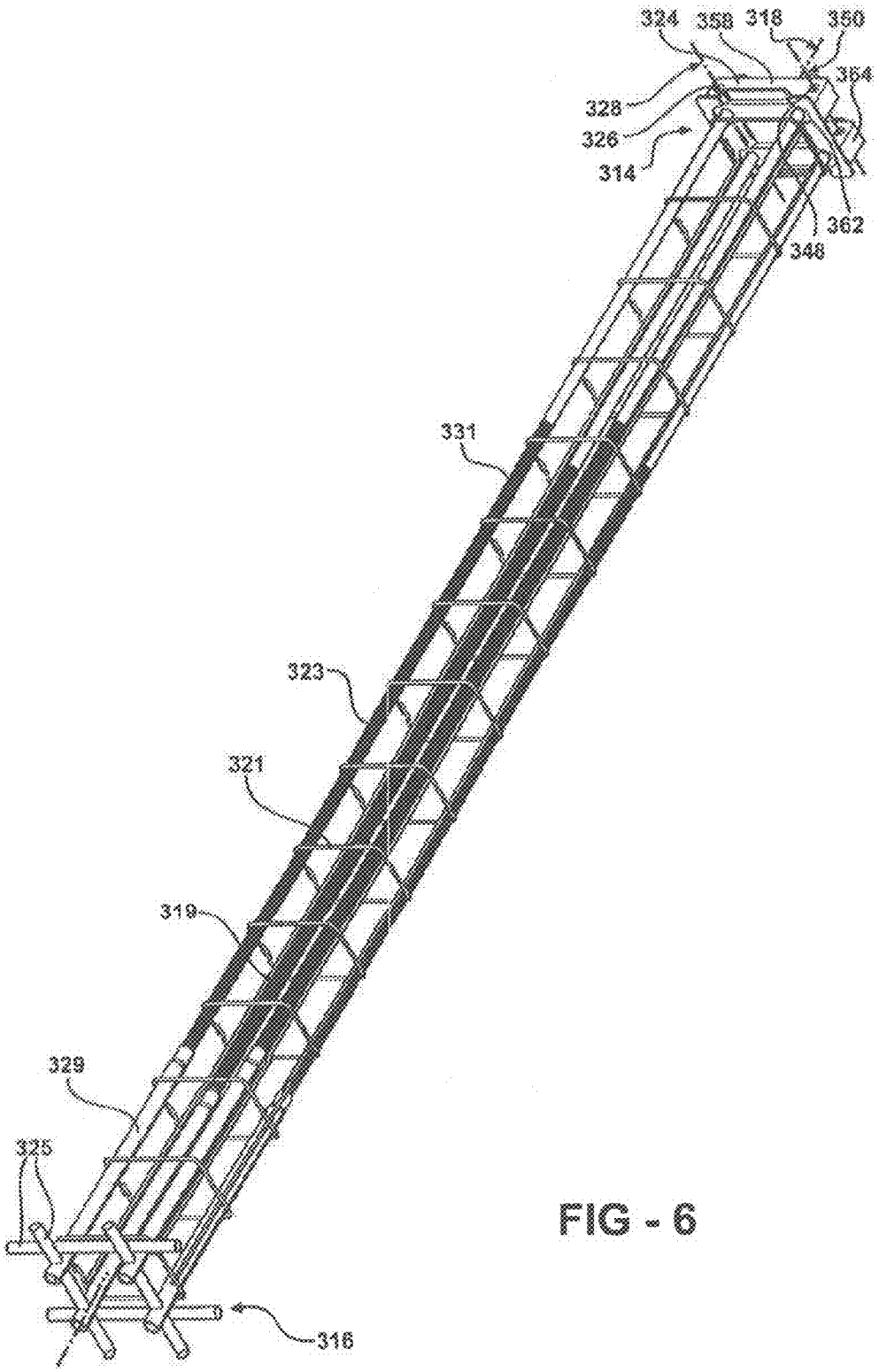
FIG. 6 is a perspective view of a reinforcing cage for a third alternative of a lower piling.
Figure 7:
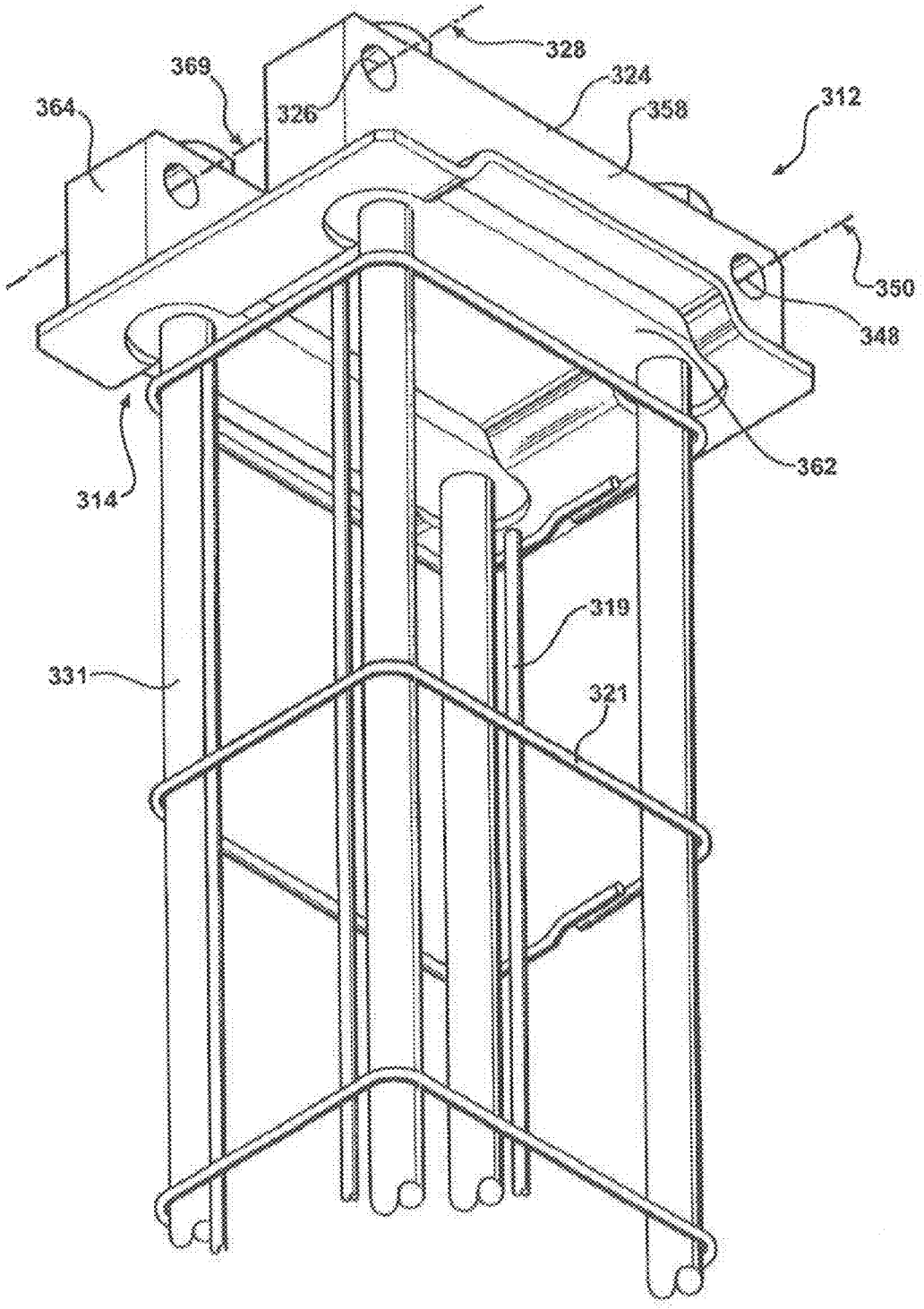
FIG. 7 is a perspective view of a first end of a reinforcing cage for a third alternative of a lower piling.
Figure 8:
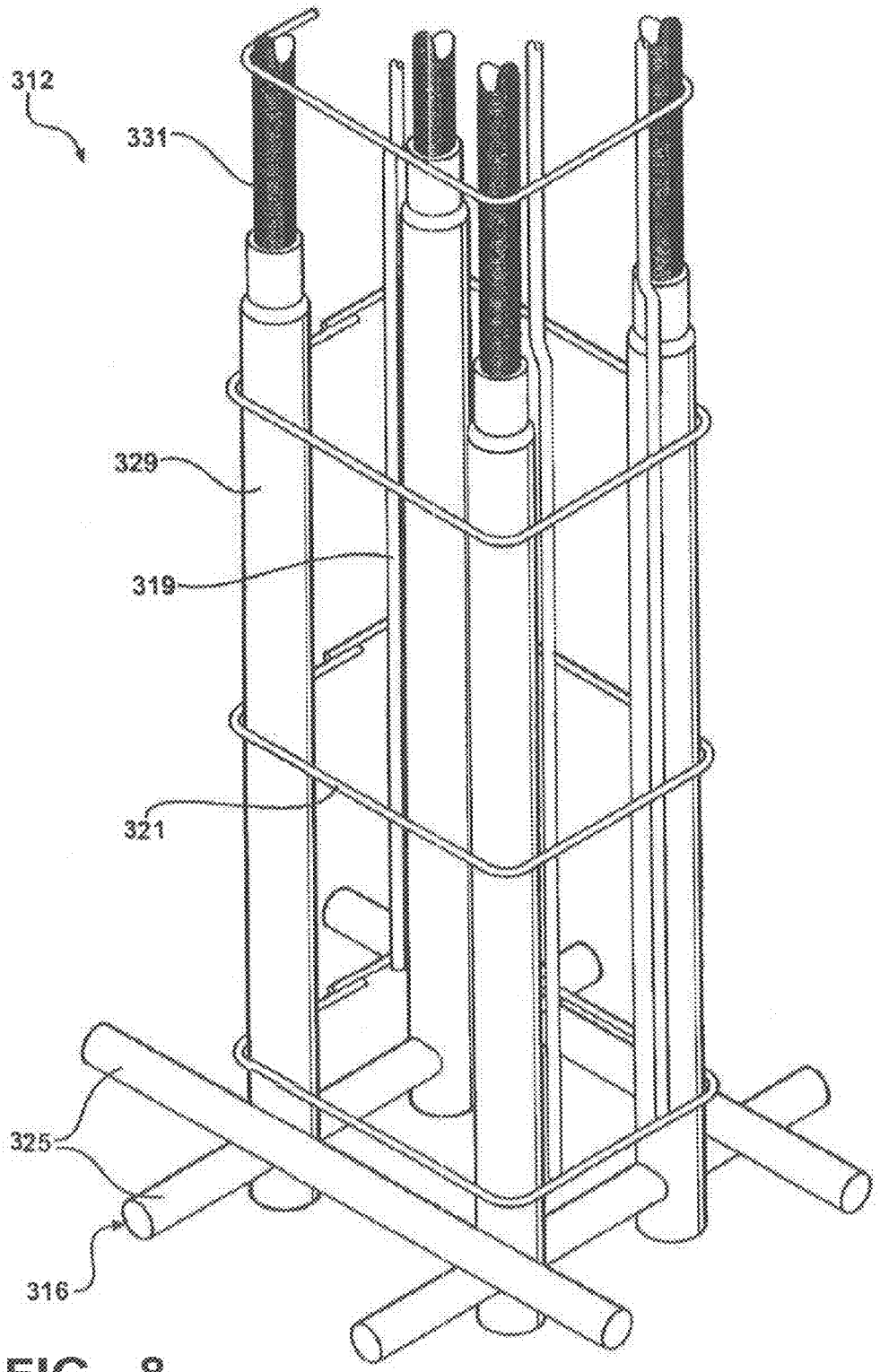
FIG. 8 is a perspective view of a second end of a reinforcing cage for a third alternative of a lower piling.
Figure 9:
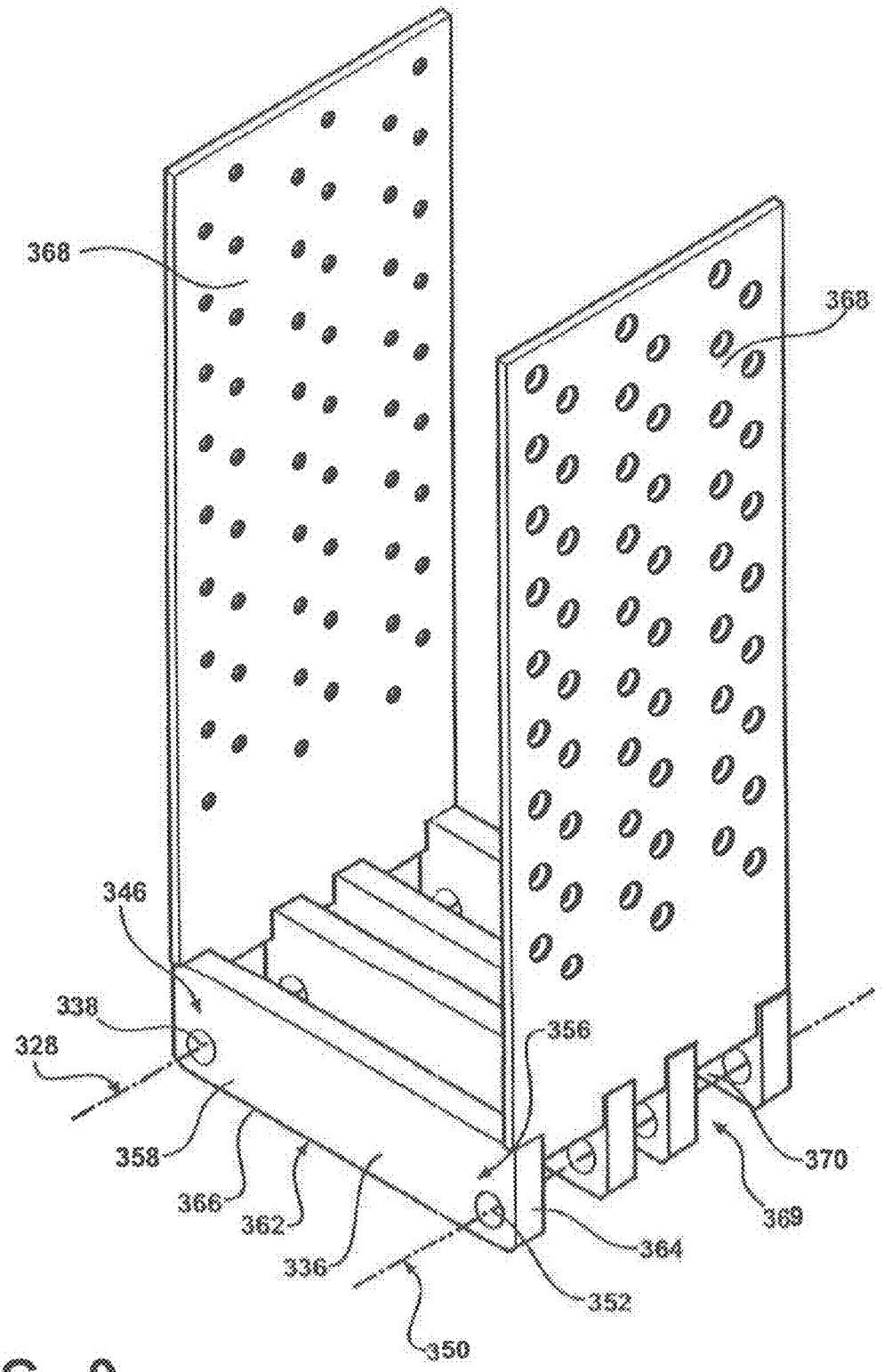
FIG. 9 is a perspective view of a hinge for a third alternative of an upper piling.

Another type of reinforcing cage 320 is shown in FIG. 6. Here, the reinforcing cage 320 is precast in concrete 322. Within the reinforcing cage 320 are a plurality of two-piece vertical reinforcing rods 323, attached to a plurality of horizontally placed rods 325 that form a footing (not shown). Each of the two-piece vertical reinforcing rods 323 are comprised of a lower vertical reinforcing tube 329, which is internally threaded and integral to the reinforcing cage 320, and an upper vertical reinforcing rod 331, which has a lower threaded end for threaded engagement of the lower tube 329. To provide additional support to the reinforcing cage 320, a plurality of vertically fixed reinforcing rods 319 and a plurality of vertically spaced hoops 321 form a square perimeter. The lower piling 312 is precast about the reinforcing cage 320 with vertical holes (not shown) that extend from the first end 314 to the lower vertical reinforcing tube 329. On the job site, a portion of the lower piling 312 can be cut off to a preferred height. This allows flexibility to level the lower pilings 312 once they are inserted into the ground, prior to connection to the upper pilings 330. After the pilings 312 are trimmed to the desired height at the job site, upper vertical reinforcing rods 331 are inserted through holes 313 in a lower hinge 324, into the vertical holes and then threaded into the lower vertical reinforcing tubes 329. Additionally, a plurality of thru-holes 333 can be precast into the concrete 322 to facilitate attachment of various framing pieces F, concrete anchors, etc. to the lower piling 312. Typically, a hole is dug into the earth for receiving a portion of the lower piling 312. Following excavation of the hole, the second end 316, and a portion of the concrete 322, is buried below ground. Finally, the hole is back filled with dirt, concrete or any other suitable material.

To provide an attachment scheme for the upper piling 330, the lower hinge 324 extends from the first end 314 and defines at least one lower first hole 326 on a first axis 328 that is spaced from the first end 314. The upper piling 330 has a column 332 and a second longitudinal axis 334 extending therethrough. Typically, the column 332 is comprised of wood, steel, aluminum or a composite. The upper hinge 336 extends from the column 332 and defines at least one upper first hole 338 on the first axis 328. The lower hinge 324 also defines a lower second hole 348, on a second axis 350 which is spaced transversely across the lower piling 312 from the lower first hole 326 and spaced from the first end 314. The upper hinge 336 also defines an upper second hole 352, on the second axis 350, which is spaced transversely across the upper piling 330 from the upper first hole 338.

Figure 10:
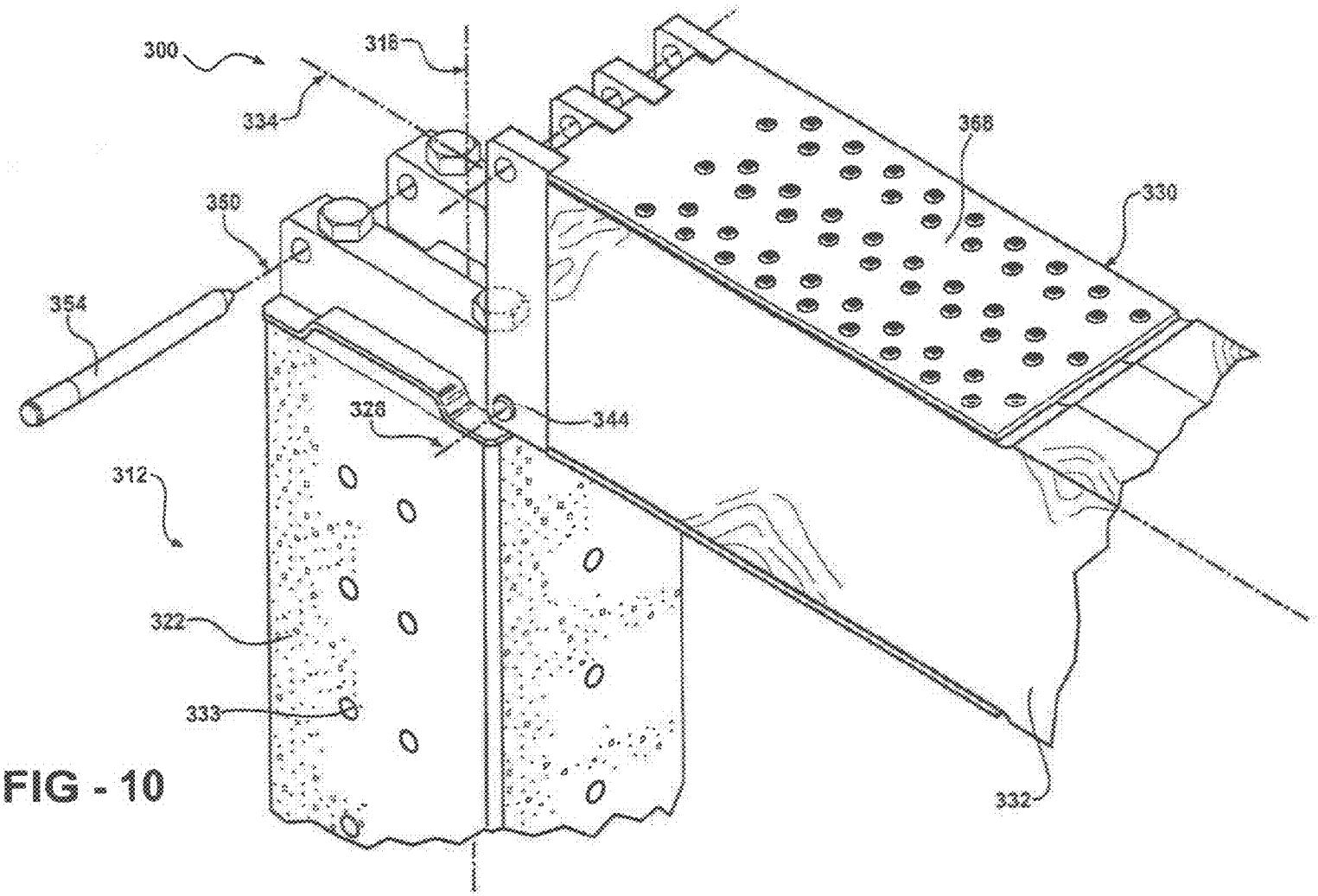
FIG. 10 is a perspective view of the hinged connection between the upper and lower piling for a third alternative of a piling assembly with the upper piling tilted away from the lower piling about a pin.
Figure 11:
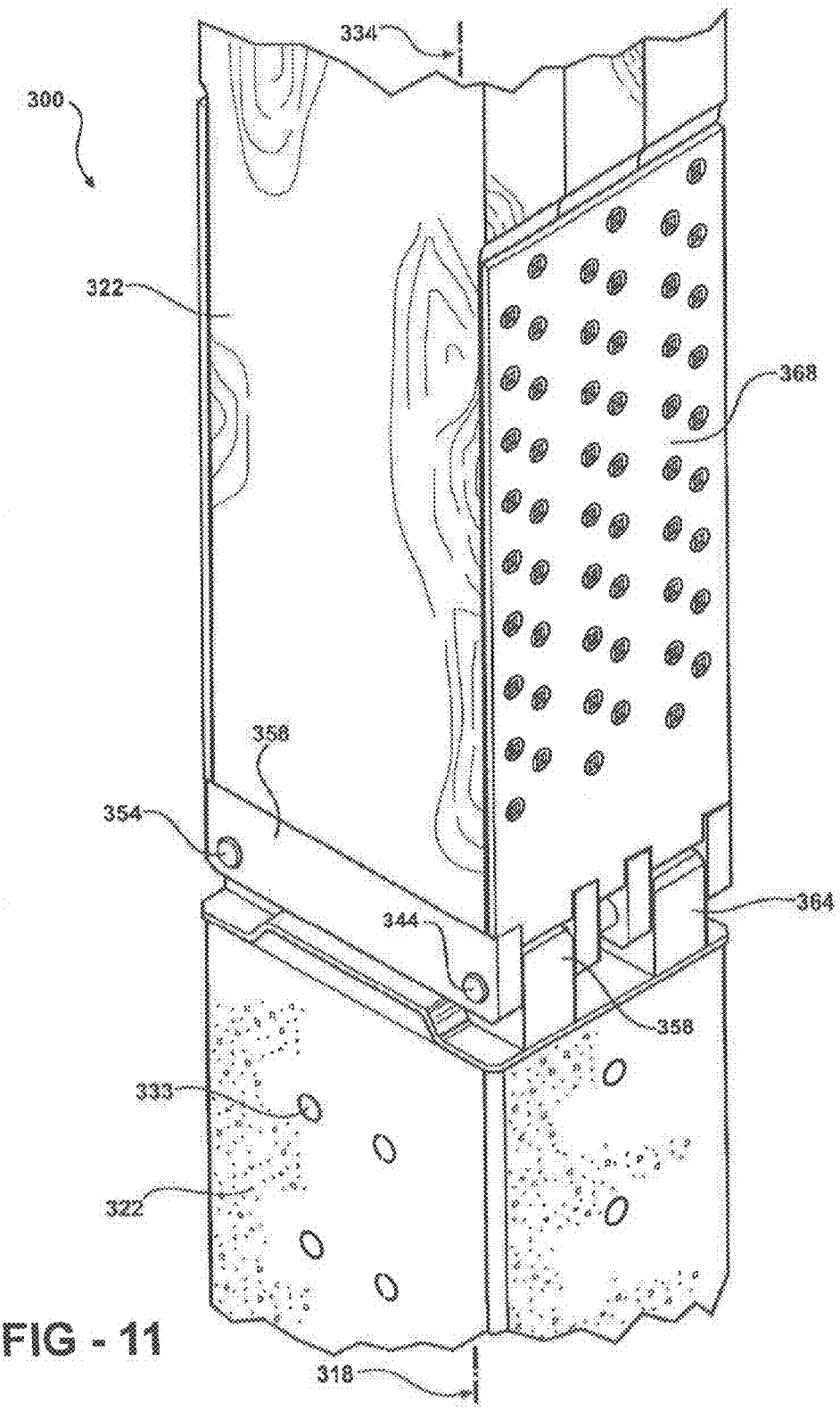
FIG. 11 is a perspective view of the hinged connection between the upper and lower piling for a third alternative of a piling assembly with the upper and lower piling in the upright and locked positions.
Figure 16:
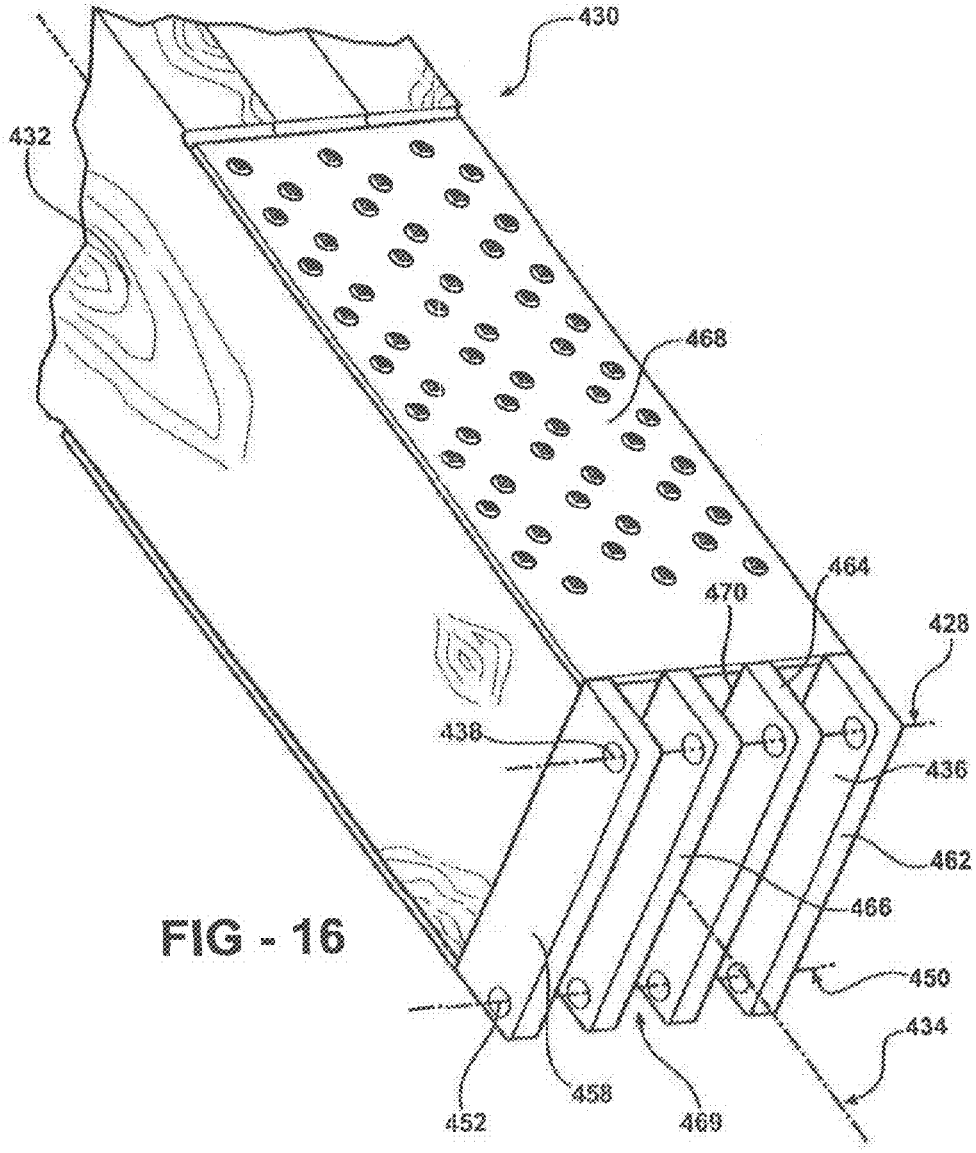
FIG. 16 is a perspective view of a hinge for a fourth alternative of an upper piling.

In the early stages of building construction, the upper and lower hinges 336, 324 are partially interleaved, as shown in FIG. 10, such that only a first pin 344 connects the upper hinge 336 to the lower hinge 324, along the first axis 328, and the second longitudinal axis 334, for the upper piling 330, is at an angle to the first longitudinal axis 318, for the lower piling 312. As a result, the columns 332 for the building can set tilted onto the ground. This position allows wall girts G to be connected to the columns 332 to facilitate the framing of an entire wall, or at least a portion of a wall, at ground level. Once the framing with the wall girts G is completed, the upper pilings 330 that form an entire wall, or a portion of a wall, are hoisted upward as a single unit, pivoting about the first pin 344 on the first axis 328. Then, the upper pilings 330 are hoisted upward, about the first axis 328, until the upper and lower hinges 336, 324 are completely interleaved with one another and the second axes 350, for the upper and lower second holes 252, 248, are aligned. When the hinges 336, 324 are completely interleaved, the first pin 344 is extending through the upper and lower first holes 326, 338, on the first axis 328, to engage and support the hinges 336, 324. Likewise, a second pin 354 is extending through the upper and lower second holes 352, 348, on the second axis 350, to engage and support the hinges 336, 324 when the longitudinal axes 318, 334 are aligned, as shown in FIG. 11.

Each of the upper and lower hinges 336, 324 include a first plurality of hinge knuckles 346, disposed about the first pin 344, where the knuckles 346 of the upper hinge 336 are interleaved with the knuckles 346 of the lower hinge 324. The knuckles 346 hold the first pin 344 in spaced relationship to the upper and lower pilings 330, 312 to transmit longitudinal forces between the pilings 330, 312 through the first pin 344. These forces include the loads resulting from the weight of the wall girts G, the roof, various other building materials and environmental factors. Similarly, the hinges 336, 324 include a second plurality of locking knuckles 356 that are disposed about the second pin 354 with the locking knuckles 356 of the upper hinge 336 interleaved with the locking knuckles 356 of the lower hinge 324. The locking knuckles 356 hold the second pin 354 in spaced relationship to the pilings 330, 312 to transmit longitudinal forces between the pilings 330, 312 totally through the first and second pins 344, 354. Therefore, the pins 344, 354 support the entire load provided by the upper pilings 330, wall girts G, the roof, various other building materials and environmental factors.

Each of the hinges 336, 324 includes a plurality of plates 358 that are in spaced and parallel relationship. A gap 369 is defined between each of the plates 358 to facilitate the upper hinge 336 interleaving with the lower hinge 324. The first hole 326 or 338 is defined through each of the plates 358, along the first axis 328. The second hole 348 or 352 is also defined through each of the plates 358, along the second axis 350, and spaced transversely across each of the plates 358 from the first hole 326 or 338, respectively. Furthermore, the plates 358 define a bottom edge 362 and end edges 364.

The lower hinge 324 is attached to the reinforcing cage 320 of the lower piling 312 along the bottom edge 362 and the lower holes 326, 348 are in spaced relationship from the lower piling 312. The upper hinge 336 includes a bottom 366 and a pair of opposing walls 368 that extend upward from the bottom 366, along the column 332. The bottom edge 362 of each of the plates 358 are attached to the bottom 366 of the lower hinge 324 and the end edges 364 of each of the plates 358 are attached to the opposing walls 368. Furthermore, the bottom 366 and the opposing walls 368 define a plurality of grooves 370 that extend in spaced and parallel relationship across the bottom 366 and into a portion of the walls 368, between each of the plates 358. The grooves 370 allow the plates 358 of the lower hinge 324 to interleave with the plates 358 of the upper hinge 336.

Another embodiment of a piling assembly 400, shown in FIGS. 12-18, comprises a height adjustable lower piling 412 hingedly connected to an upper piling 430. The lower piling 412 has a first and a second end 414, 416 with a first longitudinal axis 418 extending therethrough. The upper piling 430 has a column 432 with a second longitudinal axis 434 extending therethrough.

Another type of reinforcing cage 420 is shown in FIG. 12. Here, a plurality of vertically extending reinforcing rods 423 defines the perimeter of the reinforcing cage 420. Additionally, vertically spaced wire 221 encircles the outer perimeter of the vertically extending rods 423 to provide additional reinforcement for the reinforcing cage 420. The vertical rods 423 flare outward at the second end 416 to form a footing 427. The vertical rods 423 extend beyond the precast concrete 422 at the first end 414, terminating at threaded ends 415. The lower piling 412 is precast off-site and a plurality of thru-holes 433 can be precast into the concrete 422 to attach various framing pieces F, concrete anchors, etc. to the lower piling 412. Typically, a hole is dug into the earth for receiving a portion of the lower piling 412. Following excavation of the hole, the second end 416, and a portion of the lower piling 412, is buried below ground. Finally, the hole is back filled with dirt, concrete or any other suitable material. To level the first ends 414 of the lower pilings 412, once the lower pilings 412 are set in the ground, shims 435 are placed over the threaded ends 414. Once the proper height is achieved, a lower hinge 424 is also placed over the threaded ends 414 and fastened in place with nuts 437.

To provide an attachment scheme for the upper piling 430, the lower hinge 424 extends from the first end 414 and defines at least one lower first hole 426 on a first axis 428 that is spaced from the first end 414. The upper piling 430 has a column 432 and a second longitudinal axis 434 extending therethrough. Typically, the column 432 is comprised of wood, steel, aluminum or a composite. The upper hinge 436 extends from the column 432 and defines at least one upper first hole 438 on the first axis 428. The lower hinge 424 also defines a lower second hole 448, on a second axis 450 which is spaced transversely across the lower piling 412 from the lower first hole 426 and spaced from the first end 414. The upper hinge 436 also defines an upper second hole 452, on the second axis 450, which is spaced transversely across the upper piling 430 from the upper first hole 438.

Figure 17:
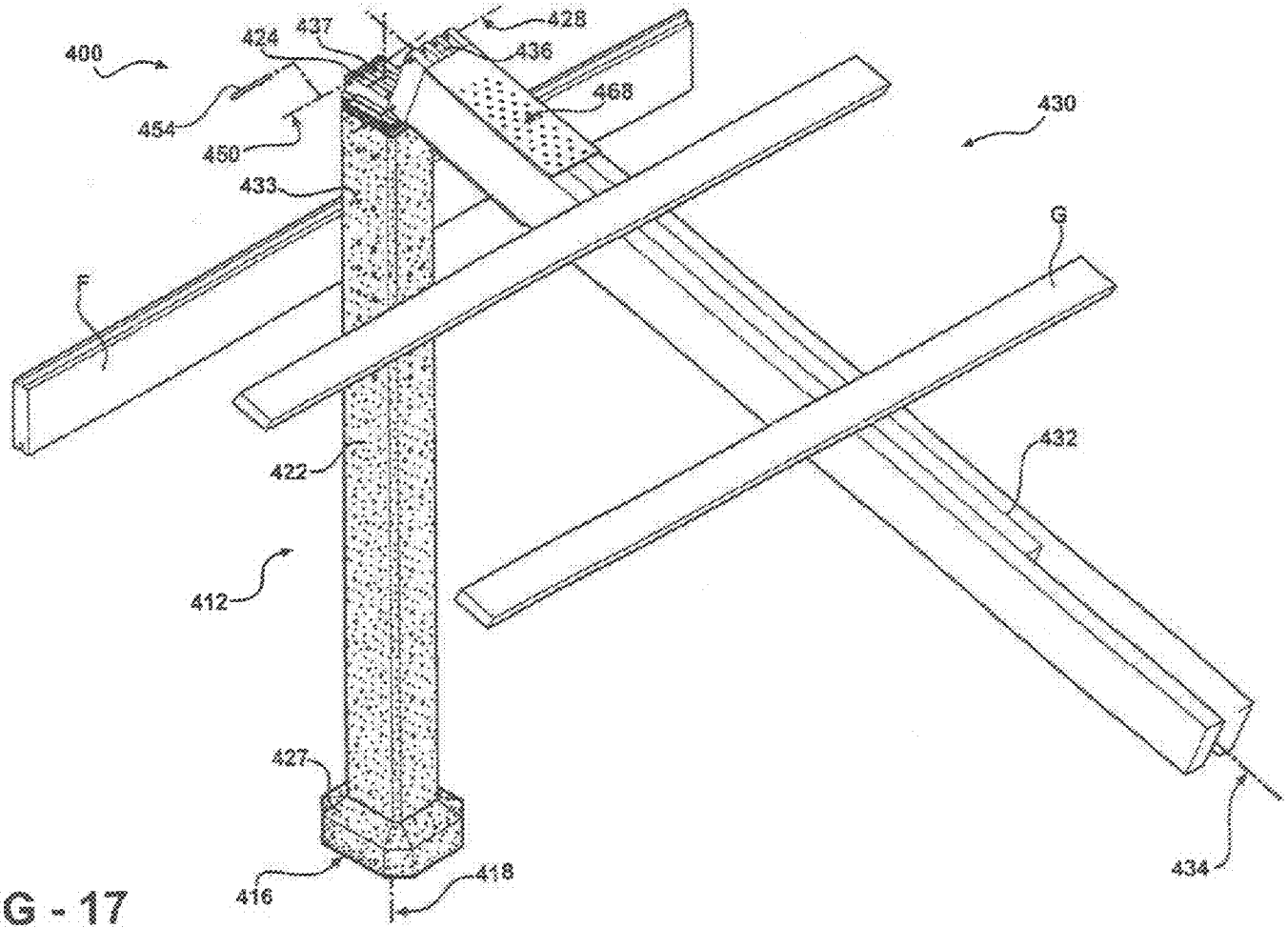
FIG. 17 is a perspective view of a hinged connection between the upper and lower piling for a fourth alternative of a piling assembly with the upper piling tilted away from the lower piling about a pin.
Figure 18:
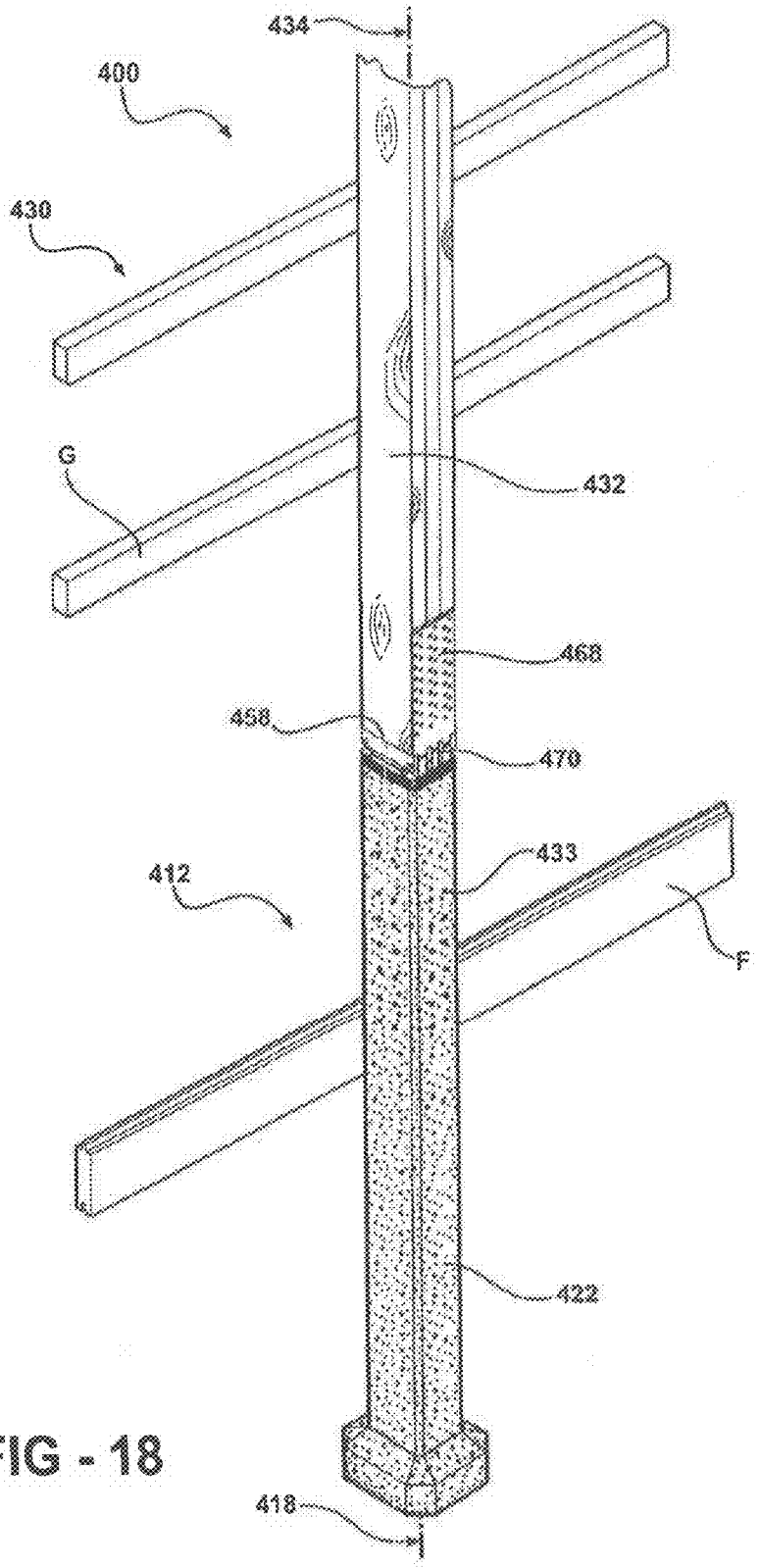
FIG. 18 is a perspective view of the hinged connection between the upper and lower piling for a fourth alternative of a piling assembly with the upper and lower piling in the upright and locked positions.

In the early stages of building construction, the upper and lower hinges 436, 424 are partially interleaved, as shown in FIG. 17, such that only a first pin 444 connects the upper hinge 436 to the lower hinge 424, along the first axis 428, and the second longitudinal axis 434, for the upper piling 430, is at an angle to the first longitudinal axis 418, for the lower piling 412. As a result, the columns 432 for the building can set tilted onto the ground. This position allows wall girts G to be connected to the columns 432 to facilitate the framing of an entire wall, or at least a portion of a wall, at ground level. Once the framing with the wall girts G is completed, the upper pilings 430 that form an entire wall, or a portion of a wall, are hoisted upward as a single unit, pivoting about the first pin 444 on the first axis 428. Then, the upper pilings 430 are hoisted upward, about the first axis 428, until the upper and lower hinges 436, 424 are completely interleaved with one another and the second axes 450, for the upper and lower second holes 452, 448, are aligned. When the hinges 436, 424 are completely interleaved, the first pin 444 is extending through the upper and lower first holes 426, 438, on the first axis 428, to engage and support the hinges 436, 424. Likewise, a second pin 454 is extending through the upper and lower second holes 452, 448, on the second axis 450, to engage and support the hinges 436, 424 when the longitudinal axes 418, 434 are aligned, as shown in FIG. 18.

Each of the upper and lower hinges 436, 424 include a first plurality of hinge knuckles 446, disposed about the first pin 444, where the knuckles 446 of the upper hinge 436 are interleaved with the knuckles 446 of the lower hinge 424. The knuckles 446 hold the first pin 444 in spaced relationship to the upper and lower pilings 430, 412 to transmit longitudinal forces between the pilings 430, 412 through the first pin 444. These forces include the loads resulting from the weight of the wall girts G, the roof, various other building materials and environmental factors. Similarly, the hinges 436, 424 include a second plurality of locking knuckles 456 that are disposed about the second pin 454 with the locking knuckles 456 of the upper hinge 436 interleaved with the locking knuckles 456 of the lower hinge 424. The locking knuckles 456 hold the second pin 454 in spaced relationship to the pilings 430, 412 to transmit longitudinal forces between the pilings 430, 412 totally through the first and second pins 444, 454. Therefore, the pins 444, 454 support the entire load provided by the upper pilings 430, wall girts G, the roof, various other building materials and environmental factors.

Each of the hinges 436, 424 includes a plurality of plates 458 that are in spaced and parallel relationship. A gap 469 is defined between each of the plates 458 to facilitate the upper hinge 436 interleaving with the lower hinge 424. The first hole 426 or 438 is defined through each of the plates 458, along the first axis 428. The second hole 448 or 452 is also defined through each of the plates 458, along the second axis 450, and spaced transversely across each of the plates 458 from the first hole 426 or 438 respectively. Furthermore, the plates 458 define a bottom edge 462 and end edges 464.

The lower hinge 424 is attached to the reinforcing cage 420 of the lower piling 412 along the bottom edge 462 and the holes 426, 448 are in spaced relationship from the lower piling 412. The upper hinge 436 includes a bottom 466 and a pair of opposing walls 468 that extend upward from the bottom 466, along the column 432. The bottom edge 462 of each of the plates 458 are attached to the bottom 466 of the lower hinge 424 and the end edges 464 of each of the plates 458 are attached to the opposing walls 468. Furthermore, the bottom 466 and the opposing walls 468 define a plurality of grooves 470 that extend in spaced and parallel relationship across the bottom 466 and into a portion of the walls 468, between each of the plates 458. The grooves 470 allow the plates 458 of the lower hinge 424 to interleave with the plates 458 of the upper hinge 436.

The next embodiment of the piling assembly 500, shown in FIGS. 19-39, comprises another type of height adjustable lower piling 512, i.e., jack piling assembly, hingedly connected to an upper piling 530. The lower piling 512 has a first end 514, i.e., a top, and a second end 516, i.e., a bottom, with a first longitudinal axis 518 extending therethrough. The upper piling 530 has a column 532 with a second longitudinal axis 534 extending therethrough.

Figure 19:
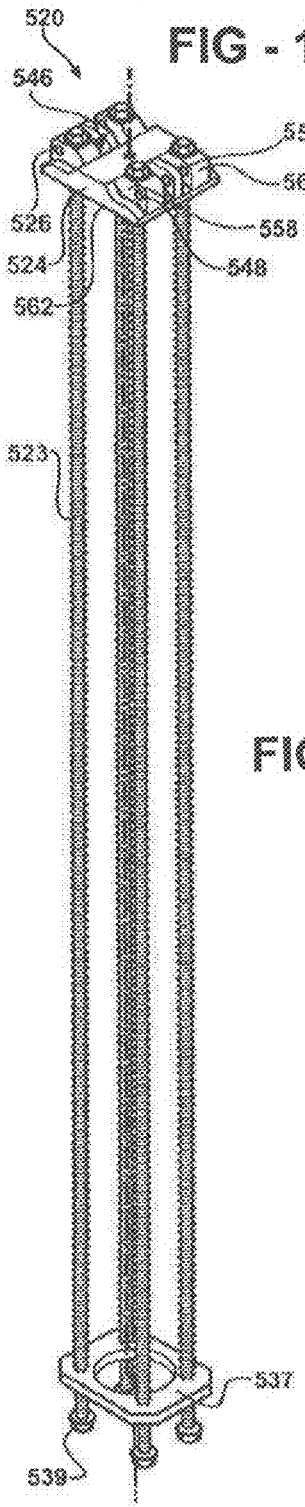
FIG. 19 is a perspective view of a reinforcing cage for a fifth alternative of a piling assembly.
Figure 32:
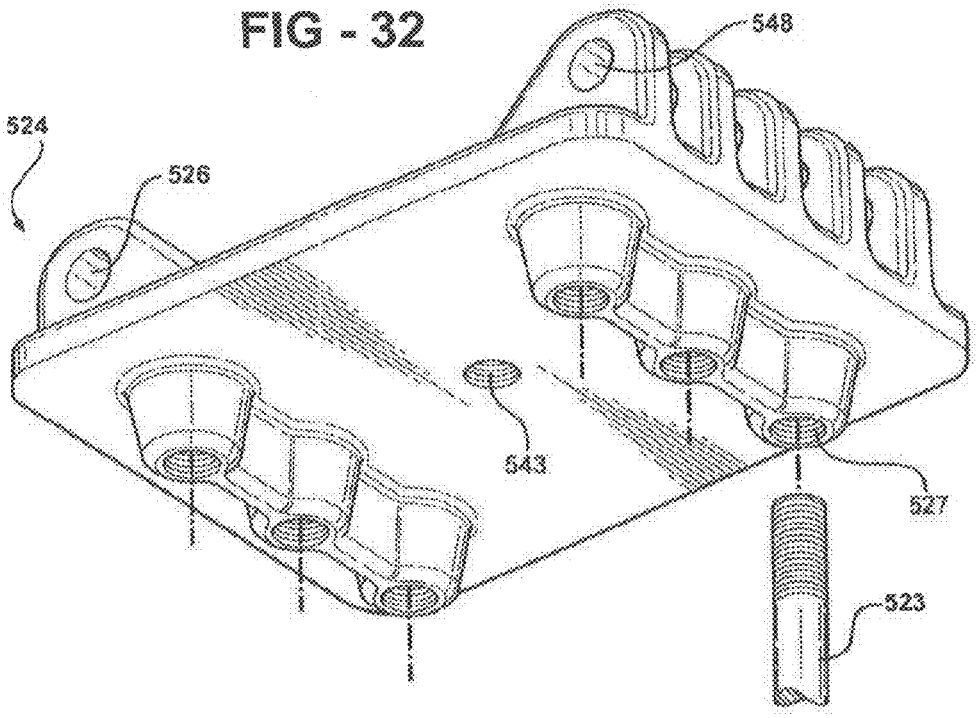
FIG. 32 is a perspective bottom view of a top plate and a top retention device for a fifth alternative of a piling assembly.
Figure 33:
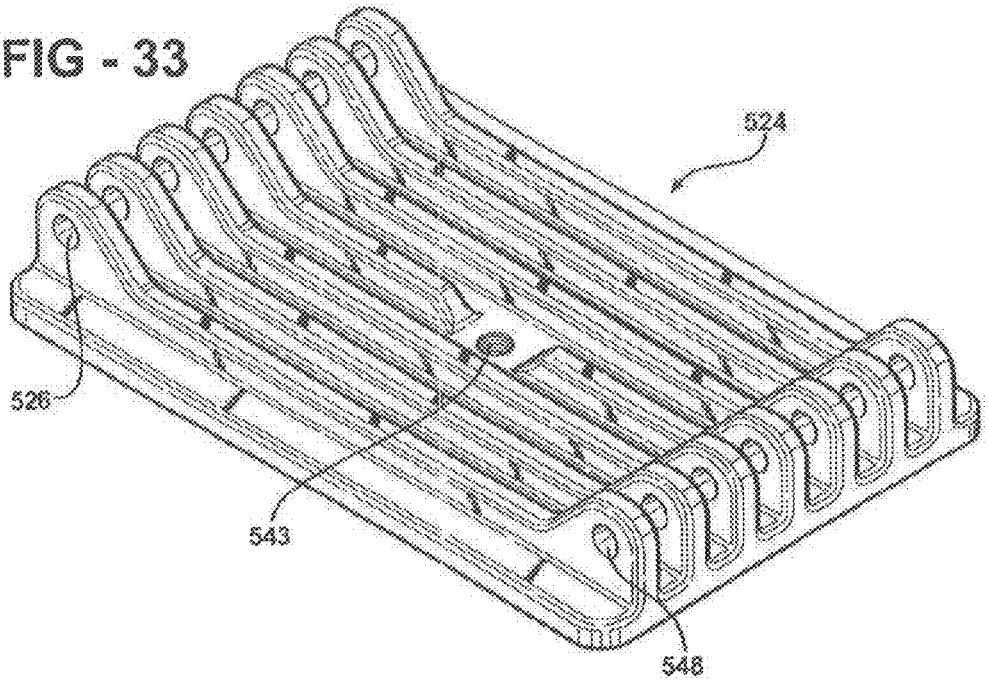
FIG. 33 is a perspective top view of a top plate for a jack piling assembly.
Figure 34:
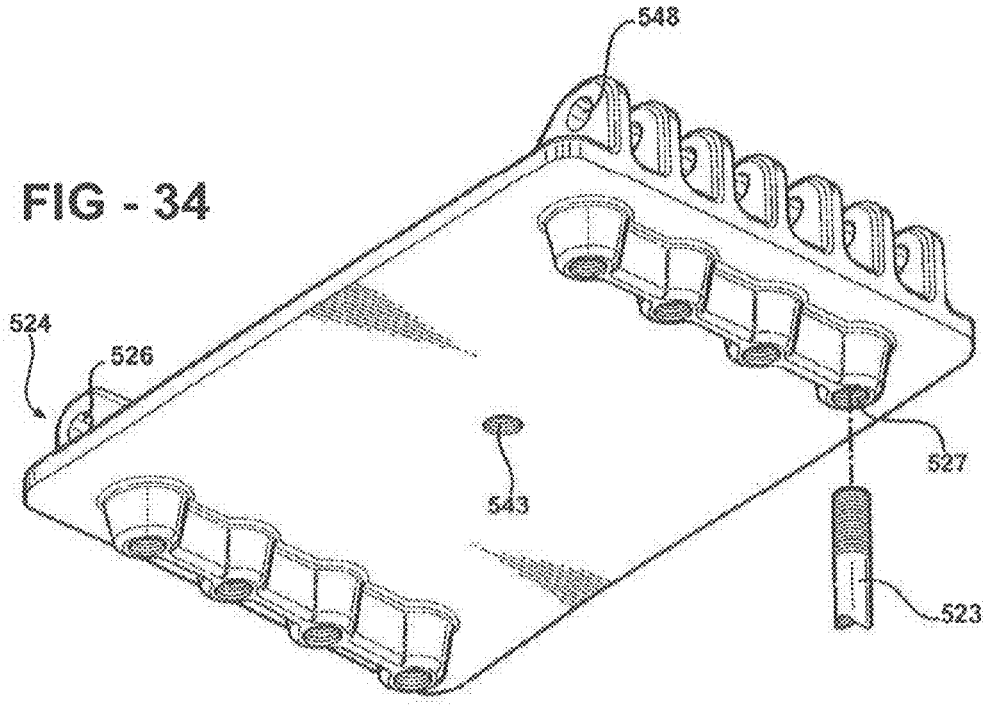
FIG. 34 is a perspective bottom view of a top plate and a top retention mechanism for a fifth alternative of a piling assembly.

This embodiment uses a height adjustable reinforcing cage 520, as shown in FIG. 19. With this type of a height adjustable reinforcing cage 520, concrete 522 is precast into the shape of a lower piling 512 with a plurality of vertically extending holes (not shown), extending between the first and second end 514, 516. These holes can be lined with cast-in-place plastic tubing 521 which allow for the insertion and removal of post-tensioning rods 523 as one way to facilitate height adjustment of the lower piling 512. Prior to shipment to the job site, the vertically threaded post-tensioning rods 523 are preferably threaded into threaded bosses 527 that act as upper retention mechanisms disposed on the underside of a lower hinge 524, i.e., top plate, as shown in FIGS. 32 and 34. However, post-tensioning rods 523 can also be inserted through each of a plurality of vertically extending holes (not shown) in the lower hinge 524, at the first end 514, and extending through the vertical holes in the lower piling 512. Additionally, the post-tensioning rods 523 extend out of, and beyond, the second end 516 and are inserted through one or more uplift extensions 529 at the second end 516 of the lower piling 512 and secured with a nut or other suitable fastener that act as lower retention mechanisms 547, as shown in FIG. 36. The nuts are then tightened to post-tension the lower piling 512.

Figure 22:
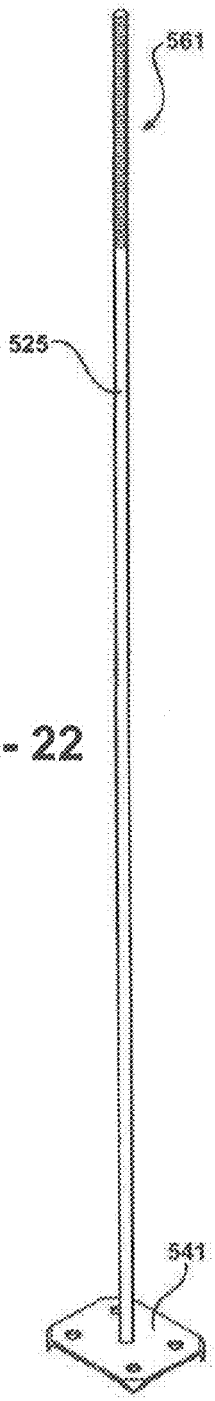
FIG. 22 is a perspective view of a push rod assembly for a fifth alternative of a piling assembly.
Figure 23:
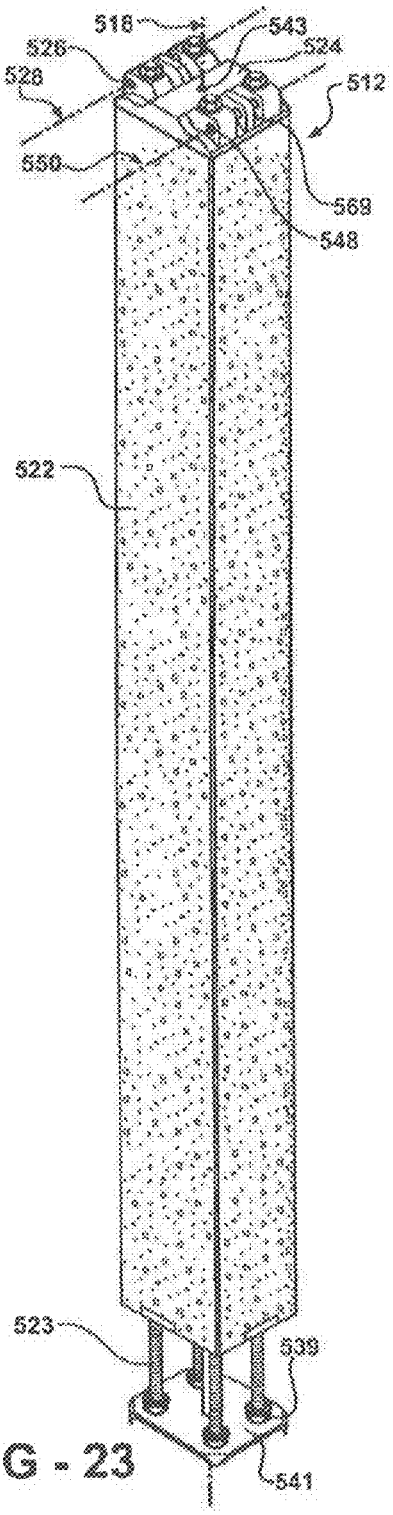
FIG. 23 is a perspective view of an assembled lower reinforcing cage encased in concrete for a fifth alternative of a piling assembly.
Figure 20:
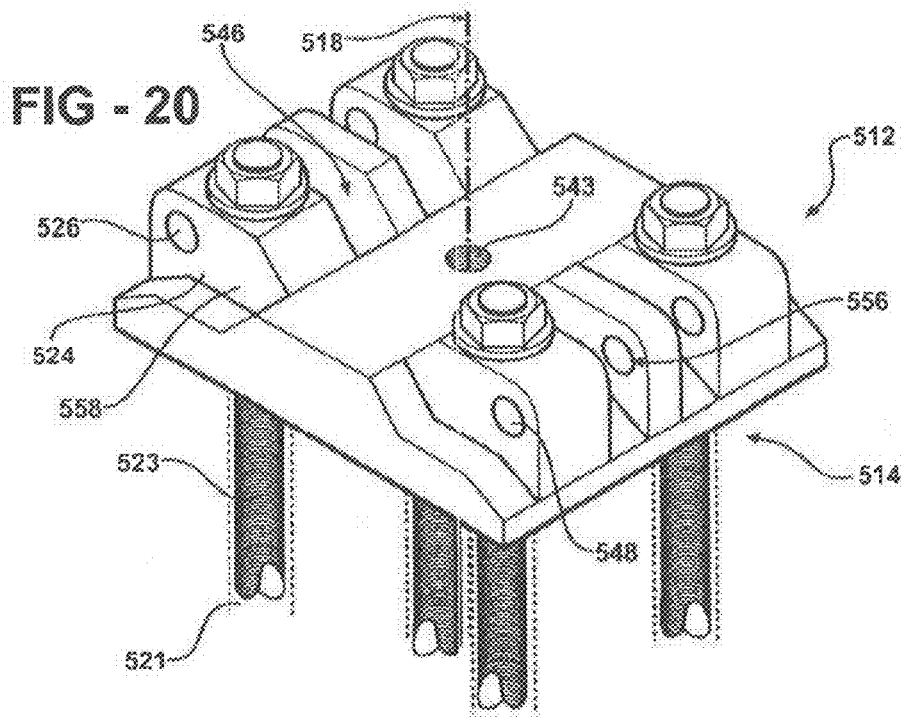
FIG. 20 is a perspective view of a first end of a reinforcing cage for a lower piling for a fifth alternative of a piling assembly.
Figure 21:
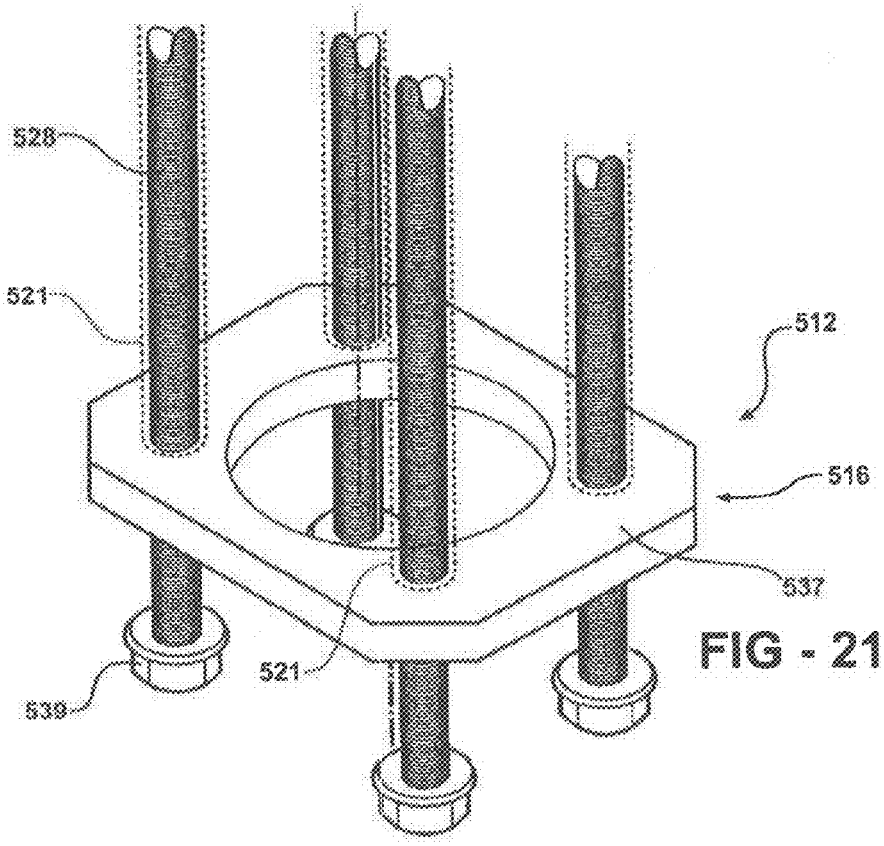
FIG. 21 is a perspective view of a second end of a reinforcing cage for a lower piling for a fifth alternative of a piling assembly.
Figure 24:
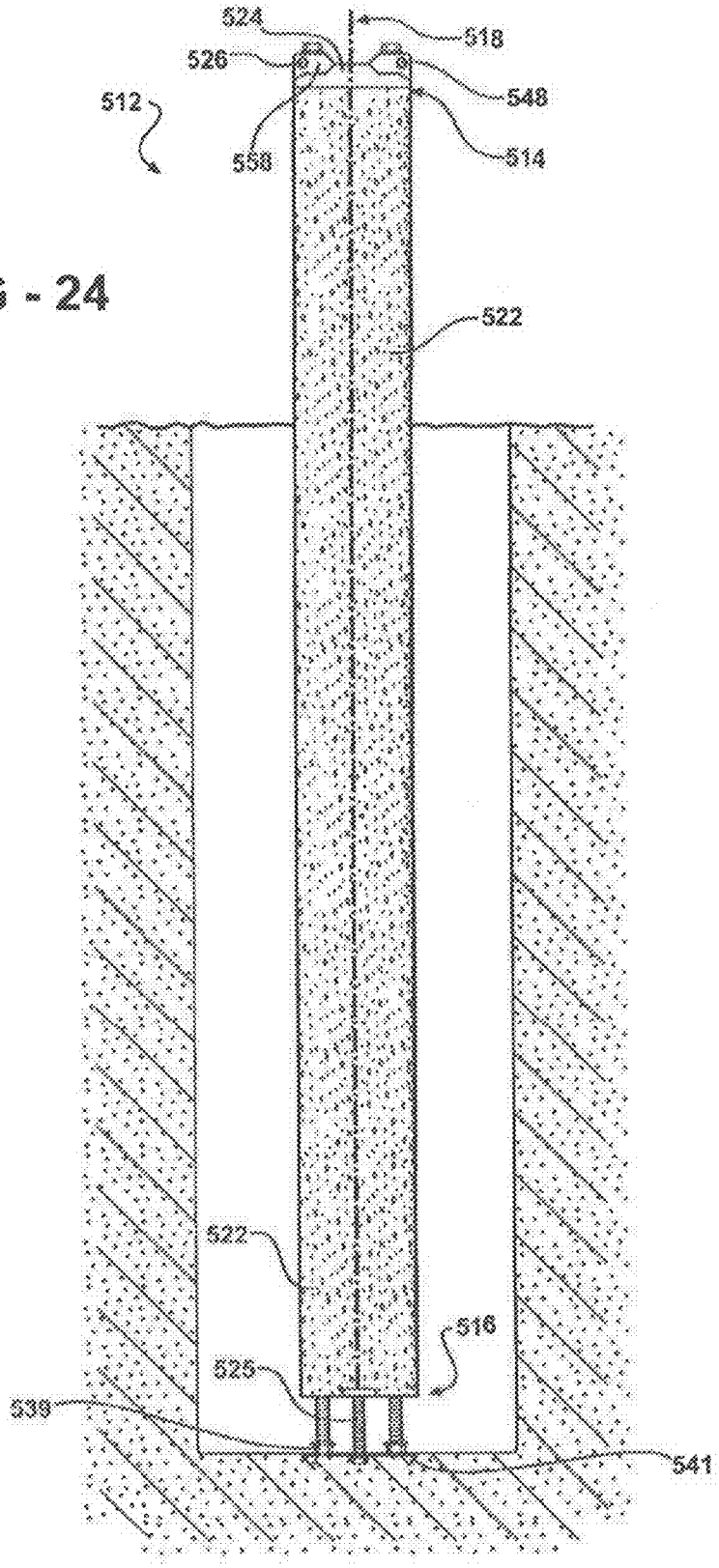
FIG. 24 is a sectional view of a lower piling for a fifth alternative of a piling assembly inserted into the ground with the column in the lowered position.
Figure 25:
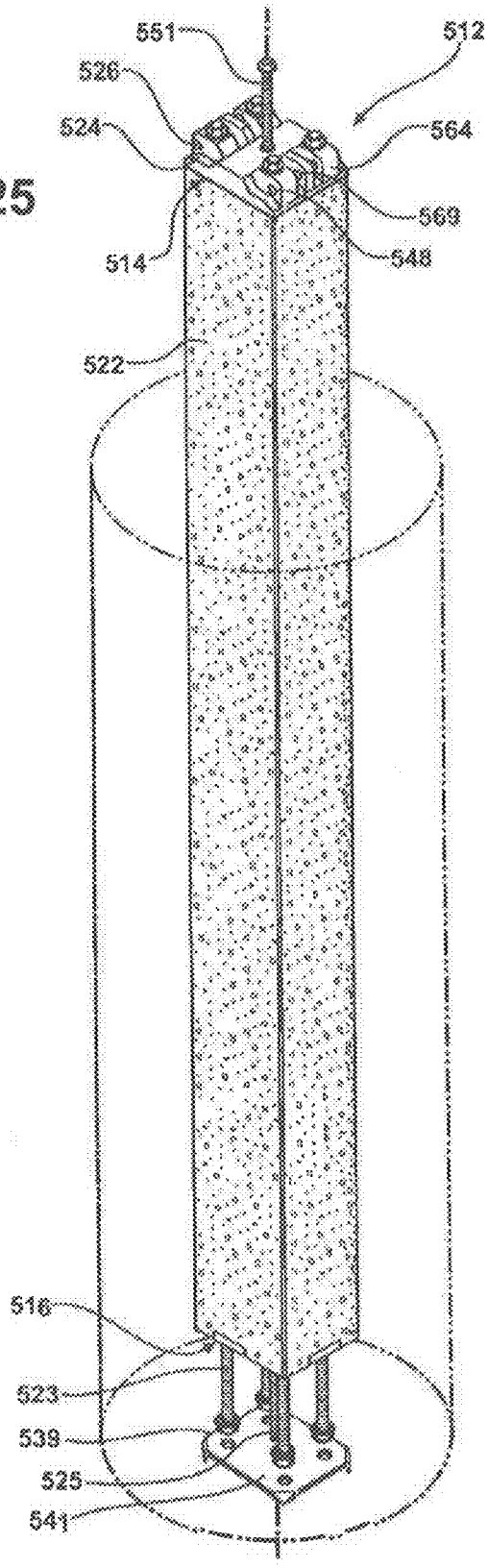
FIG. 25 is a perspective view of a lower piling for a fifth alternative of a piling assembly inserted into the ground with the push rod mechanism threaded into the center hole.
Figure 26:
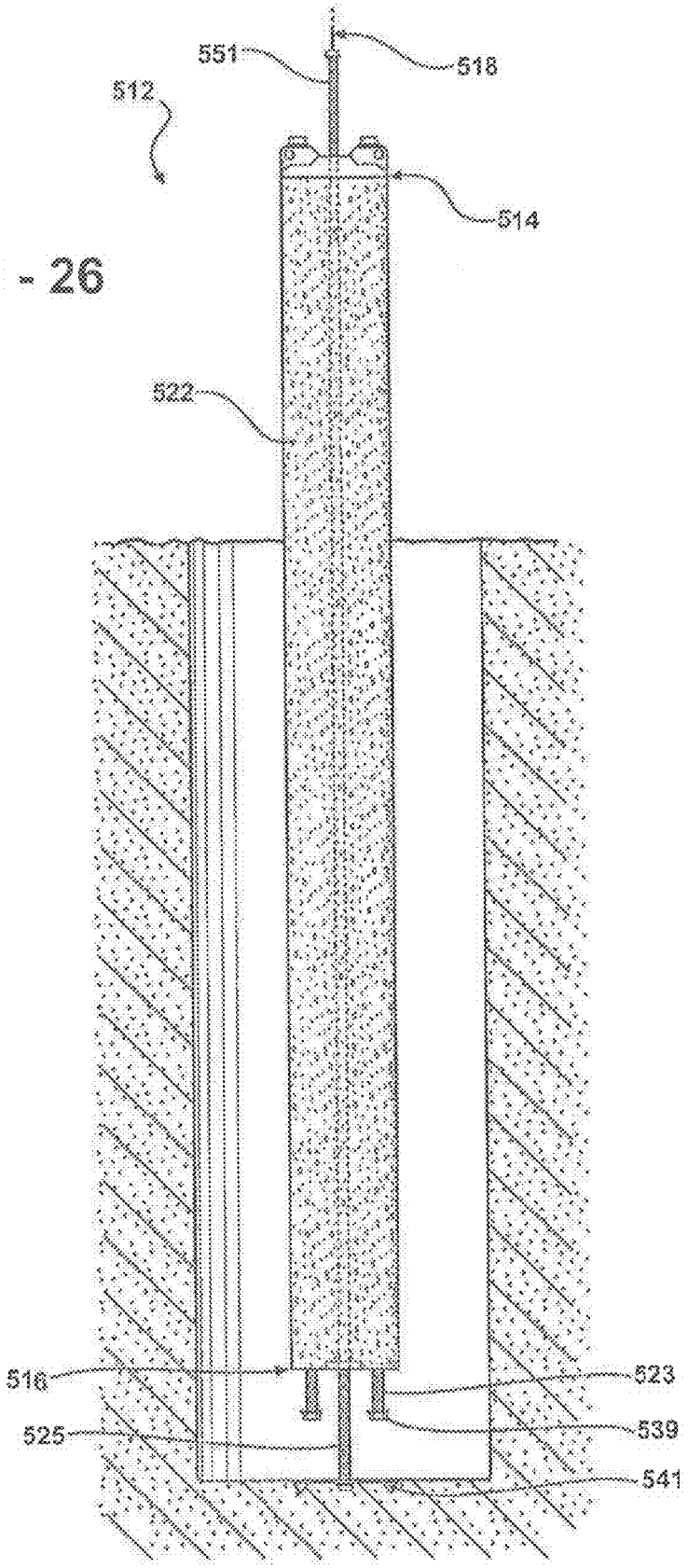
FIG. 26 is a sectional view of a lower piling for a fifth alternative of a piling assembly inserted into the ground with the push rod mechanism threaded into the center hole and the lower piling in the raised position.
Figure 27:
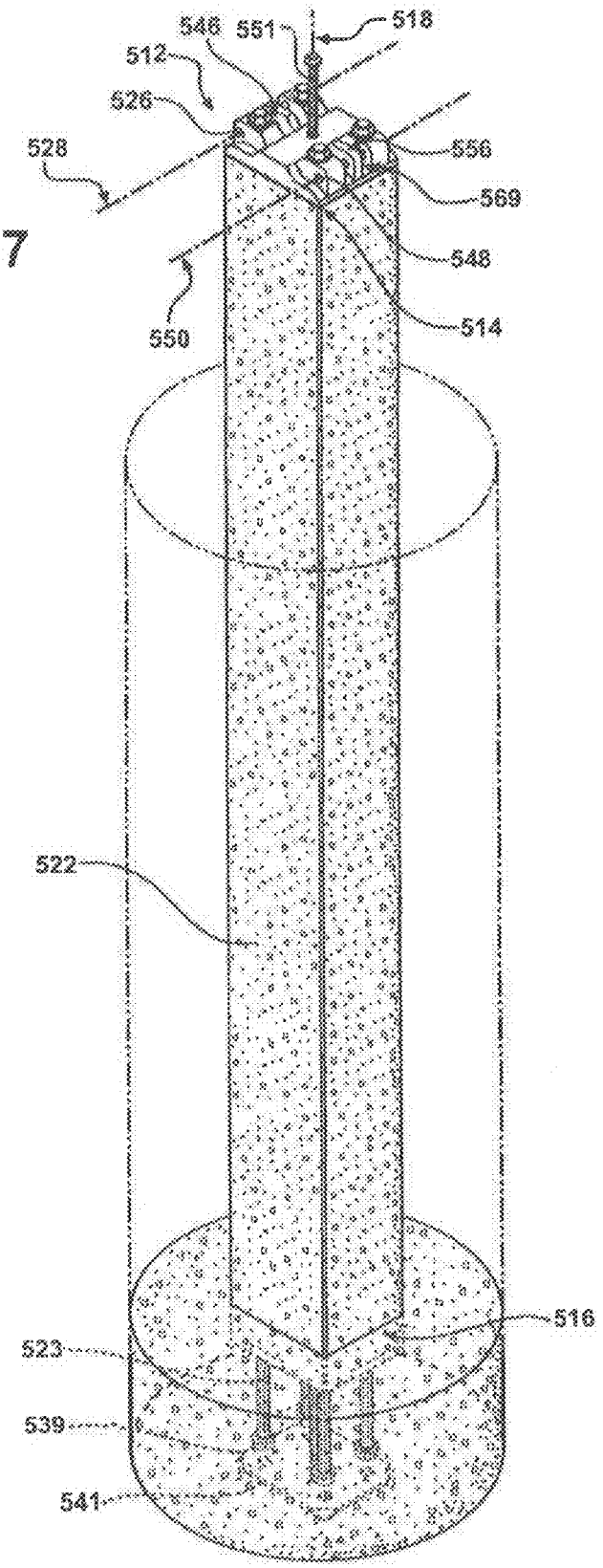
FIG. 27 is a perspective view of a lower piling for a fifth alternative of a piling assembly inserted into the ground with the push rod mechanism threaded into the center hole and the lower piling in the raised position and concrete poured to set the height.
Figure 28:
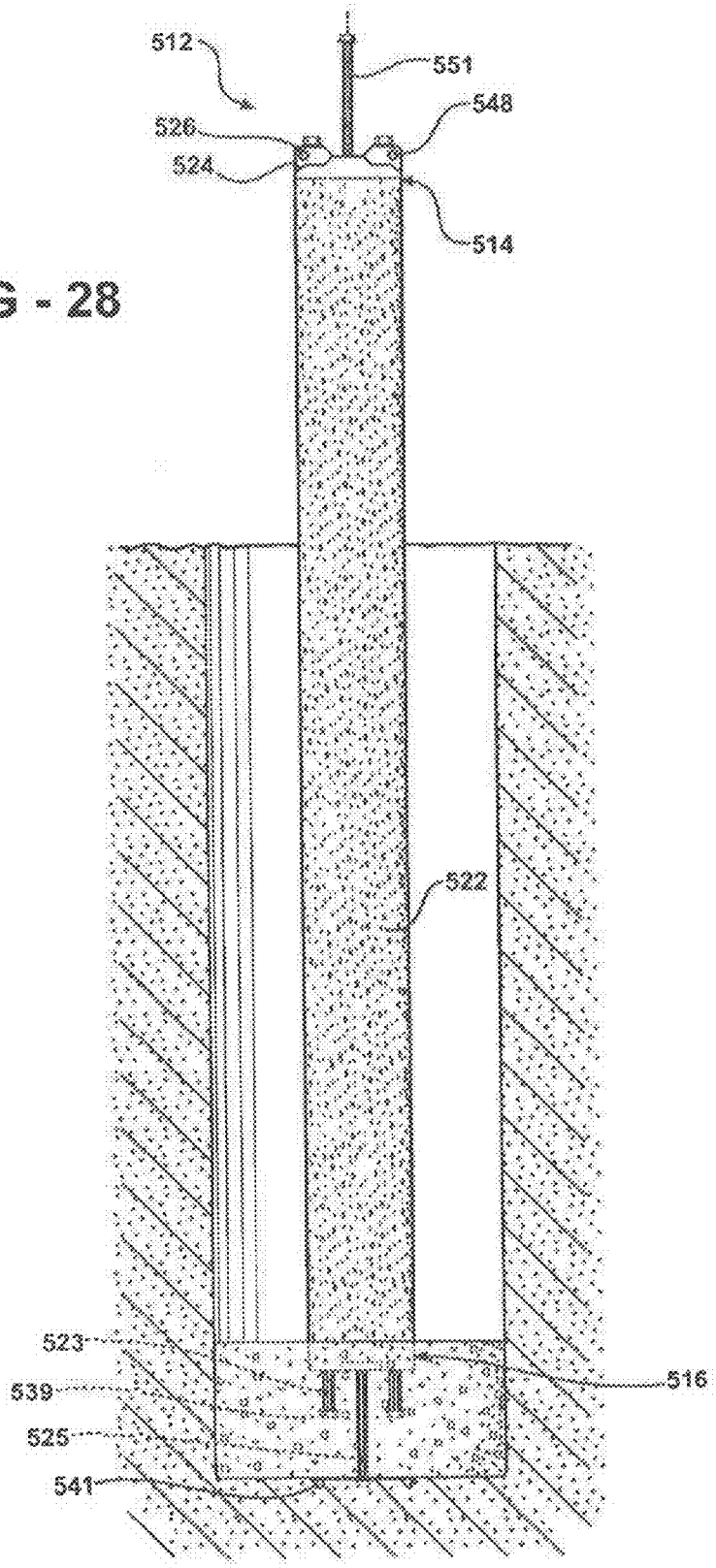
FIG. 28 is a sectional view of a lower piling for a fifth alternative of a piling assembly inserted into the ground with the push rod mechanism threaded into the center hole and the lower piling in the raised position and concrete poured to set the height.

Alternatively, the post-tensioning rods 523 can be threaded through corresponding holes on the base plate 537, each terminating at a flanged nut 539, as shown in FIGS. 21 and 22. When using a base plate 537, flanged nuts 539 that are in spaced relationship to the base plate 537 are used in place of uplift extensions 529. As an alternative to threading the rods 523 through holes in the base plate, the holes in the base plate 537 can be oversized and additional nuts (not shown) can be used to secure the base plate 537 against the second end 516 of the lower piling 512 to post-tension the lower piling.

At the job site for constructing the building, if the height of the lower piling 512 needs to be reduced, the post-tensioning rods 523, lower hinge 524 and base plate 537 are initially removed and the concrete 522 is cut to the desired height. Following trimming of the lower piling 512, the rods 523, lower hinge 524 and base plate 537 are reassembled to the lower piling 512.

Additionally, a vertical hole, i.e., passage, (not shown) is cast into center of the concrete 522, extending between the first and second ends 514, 516 and along the first longitudinal axis 518. A vertical push rod 525 is attached to a bearing plate 541 with a nut 577 to create a push rod assembly 561, as shown in FIG. 22. The vertical push rod 525, with the bearing plate 541 attached, is inserted into the center hole of the lower piling 512, from the second end 516. Next, a hole for receiving the bearing plate 541, and a portion of the lower piling 512, is excavated into the earth to a floor, i.e., a surface. A plurality of downward projecting teeth 531 are disposed on the bearing plate 541 for improving the grip between the bearing plate 541 and the floor. Following excavation of the hole in the earth, the second end 516, and a portion of the lower piling 512, with the bearing plate 541 inserted therein, is placed into the hole in the earth and the bearing plate 541 is set onto the floor thereof to support the lower piling 512. Inside of the hole in the earth, the uplift extensions 529 are initially resting on the bearing plate 541. Likewise, if the flanged nuts 539 are used in lieu of the uplift extensions 529, the flanged nuts 539 are initially resting on the bearing plate 541.

To set the overall height of the lower piling 512, a threaded height adjustment mechanism 551, i.e., threaded shaft, having a head 535 disposed at one end thereof, is threadedly inserted through a center hole, i.e., passage, in the first end 514 at a threaded hole 543, i.e., threaded bore, in the lower hinge 524. Torque is applied to the height adjustment mechanism 551, via the head 535, to thread the height adjustment mechanism 551 into the lower piling 512 until the height adjustment mechanism 551 abuts the push rod. As torque is continued to be applied to the head 535, the mechanism 551 pushes against the push rod 525 of the push rod assembly 561, forcing the lower piling 512, and thus the uplift extensions 529 or flanged nuts 539, to move upward and away from the bearing plate 541. Once the desired height for the lower piling 512 is attained, concrete is poured into the hole in the earth, stopping at least two inches above the uplift extensions 529, and/or the base plate 537, to prevent the lower piling 512 from lifting out of the hole in the earth and to prevent the base plate 537 and/or the uplift extensions 529 from corroding. Once the concrete in the hole in the earth is adequately set, the height adjustment mechanism 551 is unthreaded and removed from the center hole in the lower piling 512. Finally, the hole in the earth is back filled with dirt, concrete or any other suitable material.

However, the jack piling assembly 512 is not limited to a post-tensioned concrete 522. A reinforced concrete 122, 222, 322, 422, such as those described in the previous four embodiments, or a pre-tensioned concrete can be used in lieu of post-tensioned concrete if they have a vertical hole, cast in the center along the first longitudinal axis 518, to facilitate height adjustment using the height adjustment mechanism 551 and the push rod assembly 561.

To provide an attachment scheme for the upper piling 530, the lower hinge 524, i.e., top plate, extends from the first end 514 and defines at least one lower first hole 526 on a hinge axis 528 that is spaced from the first end 514. The upper piling 530 has a column 532 and a second longitudinal axis 534 extending therethrough. Typically, the column 532 is comprised of wood, steel, aluminum or a composite. The upper hinge 536 extends from the column 532 and defines at least one upper first hole 538 on the hinge axis 528. The lower hinge 524 also defines a lower second hole 526, on a second axis 550 which is spaced transversely across the lower piling 512 from the lower first hole 550 and spaced from the first end 514. The upper hinge 536 also defines an upper second hole 552, on the second axis 550, which is spaced transversely across the upper piling 530 from the upper first hole 538.

Figure 29:
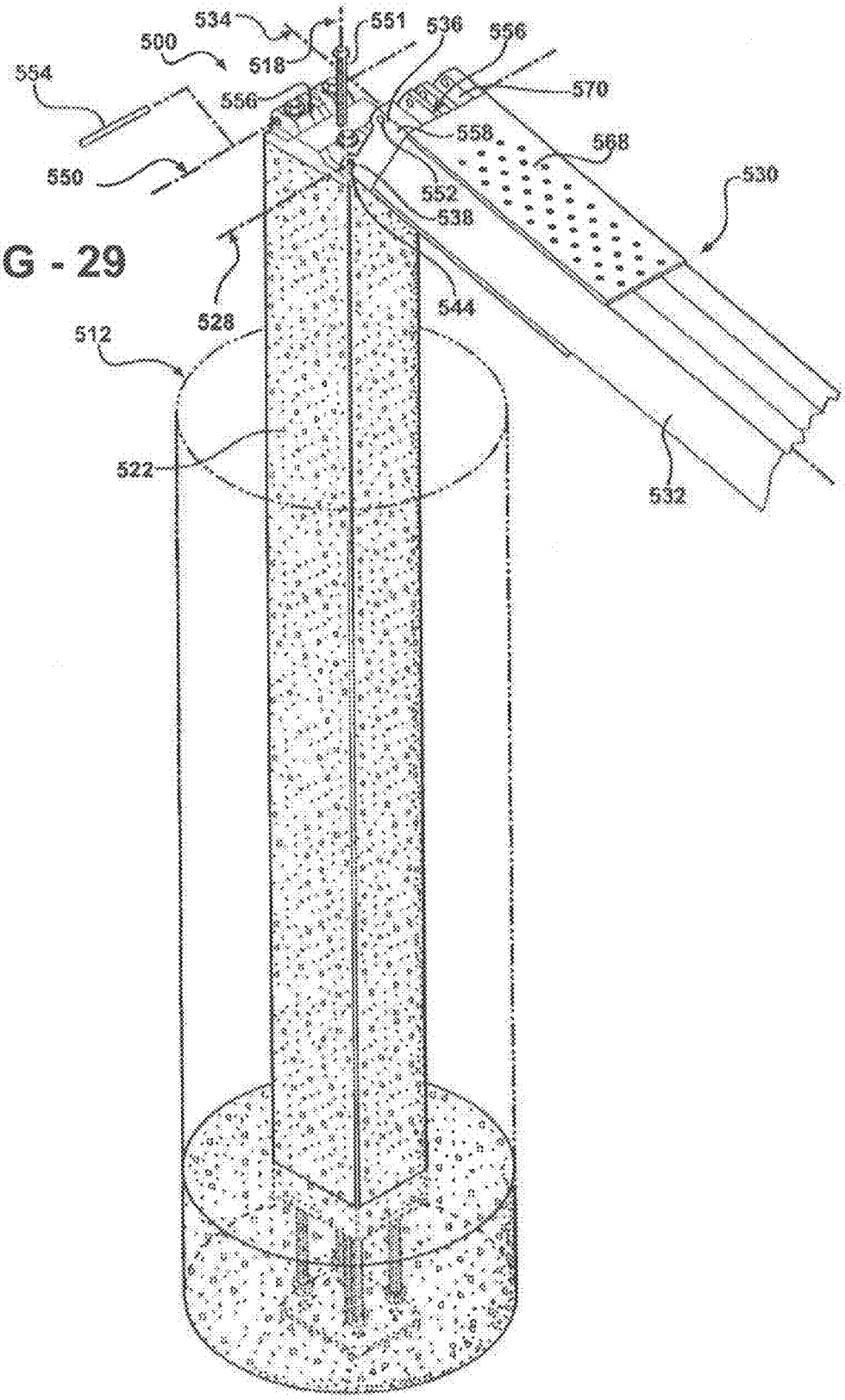
FIG. 29 is a perspective view of a lower piling assembly for a fifth alternative of a piling assembly set into the ground in the raised position with the upper piling tilted away from the lower piling about a pin.
Figure 30:
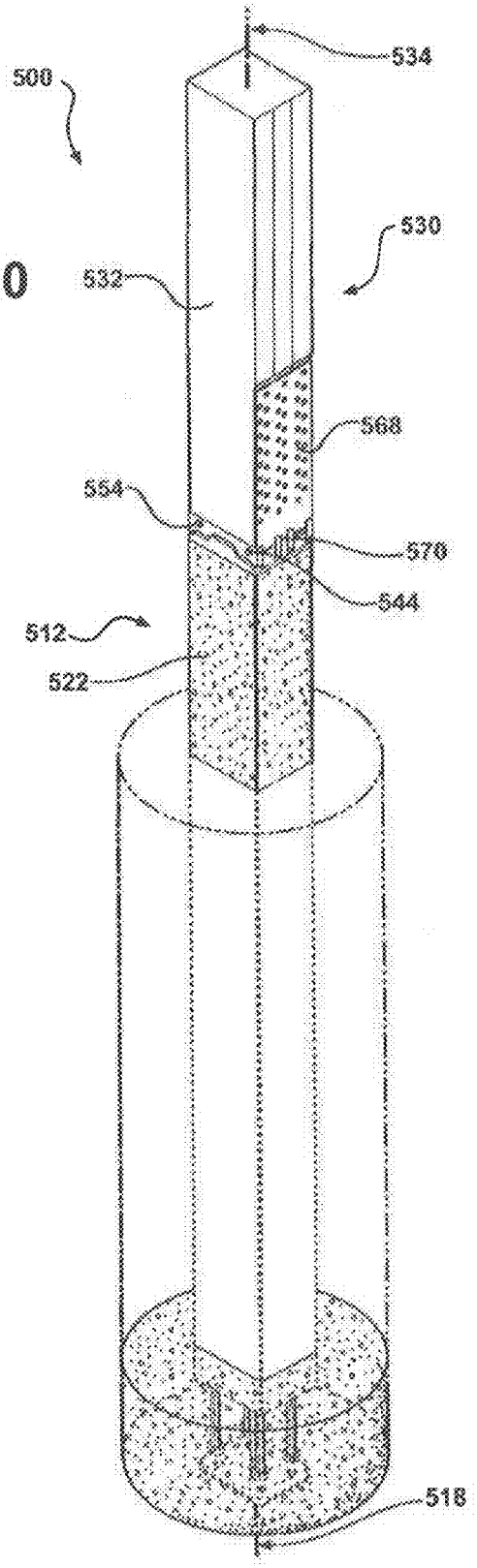
FIG. 30 is a perspective view of a lower piling assembly for a fifth alternative of a piling assembly set into the ground in the raised position with the upper and lower pilings in the upright and locked positions.
Figure 31:
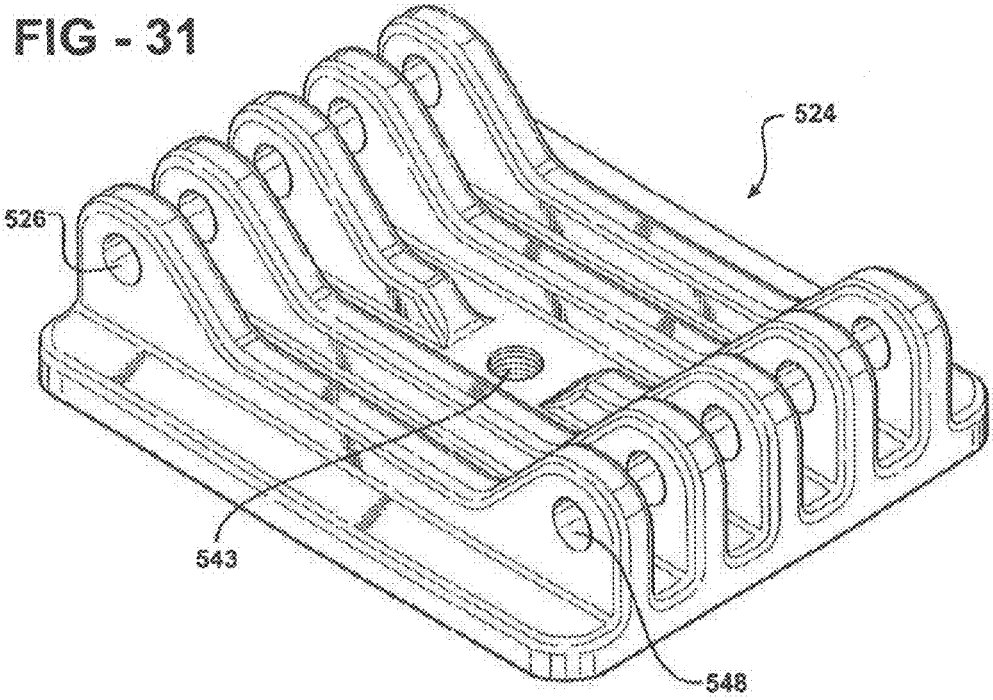
FIG. 31 is a perspective top view of a top plate for a fifth alternative of a piling assembly.

In the early stages of building construction, the upper and lower hinges 536, 524 are partially interleaved, as shown in FIG. 29, such that only a first pin 544 connects the upper hinge 536 to the lower hinge 524, along the hinge axis 528, i.e., hinge axis, and the second longitudinal axis 534, for the upper piling 530, is at an angle to the first longitudinal axis 518, for the lower piling 512. As a result, the columns 532 for the building can set tilted onto the ground. This position allows wall girts G to be connected to the columns 532 to facilitate the framing of an entire wall, or at least a portion of a wall, at ground level. Once the framing with the wall girts G is completed, the upper pilings 530 that form an entire wall, or a portion of a wall, are hoisted upward as a single unit, pivoting about the first pin 544 on the hinge axis 528. Then, the upper pilings 530 are hoisted upward, about the hinge axis 528, until the upper and lower hinges 536, 524 are completely interleaved with one another and the second axes 550, for the upper and lower second holes 552, 548, are aligned. When the hinges 536, 524 are completely interleaved, the first pin 544 is extending through the upper and lower first holes 548, 538, on the hinge axis 528, to engage and support the hinges 536, 524. Likewise, a second pin 554 is extending through the upper and lower second holes 552, 526, on the second axis 550, to engage and support the hinges 536, 524 when the longitudinal axes 518, 534 are aligned, as shown in FIG. 30.

Each of the upper and lower hinges 536, 524 include a first plurality of hinge knuckles 546, disposed about the first pin 544, where the knuckles 546 of the upper hinge 536 are interleaved with the knuckles 546 of the lower hinge 524. The knuckles 546 hold the first pin 544 in spaced relationship to the upper and lower pilings 530, 512 to transmit longitudinal forces between the pilings 530, 512 through the first pin 544. These forces include the loads resulting from the weight of the wall girts G, the roof, various other building materials and environmental factors. Similarly, the hinges 536, 524 include a second plurality of locking knuckles 556 that are disposed about the second pin 554 with the locking knuckles 556 of the upper hinge 536 interleaved with the locking knuckles 556 of the lower hinge 524. The locking knuckles 556 hold the second pin 554 in spaced relationship to the pilings 530, 512 to transmit longitudinal forces between the pilings 530, 512 totally through the first and second pins 544, 554. Therefore, the pins 544, 554 support the entire load provided by the upper pilings 530, wall girts G, the roof, various other building materials and environmental factors.

Each of the hinges 536, 524 includes a plurality of plates 558 that are in spaced and parallel relationship. A gap 569 is defined between each of the plates 558 to facilitate the upper hinge 536 interleaving with the lower hinge 524. The first hole 526 or 538 is defined through each of the plates 558, along the first axis 550. The second hole 548 or 552 is also defined through each of the plates 558, along the second axis 528, and spaced transversely across each of the plates 558 from the first hole 526 or 538 respectively. Furthermore, the plates 558 define a bottom edge 562 and end edges 564.

The lower hinge 524 is attached to the lower piling 512 at the bottom edge 562 and the holes 526, 548 are in spaced relationship from the lower piling 512. The upper hinge 536 includes a bottom 566 and a pair of opposing walls 568 that extend upward from the bottom 566, along the column 532. The bottom edge 562 of each of the plates 558 are attached to the bottom 566 of the upper hinge 536 and the end edges 564 of each of the plates 558 are attached to the opposing walls 568. Furthermore, the bottom 566 and the opposing walls 568 define a plurality of grooves 570 that extend in spaced and parallel relationship across the bottom 566 and into a portion of the walls 568, between each of the plates 558. The grooves 570 allow the plates 558 of the lower hinge 524 to interleave with the plates 558 of the upper hinge 536.

Additionally, a plurality of thru-holes 533 can be precast into the concrete 522 to facilitate attachment of various framing pieces F, concrete anchors, etc. to the lower piling 512.

A wall for a building can be constructed when more than one piling 512 is installed into holes in the earth at a building site. The method of erecting a wall for a building using a jack piling 512, i.e., lower piling, having a top and a bottom and a second piling 512 having a top and a bottom, comprises the steps of excavating a first hole and a second hole in the surface of the earth to a floor in each hole, placing the bottom of the jack piling 512 having a hinge axis 528 at the top onto the floor in the first hole, and placing the bottom of the second piling 512 having a hinge axis 528 at the top onto the floor in the second hole.

Then, the method includes the step of adjusting the position of the bottom of the second piling 512 upwardly and away from the floor of the second hole to establish the position of the hinge axis 528 of the second piling 512 prior to adjusting the position of the bottom of the jack piling 512. Next, the method includes the step of adjusting the position of the bottom of the jack piling 512 upwardly and away from the floor of the first hole to bring the hinge axis 528 of the jack piling 512 upwardly and into alignment with the hinge axis 528 of the second piling 512. The placement of jack pilings 512 into the earth is repeated until the preferred number of pilings 512 for a single wall is achieved.

Figures 35, 36A:
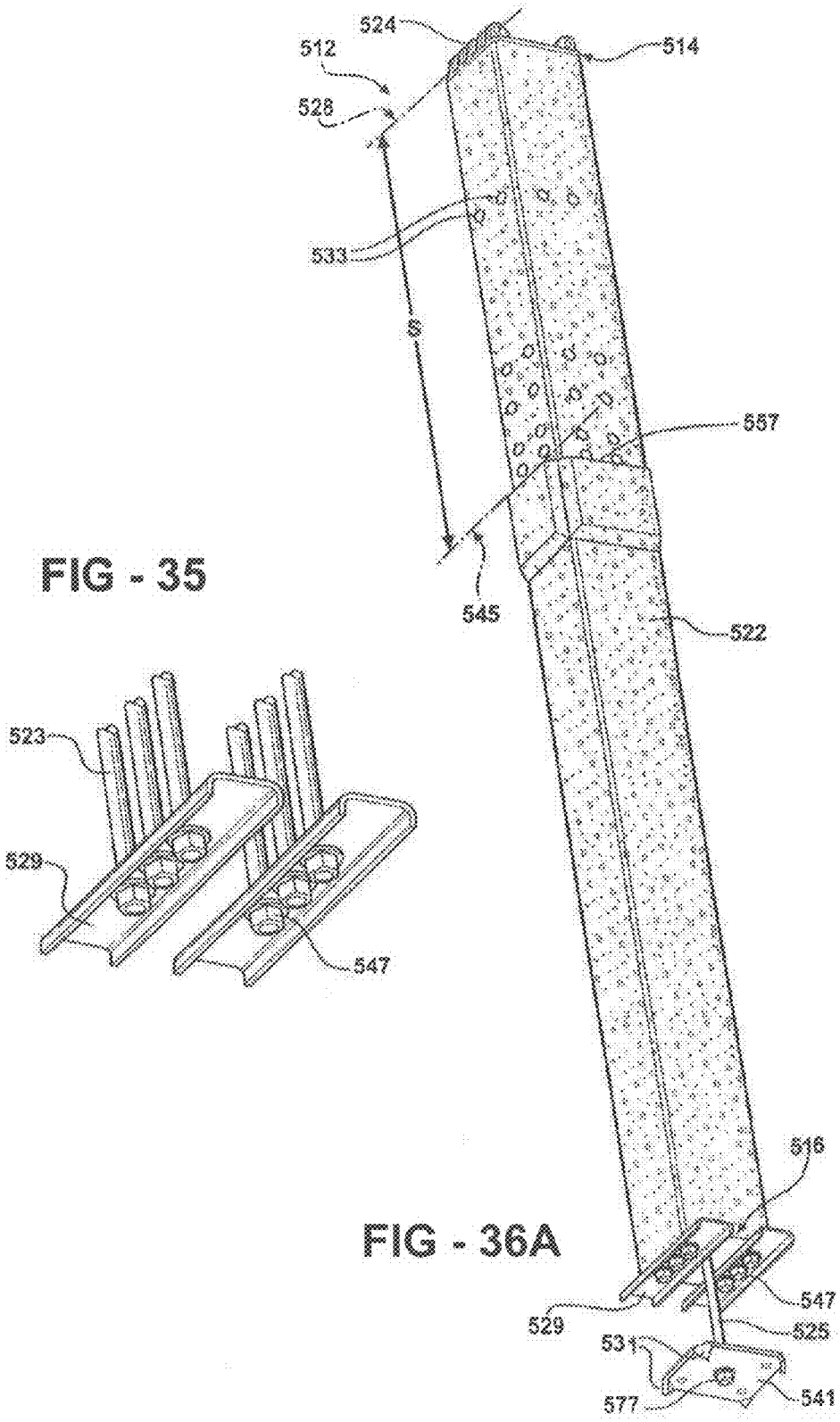
FIG. 35 is a perspective view of uplift extensions and a bottom retention mechanism for a fifth alternative of a piling assembly.
FIGS. 36A, 36B, and 36C are perspective bottom views of a jack piling assembly having a push rod extending into a piling for a fifth alternative of a piling assembly.
Figure 36B:
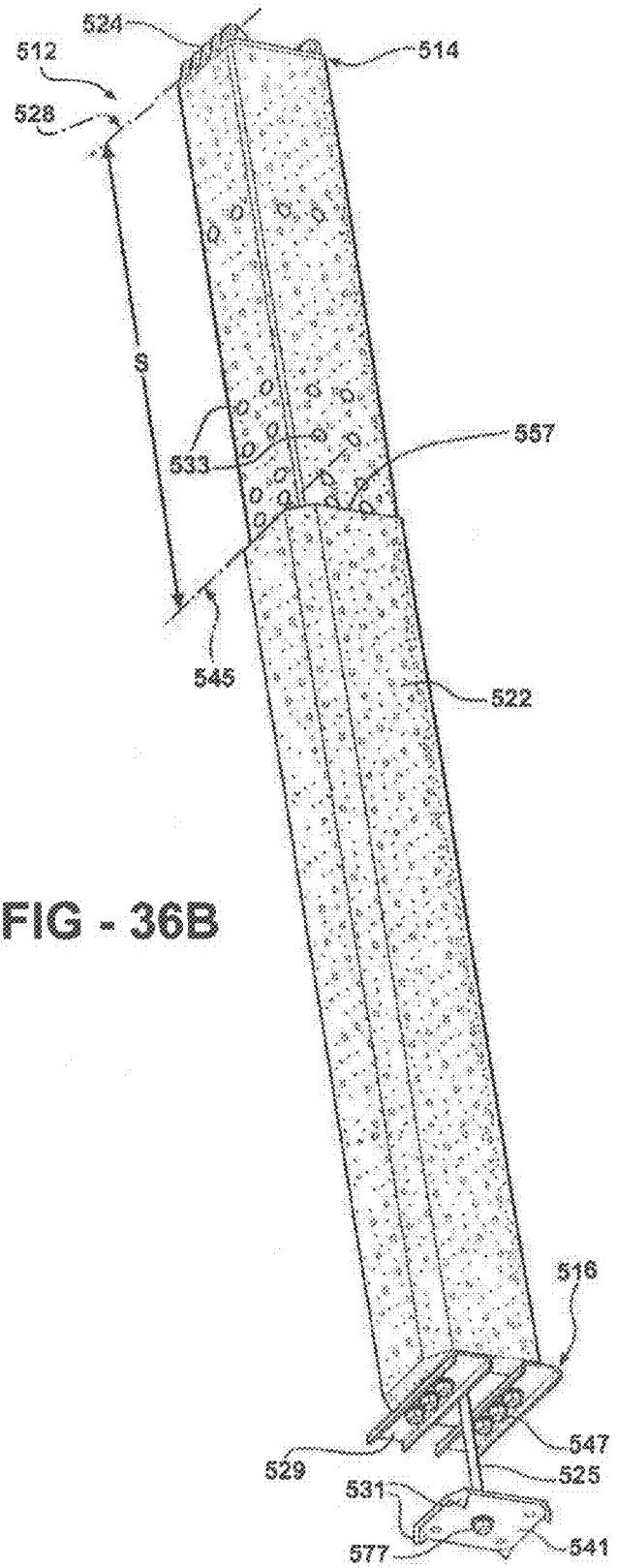
Figure 36C:
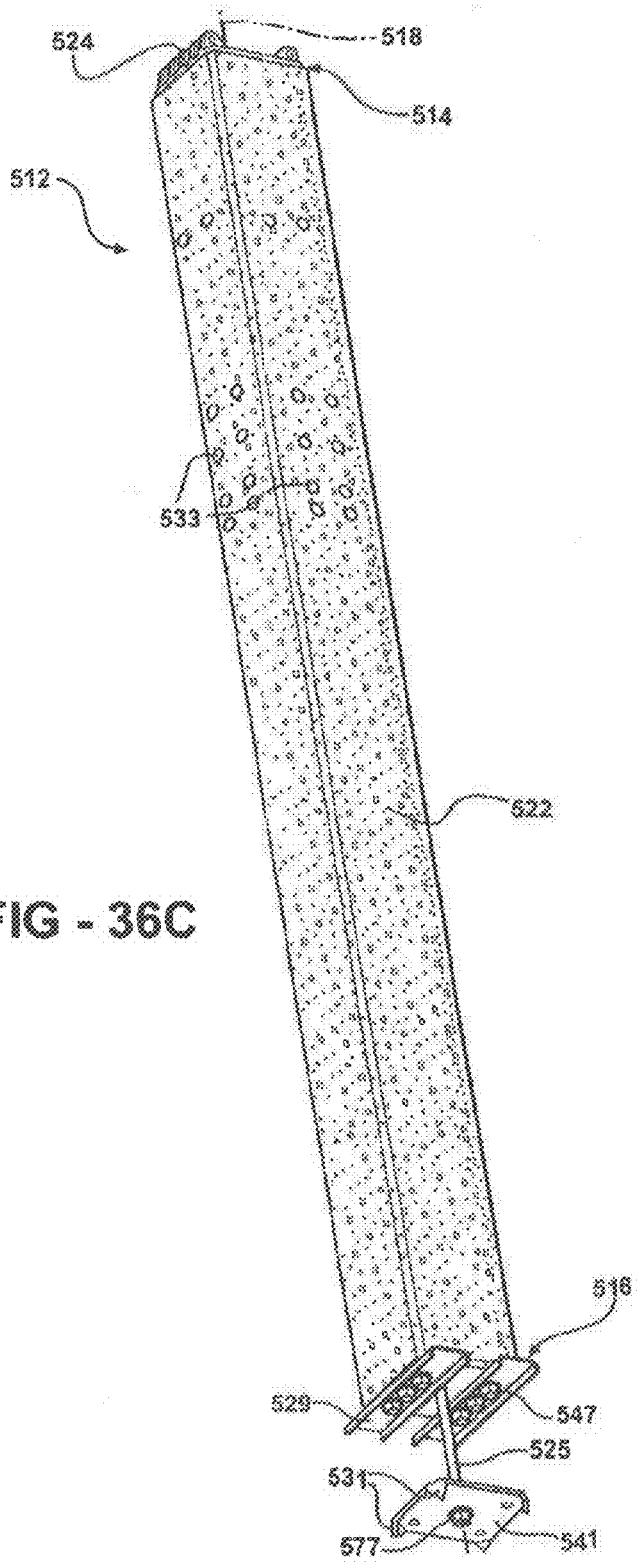
Figure 37:
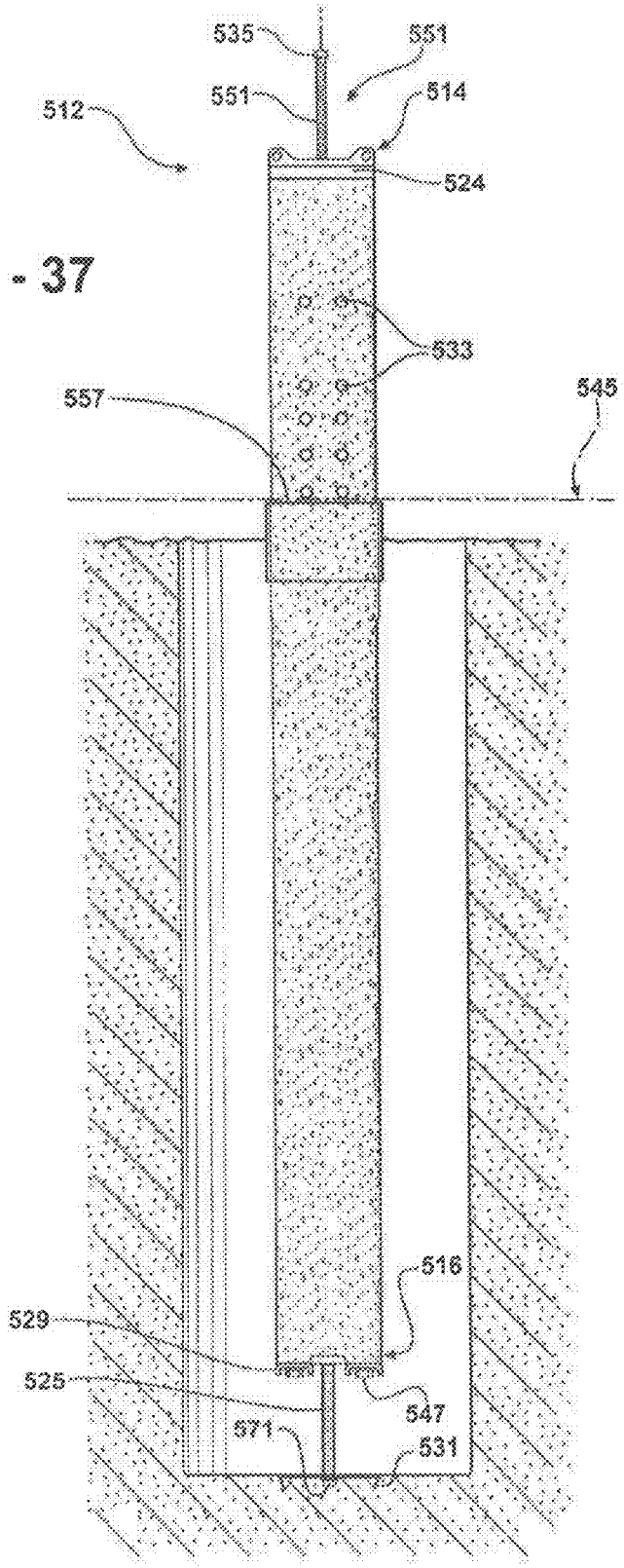
FIG. 37 is a partial sectional view of a lower piling for a fifth alternative of a piling assembly inserted into the ground with the column in the raised position and the grade axis set to a theoretical final grade of the surface of the earth.
Figure 38:
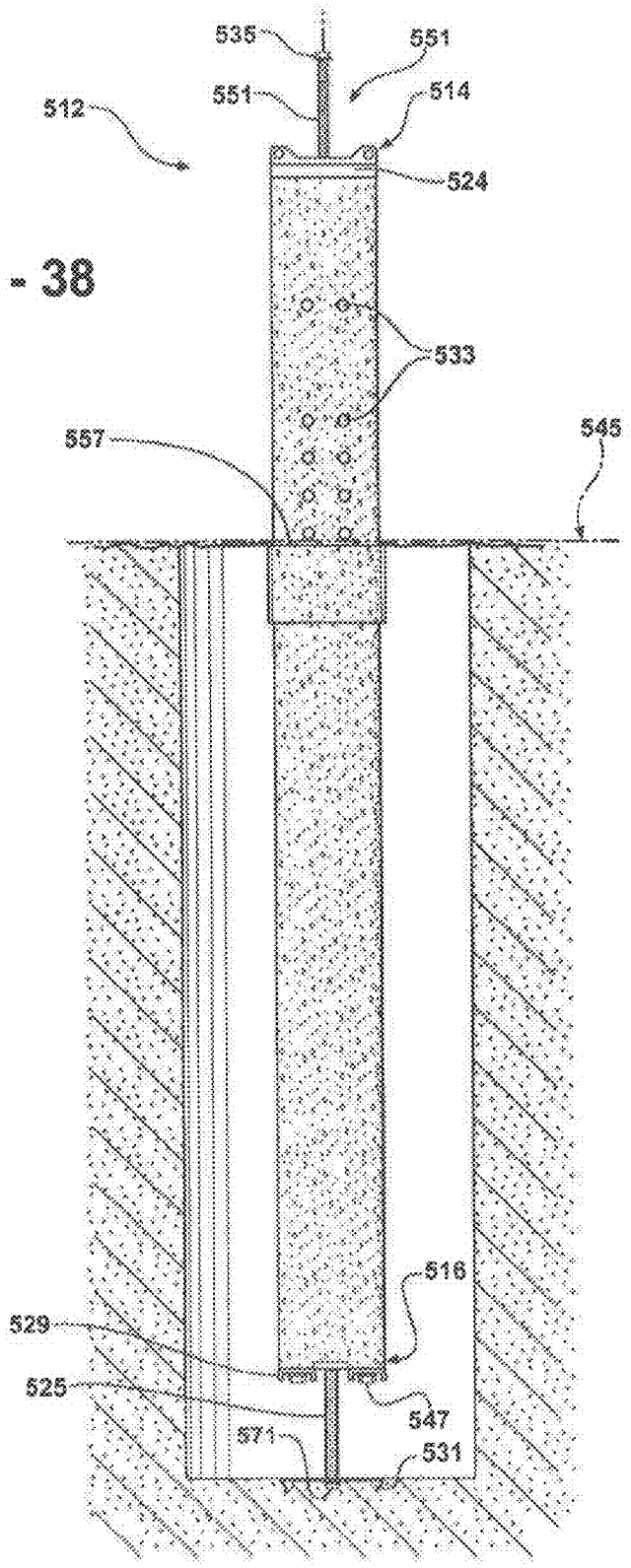
FIG. 38 is a partial sectional view of a lower piling for a fifth alternative of a piling assembly inserted into the ground with the column in the raised position and the grade axis is aligned with a final grade of the surface of the earth.
Figure 39:
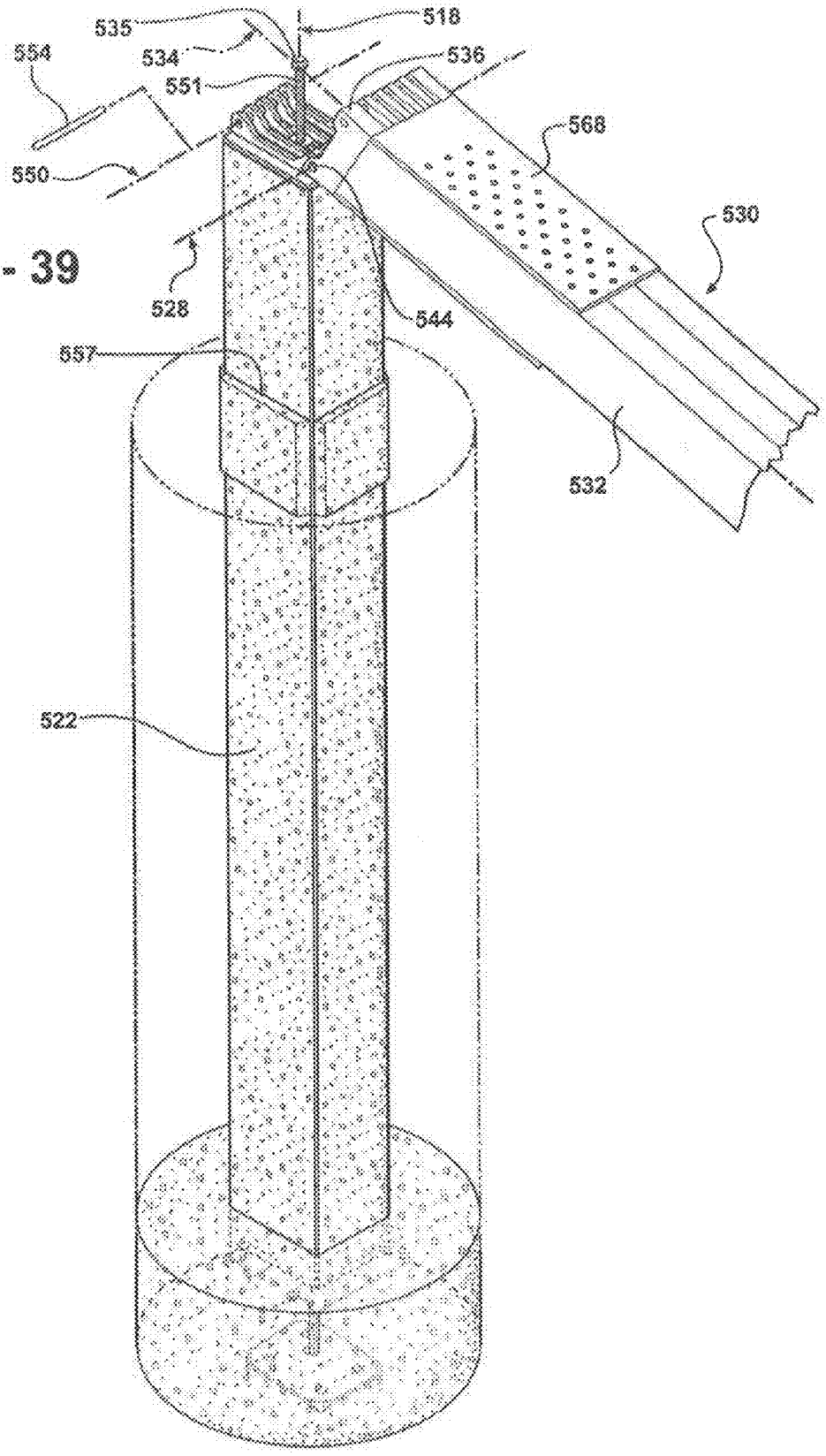
FIG. 39 is a perspective view of a lower piling assembly for a fifth alternative of a piling assembly set into the ground in the raised position with the upper piling tilted away from the lower piling about a pin.
Figure 40:
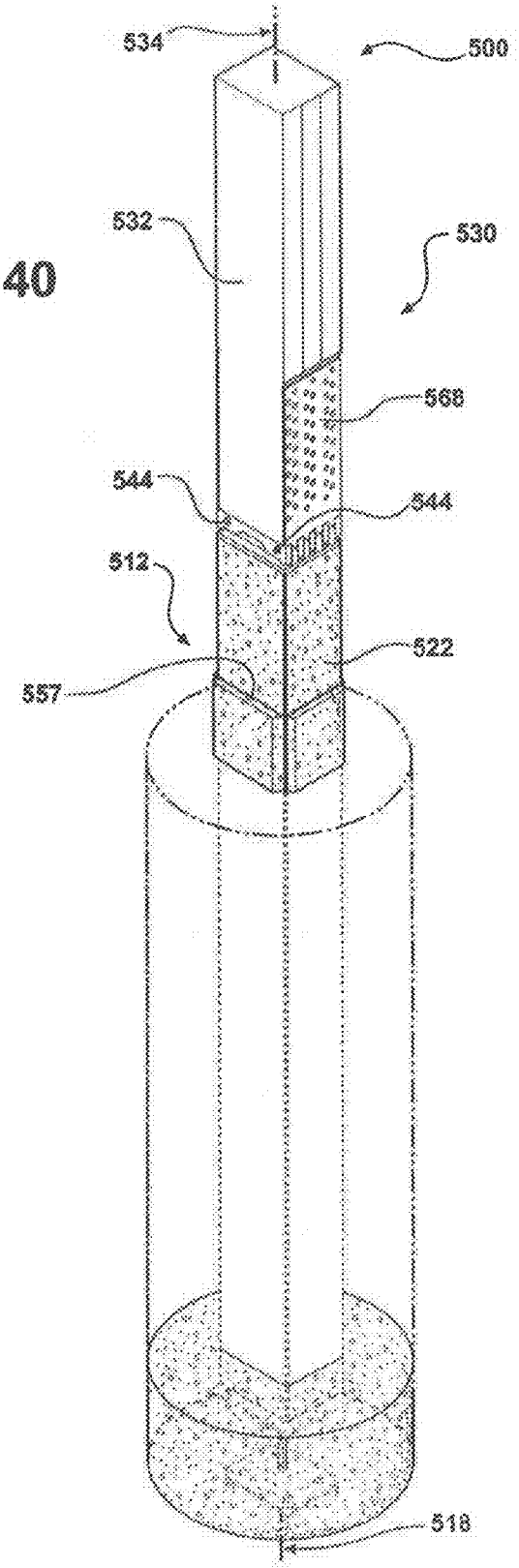
FIG. 40 is a perspective view of a lower piling assembly for a fifth alternative of a piling assembly set into the ground in the raised position with the upper and lower pilings in the upright and locked positions.

One way to determine whether the proper height of each lower 512 piling is achieved is by using a grade ledge 557 that can be integrated onto each of the lower pilings 512, as shown in FIGS. 36A and 36B. The grade ledge 557 provides a ledge on the lower piling 512 for supporting the lowermost framing piece F. When using the jack piling assembly, the grade ledge 557 provides a fixed span between the hinge axis 528 and the grade level 545. When the surface of the earth at the building site is initially graded, it is graded to a theoretical grade FIG. 37. However, when the final grade of the surface of the earth is performed, the surface is graded to a grade level 545, along axis, as shown in FIG. 38. The lower pilings 512 are therefore adjusted to set the grade ledge 557 in alignment with what the grade level 545 will be after the final grade is performed. Likewise, the hinge axes 528 of the lower pilings 512 will be along a common hinge axis 528 by virtue of the fixed span S.

Next, the method includes the step of pouring concrete into each of the holes in the earth to encase a portion of each of the pilings and to fix the alignment of the axes. It is preferable that the concrete extend at least two inches above the uplift extensions 529 to prevent lifting of the lower piling 512 and to prevent corrosion of the uplift extensions 529.

Next, the method includes the step of back filling each of the holes in the earth to the grade level 545 with a fill material. Then the method includes the step of regrading the surface of the earth to be level with a grade level 545. The grade level 545 is usually even with the grade axis of the lower pilings 512.

Then, the method includes the step of pivotally connecting a hinge axis 528 of an upper piling 530, to the hinge axis 528 of the lower piling 512 for each of the lower pilings 512. The next steps of the method include attaching framing pieces F across the upper pilings 530 to form an upper wall and pivoting the upper wall about the hinge axis 528 and into an upright position. Next, the method includes the step of securing the upper wall into the upright position.

Finally, the method includes the step of attaching framing pieces F across the lower pilings 512 to form a lower wall. The use of a grade level 545 on each lower piling 512 can be useful because the grade levels 545 can act as a ledge to align and support the lowermost framing pieces that are attached to the lower pilings 512.

Figure 41:
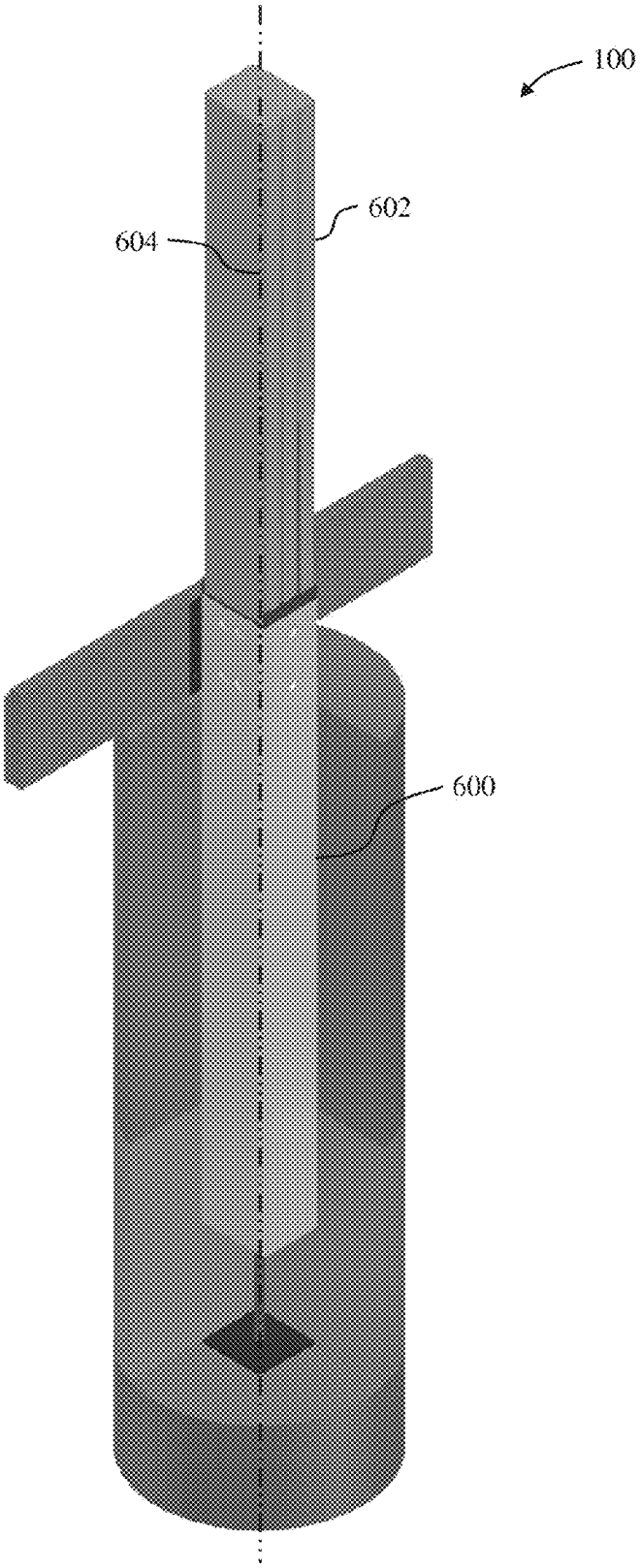
FIG. 41 is a perspective view of a piling assembly, according to an embodiment of the present invention.
Figure 42A:
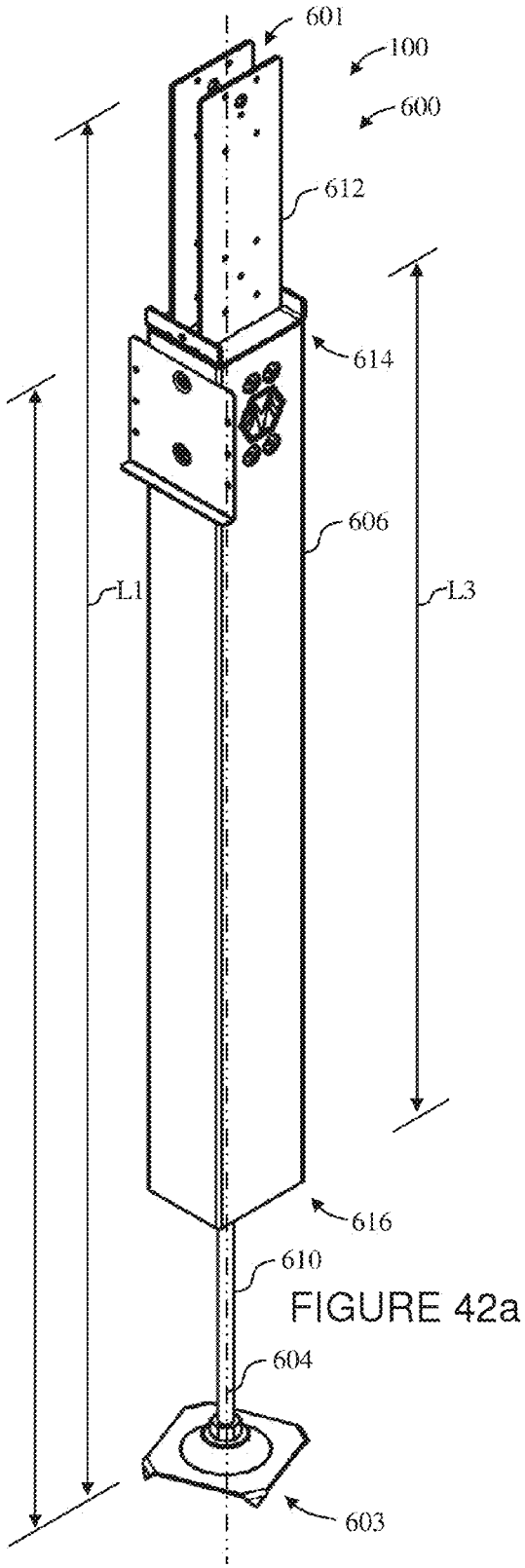
FIGS. 42*a* and 42*b* are partial perspective views of the piling assembly shown in FIG. 41, according to an embodiment of the present invention.
Figure 42B:
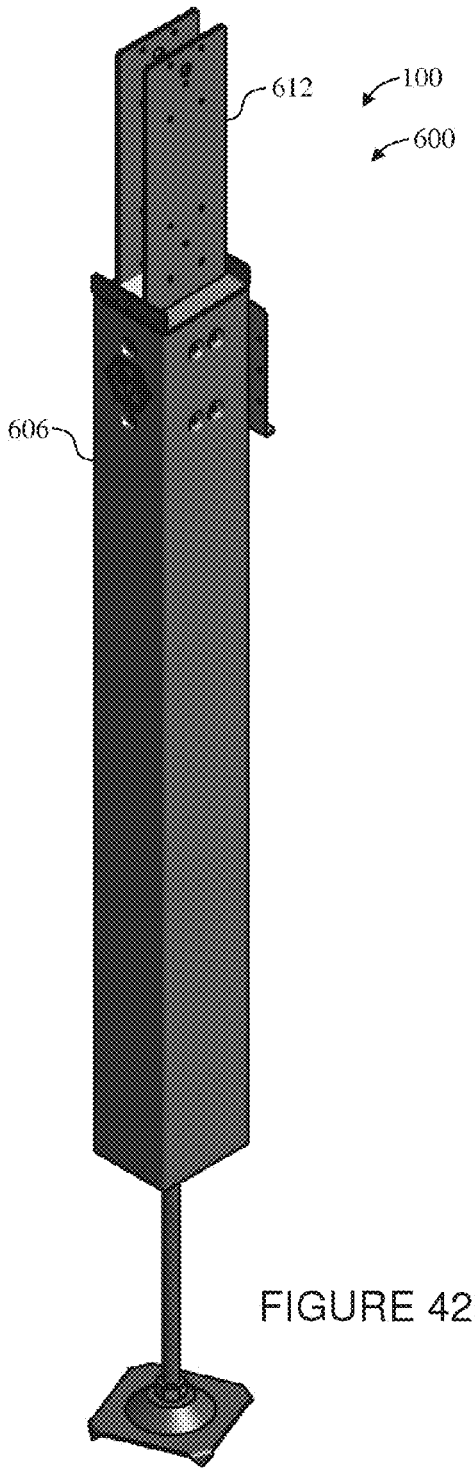
Figure 43:
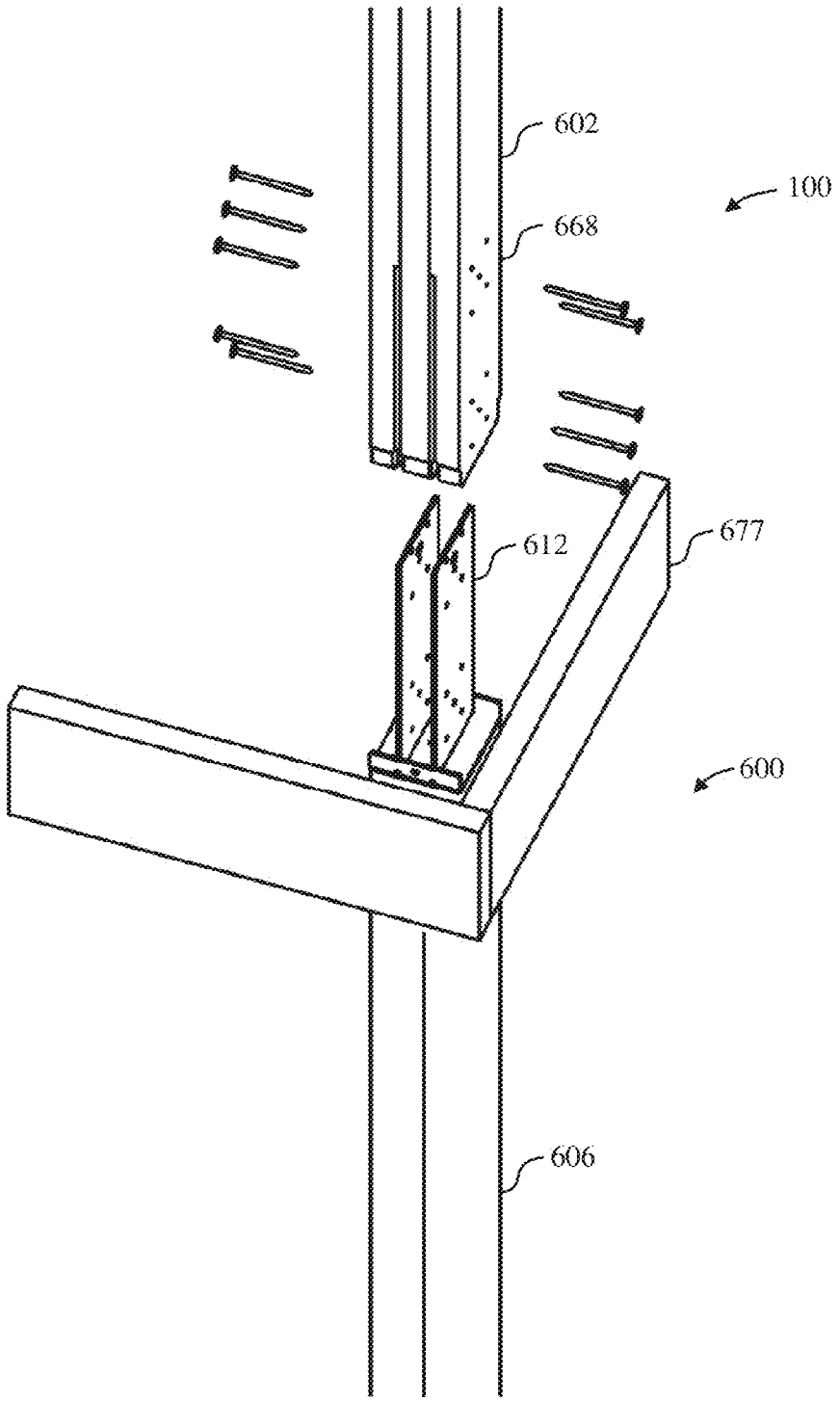
FIG. 43 is an exploded view of the piling assembly shown in FIG. 41.
Figure 44:
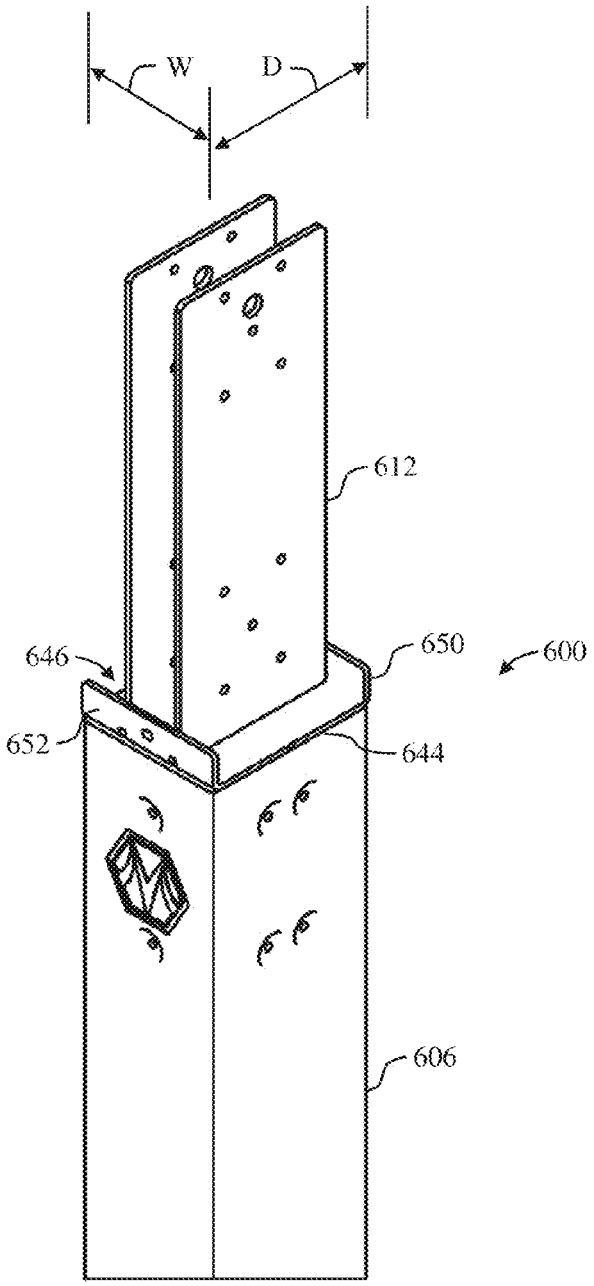
FIG. 44 is a partial perspective view of the piling assembly shown in FIG. 41, according to an embodiment of the present invention.
Figure 45:
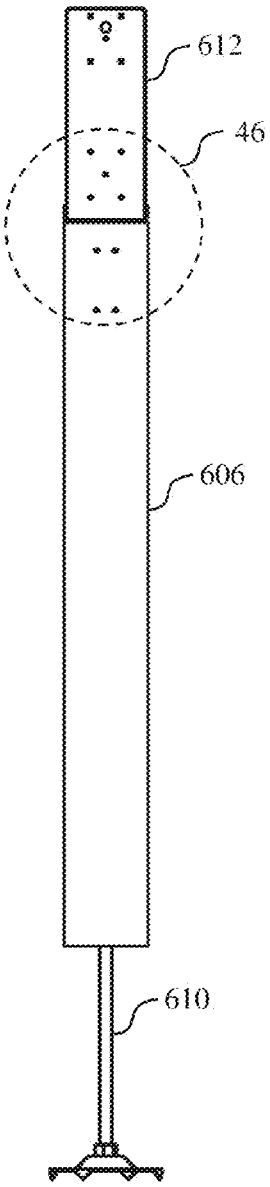
FIG. 45 is a side view of the piling assembly, according to an embodiment of the present invention.
Figure 47:
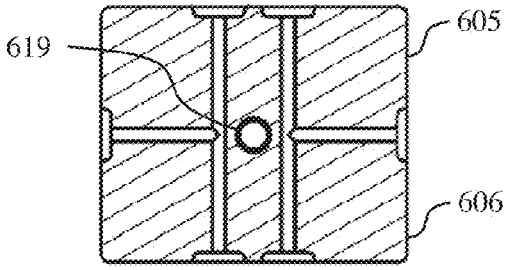
FIG. 47 is a sectional view of a portion of the piling assembly shown in FIG. 46*b* and taken along line 47-47.
Figure 46:
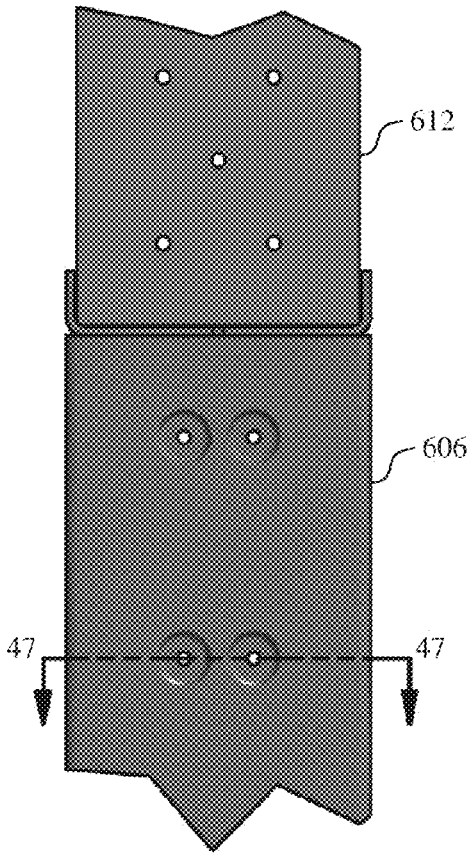
FIG. 46 is an enlarged side view of the piling assembly shown in FIG. 45 and taken along area 46.
Figure 48:
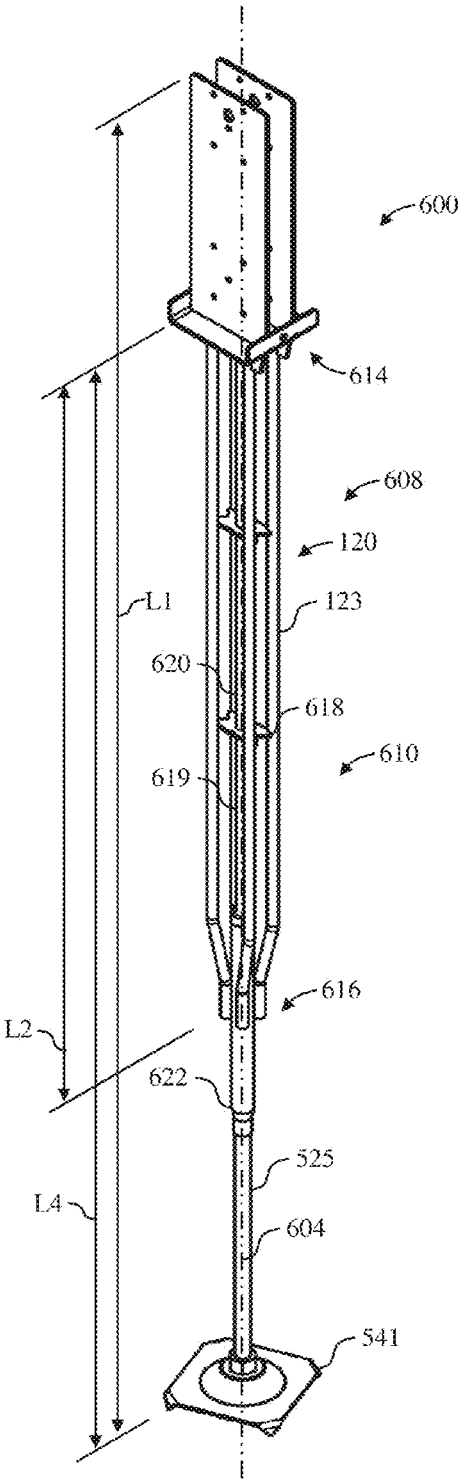
FIG. 48 is a perspective view of a portion of the piling assembly shown in FIG. 41.
Figure 50:
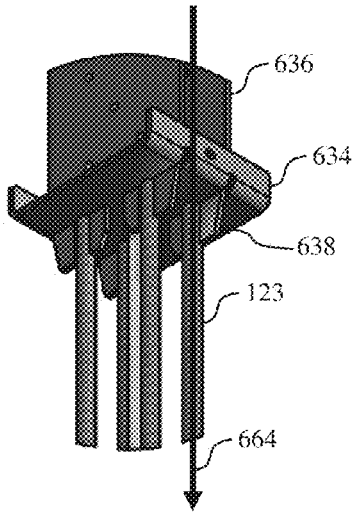
FIG. 50 is an enlarged perspective view of a portion of the piling assembly shown in FIG. 49 and taken along area 50.
Figure 49:
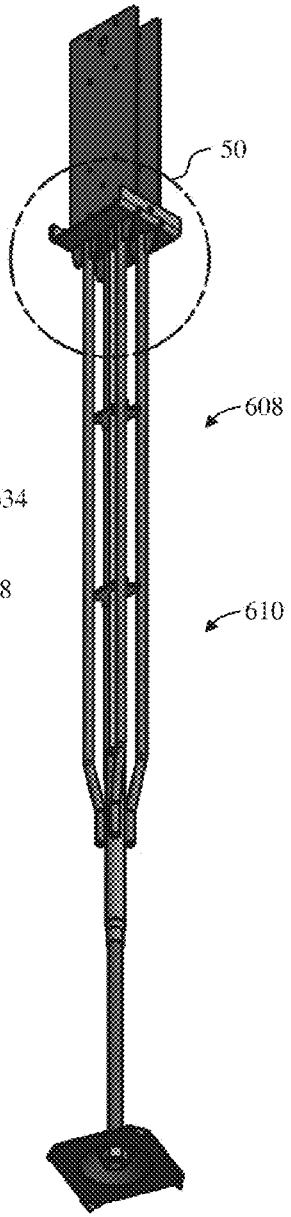
FIG. 49 is another perspective view of a portion of the piling assembly shown in FIG. 41.
Figure 51:
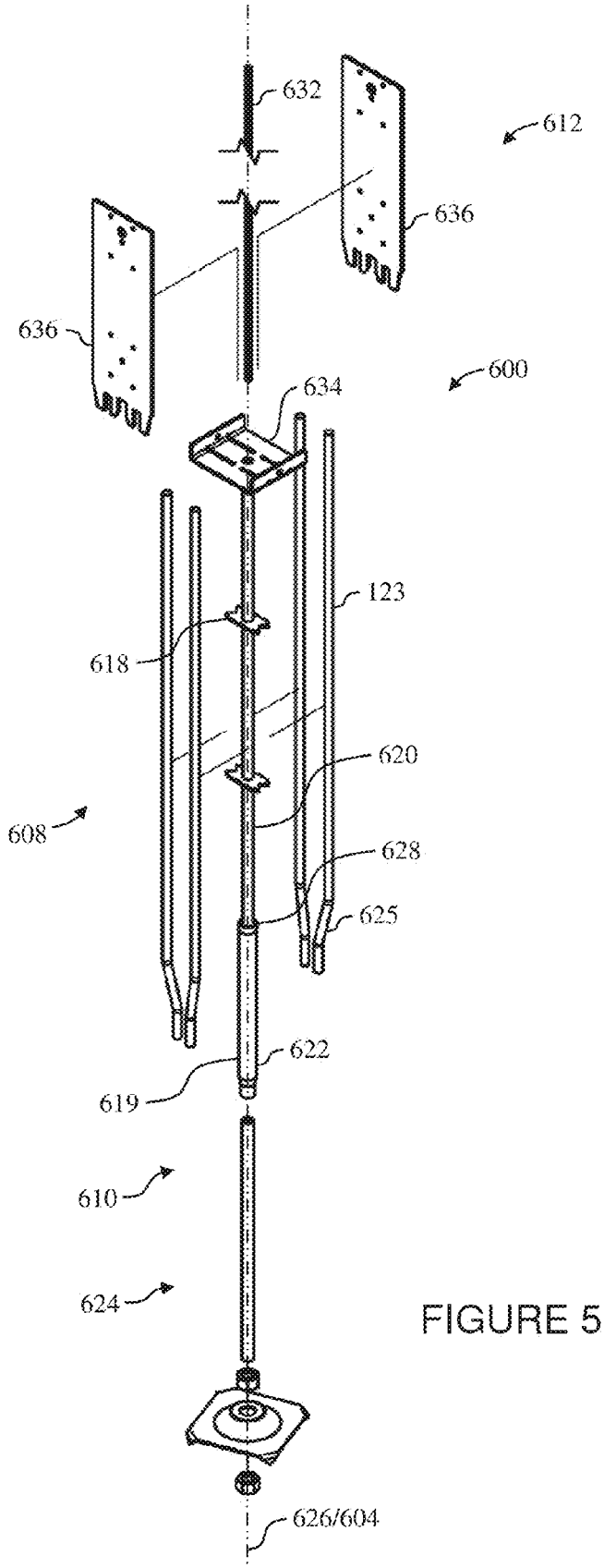
FIG. 51 is an exploded schematic view of the piling assembly shown in FIG. 48.
Figure 52:
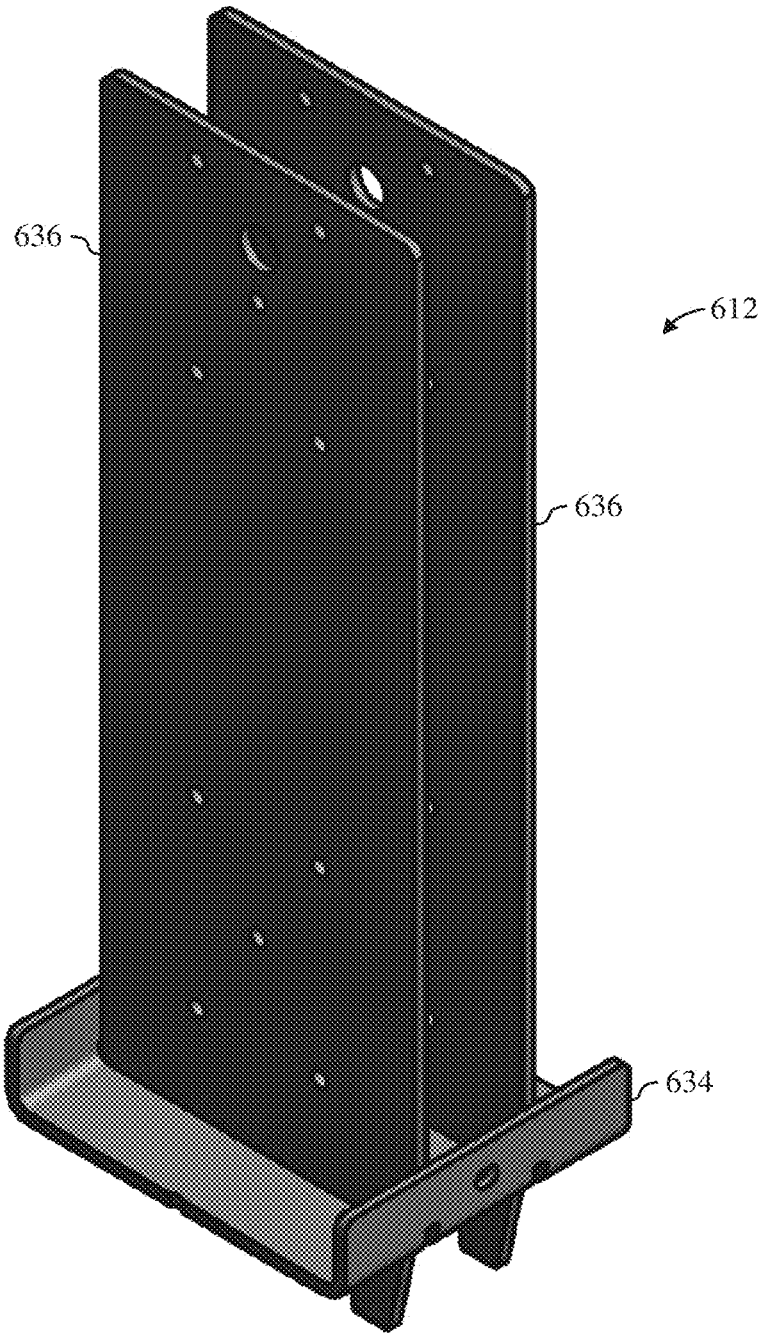
FIG. 52 is a perspective view of a column connector assembly that may be used with the piling assembly shown in FIG. 41, according to an embodiment of the present invention.
Figure 53:
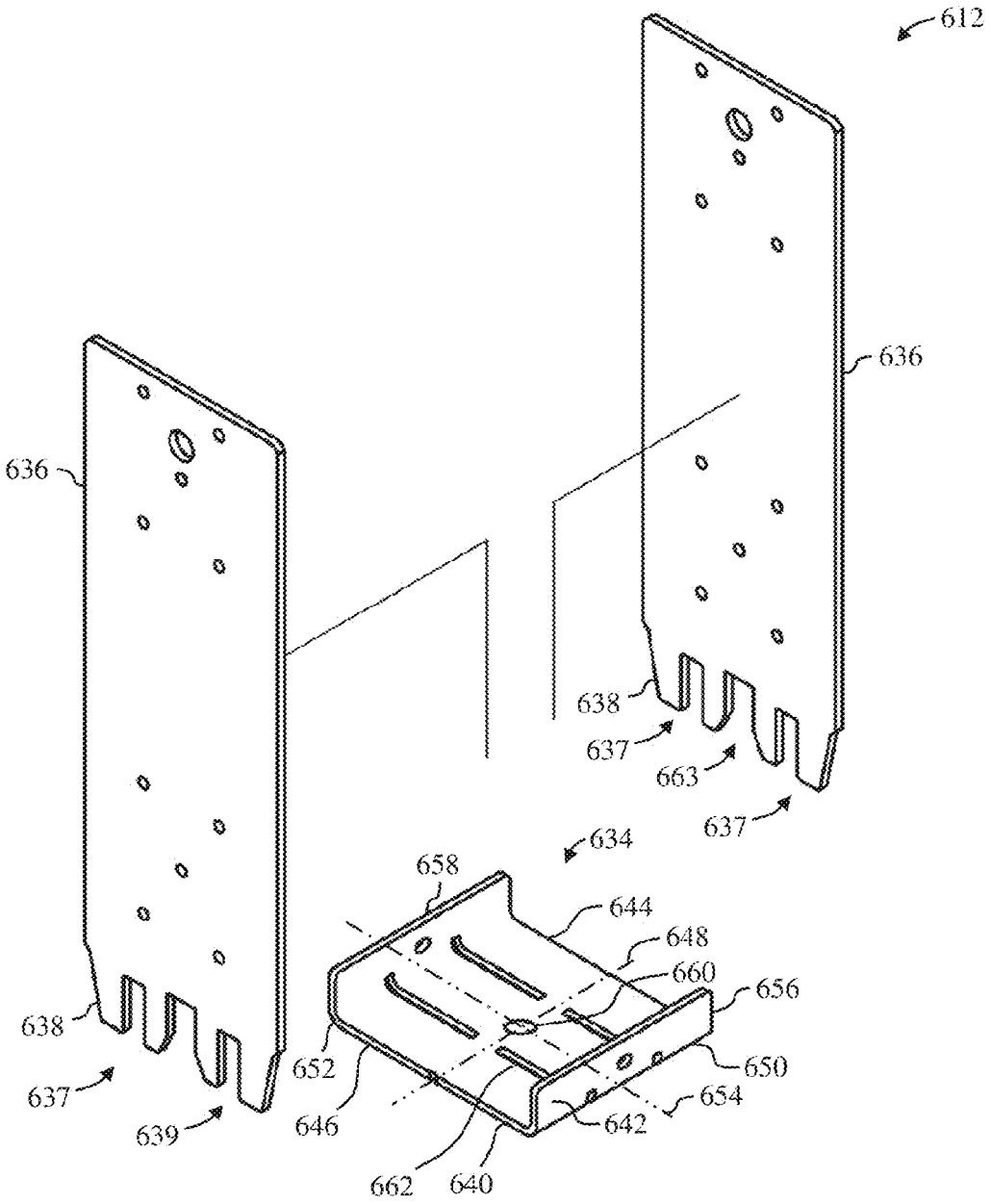
FIG. 53 is an exploded schematic view of the column connector assembly shown in FIG. 52.

FIG. 41 is a perspective view of the column assembly 100, according to an embodiment of the present invention. FIGS. 42*a* and 42*b* are partial perspective views of the column assembly 100. FIGS. 43 through 62 are various views of the column assembly 100. In the illustrated embodiment, the column assembly 100 includes a lower column assembly 600, i.e. lower piling 112, and an upper column assembly 602, i.e. upper piling 130, that is coupled to the lower column assembly 600. The upper column assembly 602 is coupled to the lower column assembly 600 such that lower column assembly 600 and the upper column assembly 602 are each orientated along the longitudinal axis 604. In addition, the upper column assembly 602 has a cross-sectional area that is substantially similar to the cross-sectional area of the lower column assembly 600 such that the column assembly 100 has a substantially uniform cross-section 605 along the longitudinal axis 604.

In the illustrated embodiment, the lower column assembly 600 includes a precast concrete portion 606, a reinforcement assembly 608, an adjustment assembly 610, and a column connector 612. The lower column assembly 600 extends between a top end 601 and a bottom end 603 and has a length L1 that is measured along the longitudinal axis 604.

The reinforcement assembly 608 extends along the longitudinal axis 604 between a first end 614 and a second end 616 and includes a reinforcing cage, i.e. reinforcing cage 120, that extends from the first end 614 to the second end 616. The reinforcement assembly 608 also includes a length L2 measured between the first end 614 and the second end 616 along the longitudinal axis 604. The reinforcing cage 120 includes a plurality of reinforcement members (re-bar), i.e. reinforcing rods 123, that extend along the longitudinal axis 604, and a plurality of re-bar ties 618 that are spaced along the longitudinal axis 604. Each re-bar tie 618 is positioned between the reinforcing rod 123 such that adjacent reinforcing rods 123 are spaced a distance apart. In the illustrated embodiment, the reinforcing cage 120 includes four reinforcement rods 123.

The reinforcement assembly 608, a portion of the adjustment assembly 610, and a portion of the column connector 612 are positioned within the concrete portion 606. In the illustrated embodiment, the concrete portion 606 defines an outer surface of the lower column assembly 600 and has a substantially rectangular shape. In addition the lower column assembly 600 includes an outer surface that defines a substantially uniform cross-sectional area extending between the first end 614 to the second end 616. In the illustrated embodiment, the concrete portion 606 includes a length L3 measured along the longitudinal axis 604 from the first end 614 towards the second end 616. In the illustrated embodiment, the length L3 of the concrete portion 606 is approximately equal to the length L2 of the reinforcement assembly 608. In one embodiment, shown in FIGS. 64 and 70, the length L2 of the reinforcement assembly 608 is longer than the length L3 of the concrete portion 606.

In the illustrated embodiment, the adjustment assembly 610 is coupled to the reinforcing cage 120 and extends from the first end 614 towards the second end 616 along the longitudinal axis 604. The adjustment assembly 610 includes an access tube assembly 619 that includes a center tube 620, a height adjustment tube 622, and a rod assembly 624. The center tube 620 extends from the first end 614 towards the second end 616 and is orientated between each of the reinforcing rods 123 along a centerline axis 626. More specifically, the center tube 620 extends through an opening defined in each re-bar tie 618 such that the center tube 620 is positioned between each reinforcing rod 123. The height adjustment tube 622 is coupled to the center tube 620 and extends outwardly from the center tube 620 along the centerline axis 626. The height adjustment tube 622 and the center tube 620 each include an inner surface that defines a cavity therein, and are coupled together such that an interior tube cavity is defined from an upper end of the center tube 620 to a lower end of the height adjustment tube 622. In addition, an upper end of the height adjustment tube 622 includes a sealing cap 628 that is configured to engage the center tube 620 to prevent a flow of concrete from entering the interior cavity during assembly.

Each reinforcing rod 123 is coupled to an outer surface of the height adjustment tube 622. Moreover, each reinforcing rod 123 includes a tapered portion 625 that extends towards the lower end of the height adjustment tube 622, and is coupled to the outer surface of the height adjustment tube 622 such that a portion of the height adjustment tube 622 extends outwardly from the second end 616 of the reinforcing cage 120.

Figure 56:
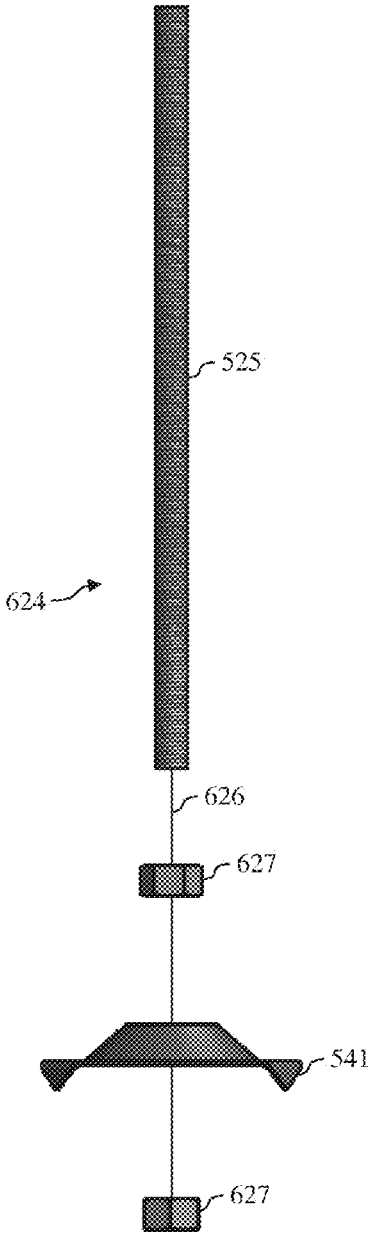
FIG. 56 is an exploded schematic view of the adjustment assembly shown in FIG. 54.
Figure 55:
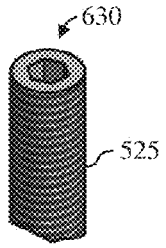
FIG. 55 is an enlarged perspective view of a portion of the adjustment assembly shown in FIG. 54 and taken along area 55.
Figure 54:
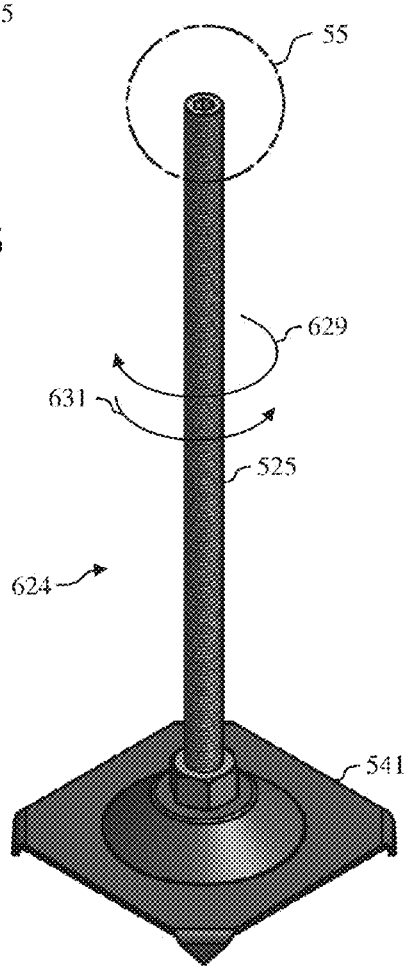
FIG. 54 is a perspective view of an adjustment assembly that may be used with the piling assembly shown in FIG. 41, according to an embodiment of the present invention.
Figure 57:
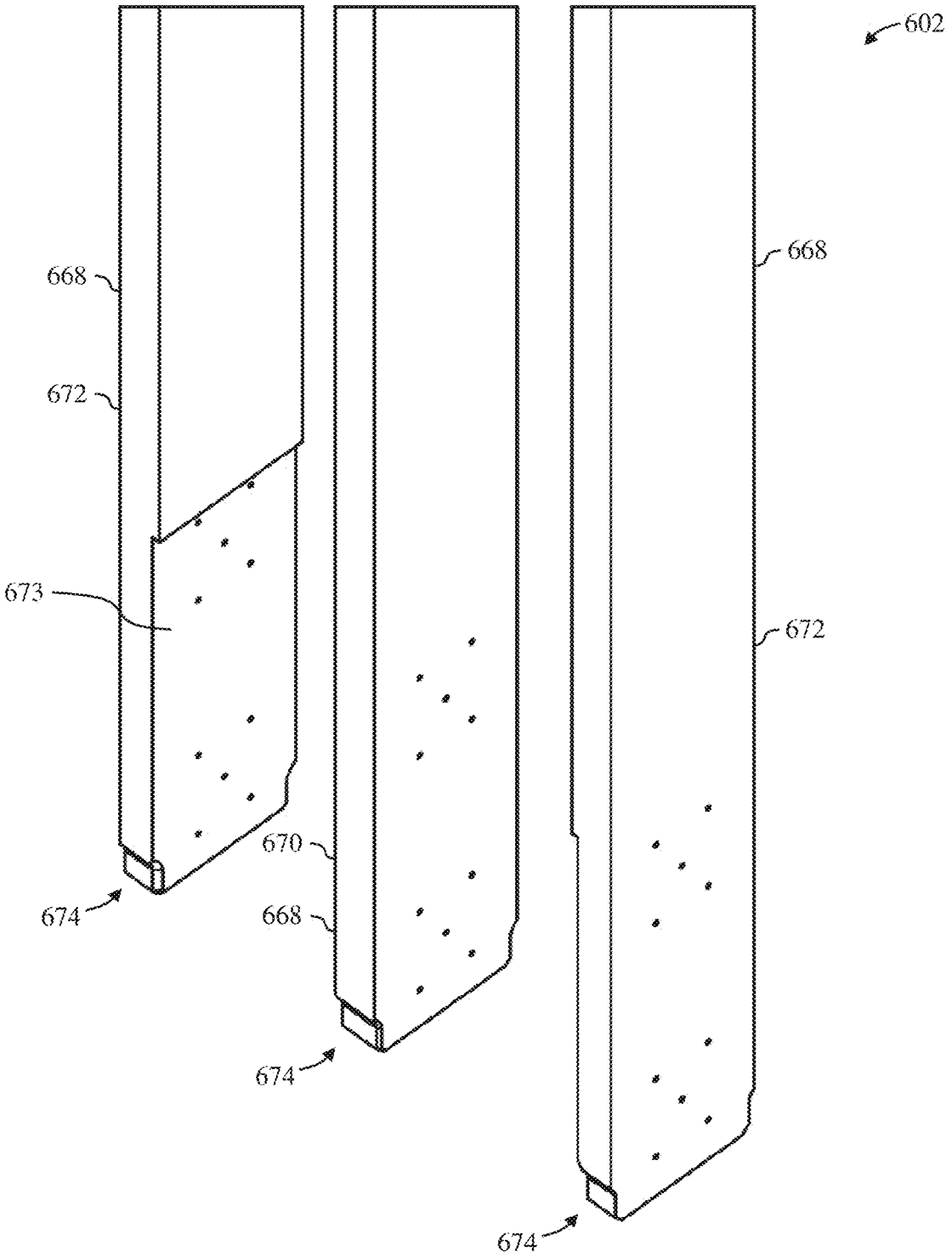
FIG. 57 is an exploded schematic view of an upper column assembly that may be used with the piling assembly shown in FIG. 41, according to an embodiment of the present invention.
Figure 58:
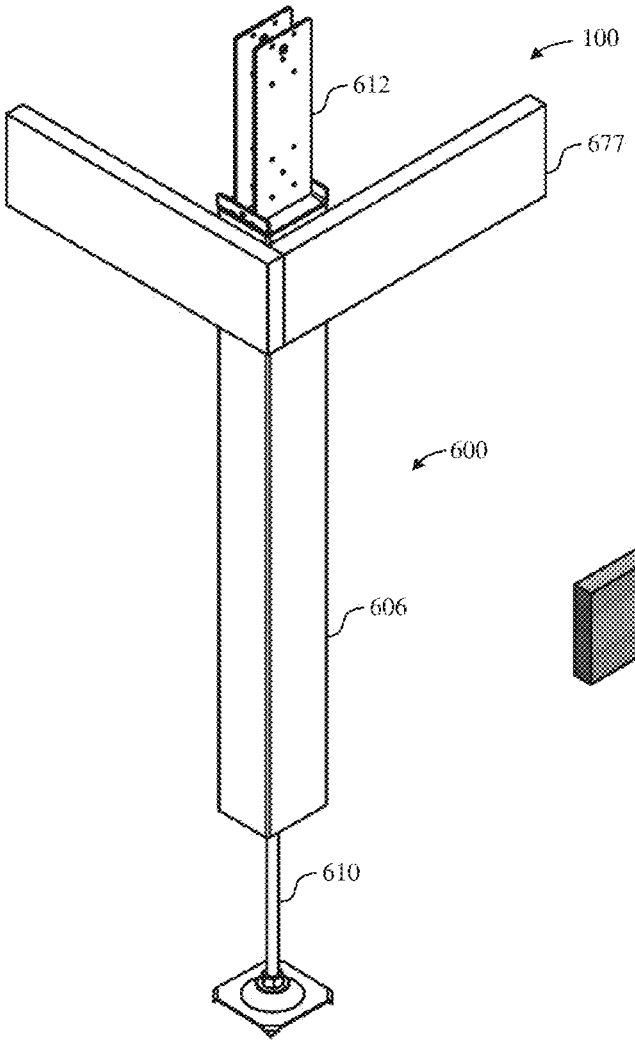
FIG. 58 is a perspective view of a portion of the piling assembly shown in FIG. 41, according to an embodiment of the present invention.
Figure 59:
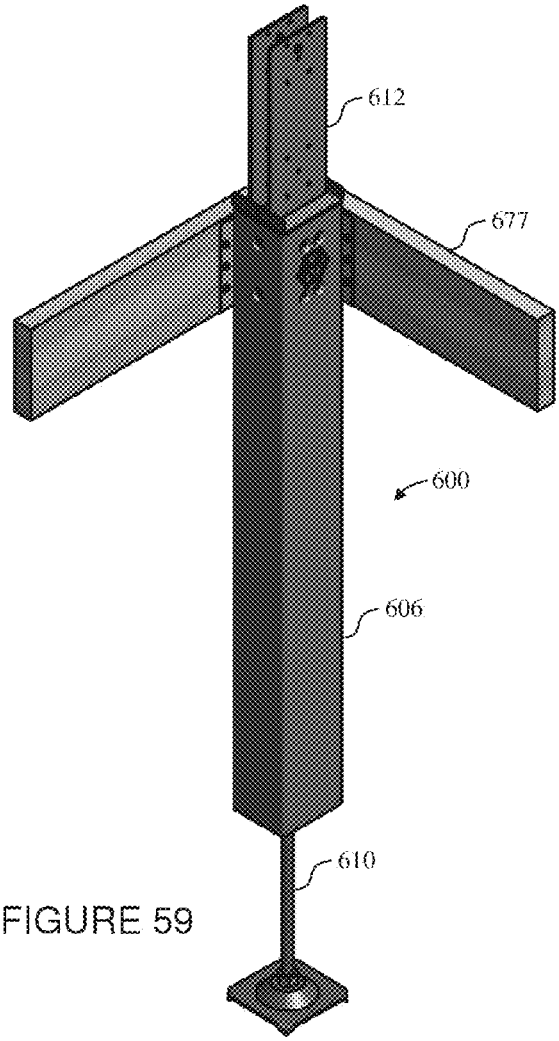
FIG. 59 is another perspective view of a portion of the piling assembly shown in FIG. 41.
Figure 60:
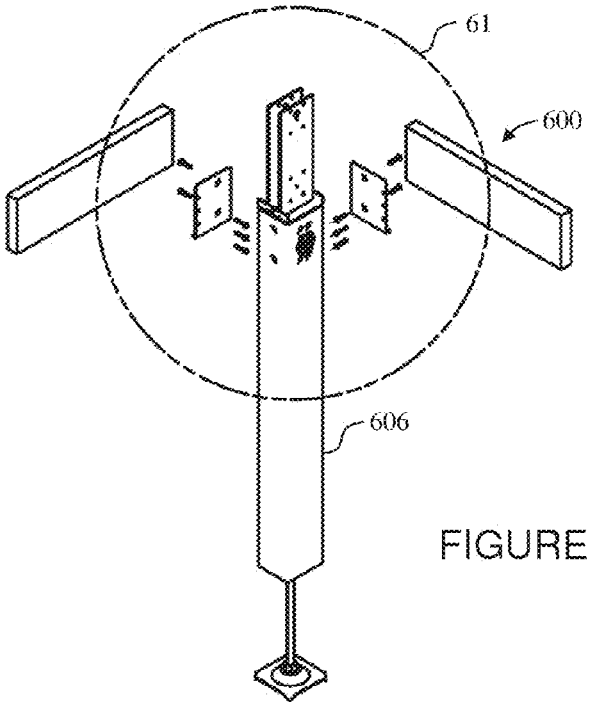
FIG. 60 is an exploded schematic view of the piling assembly shown in FIG. 59.
Figure 61:
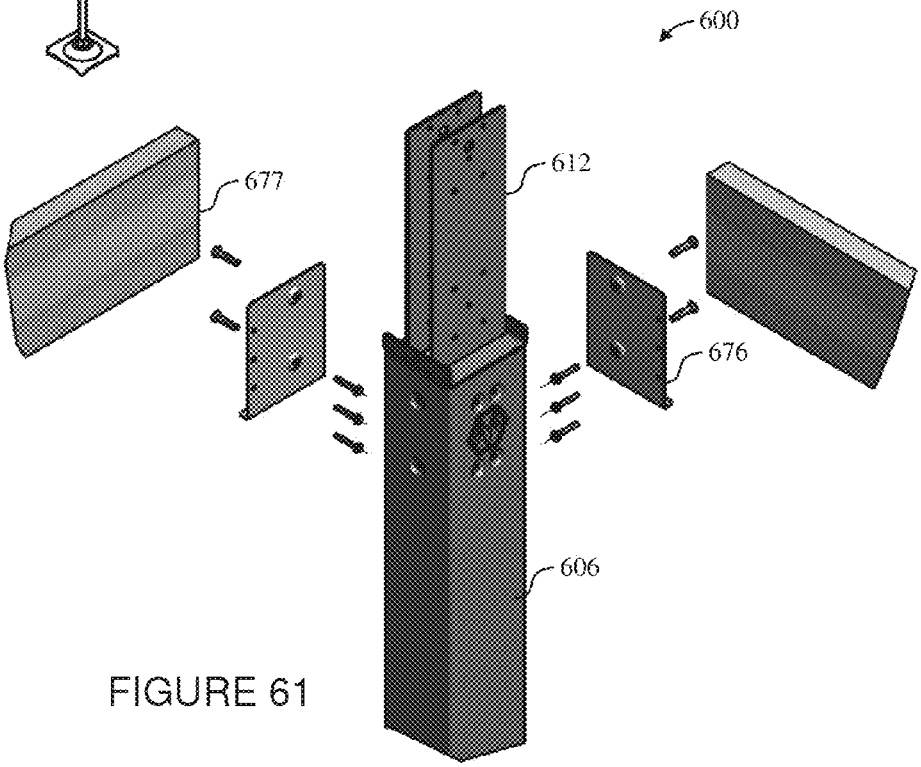
FIG. 61 is an enlarged sectional view of the piling assembly shown in FIG. 60 and taken along area 61.
Figure 63:
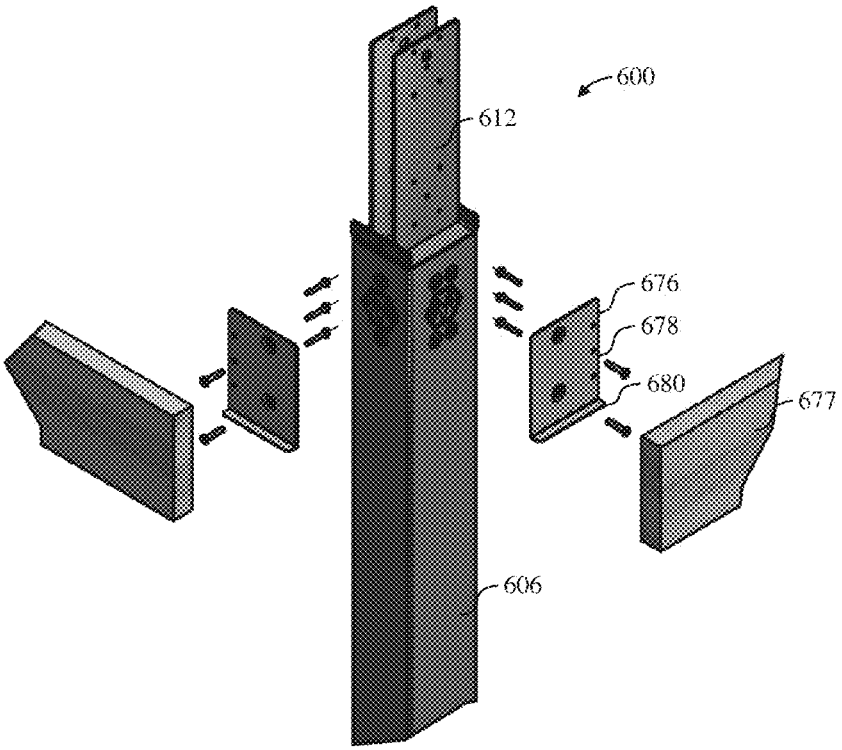
FIG. 63 is an enlarged section view of the piling assembly shown in FIG. 62 and taken along area 63.
Figure 62:
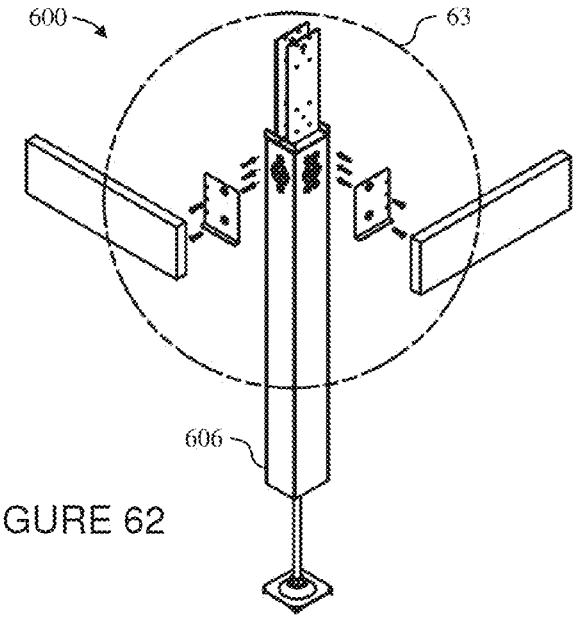
FIG. 62 is an exploded schematic view of the piling assembly shown in FIG. 58.

The rod assembly 624 includes a rod such as, for example, vertical push rod 525 and a bearing plate 541 that is coupled to the rod 525 (shown in FIGS. 54-56). Bearing plate 541 includes an opening that is sized and shaped to receive the rod 525 therethrough to facilitate coupling the bearing plate 541 to the rod 525. In addition, the bearing plate 541 is coupled to the rod 525 such that the bearing plate 541 may freely rotate with respect to the rod 525. One or more with positioning members such as, for example one or more locking nuts and/or washers are coupled to the rod 525 and positioned with respect to the bearing plate 541 to prevent the bearing plate 541 from sliding along the rod outer surface. The bearing plate 541 also may include a plurality of teeth that are configured to engage a ground surface to facilitate preventing a rotation of the bearing plate 541 with respect to the rod 525 as the rod 525 is rotated about the centerline axis 626. In the illustrated embodiment, the height adjustment tube 622 includes a threaded inner surface that defines a cavity that is sized and shaped to receive the rod 525 therein. The rod 525 includes a threaded outer surface that is configured to engage the threaded inner surface of the height adjustment tube 622 to enable the rod 525 to rotate with respect to the height adjustment tube 622. Alternatively, the height adjustment tube 622 may include a threaded nut 627 that is coupled to the distal end of the tube 622 and configured to engage the rod 525 to enable the rod 525 to rotate with respect to the tube 622 to adjust the height of the column assembly 100.

In the illustrated embodiment, a portion of the rod 525 is inserted into the height adjustment tube 622 and is moveable with respect to the height adjustment tube 622 along the centerline axis 626. More specifically, the rod 525 is inserted into the height adjustment tube 622 and is rotatably coupled to the height adjustment tube 622 such that a rotation of the rod 525 moves the rod 525 along the longitudinal axis 604. For example, during installation of the column assembly 100, the rod 525 may be rotated in a first direction, represented by arrow 629, about the centerline axis 626 to move the rod assembly 624 outwardly from the height adjustment tube 622 to increase an overall length of the column assembly 100. In addition, the rod 525 may be rotated in an opposite second direction, represented by arrow 631, about the centerline axis 626 to move the rod assembly 624 inwardly towards the first end 614 to decrease the overall length of the column assembly 100.

In the illustrated embodiment, the rod 525 includes a recessed portion 630 defined at an upper end of the rod 525. The recessed portion 630 is sized and shaped to receive an adjustment tool 632 therein. In one embodiment, the recessed portion may include a hexagonal shape. In addition, the recessed portion may include any suitable shape to enable the adjustment assembly 610 to function as described herein. During installation, the adjustment tool 632 is inserted through adjustment assembly interior cavity and into the rod recessed portion to engage the rod 525 to facilitate rotating the rod 525 with respect to the height adjustment tube 622 to adjust the height of the column assembly 100. The adjustment tool 632 may also include an electric drill and/or pneumatic drill to facilitate rotating the rod 525 about the centerline axis 626. Alternatively, the adjustment tool 632 may include a recessed portion that is sized and shaped to receive the rod 525 therein to facilitate rotating the rod 525 about the centerline axis 626 to adjust the height of the column assembly 100. For example, in one embodiment, the rod 525 may have an outer surface that has a hexagonal shape that is inserted into a corresponding recess defined in the tool 632.

For example, during construction of the building foundation, the column assembly 100 is placed in the hole such that the bearing plate 541 contacts the bottom of the hole to support the piling assembly from the hole bottom. To adjust the height of the column assembly 100 from the ground surface, a user inserts the adjustment tool 632 into the interior cavity to engage the rod 525, rotates the adjustment tool 632 and the rod 525 to move the rod 525 along the longitudinal axis 604. The user may rotate the adjustment tool 632 in the first direction to move the rod assembly 624 outwardly and increase the overall length of the column assembly 100. As the rod assembly 624 is urged outwardly, the lower column assembly 600 moves upwardly away from the ground surface. The user may also rotate the adjustment tool 632 in the opposite second direction to move the rod assembly 624 inwardly to decrease the overall length of the column assembly 100 and to move the column assembly 100 closer to the ground surface. Once the desired length of the column assembly 100 has been achieved, the adjustment tool 632 is removed from the interior cavity and a portion of the hole is backfilled with concrete and/or dirt, securing the column assembly 100 from further adjustment or movement.

In the illustrated embodiment, the column connector 612 is coupled to the reinforcing cage 120 and to the upper column assembly 602, and extends outwardly from the reinforcing cage 120 along the longitudinal axis 604. The column connector 612 includes a base plate 634 and one or more side plates 636 that extend outwardly from the base plate 634. Each side plate 636 is configured to be coupled to the upper column assembly 602 to facilitate coupling the upper column assembly 602 to the lower column assembly 600 to form the column assembly 100. In the illustrated embodiment, the column connector 612 includes a pair of side plates 636, i.e. opposing walls 168. Referring to FIGS. 49-53, each side plate 636 extends between an upper end and a lower end. The lower end is coupled to the base plate 634 and includes a pair 637 of engagement teeth 638 that extend outwardly from the side plate lower end. Adjacent teeth 638 are spaced apart to define a recess 639 that is sized and shaped to receive a corresponding reinforcement rod 123 therein. More specifically, each reinforcement rod 123 is inserted into a corresponding side plate recess and are coupled to the side plate 636 with a weld.

In the illustrated embodiment, the base plate 634 includes a base member 640 and a pair of flanges 642 that extend outwardly from the base member 640. The base member 640 is substantially planar and extends between a first end 644 and an opposite second end 646 along a first axis 648, and between a first side edge 650 and an opposite second side edge 652 along a second axis 654 that is perpendicular to the first axis 648. In the illustrated embodiment, the column connector 612 includes a column width W measured between the first end 644 and the second end 646 along the first axis 648, and includes a column depth D measured between the first side edge 650 and the second side edge 652 measured along the second axis 654. In the illustrated embodiment, the column depth D is approximately equal to the column width W. In one embodiment, shown in FIGS. 66, 67 and 72, 73, the column depth D is larger than the column width W. In another embodiment, the column width W is larger than the column depth D.

In the illustrated embodiment, a first flange 656 extends outwardly from the first side edge 650 and the second flange 658 extends outward from the second side edge 652. In addition, the base plate 634 has a cross-sectional area that is substantially similar to the cross-sectional area of the lower column concrete portion 606.

The base member 640 also includes an access opening 660 that extends through a center of the base plate 634, and a plurality of slots 662 that are defined along the second axis 654 and extend through the base member 640. The center tube 620 is coupled to the base plate 634 and is positioned with respect to the access opening 660 such that the access opening 660 is in flow communication with the interior cavity. Each slot 662 is sized and shaped to receive a corresponding pair of engagement teeth 638. Each pair of engagement teeth 638 are spaced apart to define a gap 663 therebetween. The gap is sized and shaped to receive a portion of the base member 640 defined between adjacent slots 662 such that the base member 640 contacts the side plate 636 as the side plate engagement teeth 638 are inserted into the corresponding slots 662 to facilitate coupling the base plate 634 to each side plate 636.

In the illustrated embodiment, the side plates 636 are orientated along the second axis 654 and are spaced a distance inwardly from the first and second ends 644 and 646, respectively, along the first axis 648. In addition, each side plate 636 is spaced an equal distance from the centerline axis 626. Each side plate 636 is also aligned with respect to a corresponding pair of reinforcing rods 123 and is coupled to the pair of reinforcing rods 123 such that a load path, represented by arrow 664, is defined through the side plate 636 to the reinforcement rod 123 to facilitate a transfer of bending forces, tensile forces, and/or compressive forces from the upper column assembly 602 to the lower column assembly 600. In addition, the engagement teeth 638 extend a distance from the base plate 634 such that the engagement teeth 638 are encased in the concrete portion 606.

The upper column assembly 602 includes a plurality of boards 668 that are coupled to each side plate 636 and extend outwardly from the base plate 634. In one embodiment, the boards are formed from wood. Alternatively, the boards 668 may be formed from steel, aluminum, or a composite. In the illustrated embodiment, the upper column assembly 602 includes a center board 670 and two outer boards 672. The side plate engagement teeth 638 facilitate alignment of the side plate 636 and the wood boards 668 with respect to the reinforcing rods 123 to facilitate a transfer of bending forces, tensile forces, and/or compressive forces from the wood boards 668 to the reinforcing cage 120 with each reinforcing rod 123 being encased with a minimum concrete cover.

Each board 668 is orientated along the second axis 654 and extends between the first side edge 650 and the second side edge 652. In the illustrated embodiment, the center board 670 is positioned between the pair of side plates 636, and the outer boards 672 are positioned between the side plates 636 and the first and second ends 644 and 646, respectively. The boards 668 and side plates 636 each include a plurality of holes that are sized and shaped to receive corresponding fasteners to facilitate coupling the boards 668 to the side plates 636. Each outer board 672 includes a recessed portion 673 that is defined along an outer surface. The recessed portion is sized and shaped to receive a corresponding side plate 636 therein. Moreover, the side plates 636 are spaced apart such that a lower portion of the center board 670 has a thickness that is larger than the thickness of a corresponding lower portion of each side outer board 672. By providing a center board 670 that has a larger cross-sectional area than the outer boards 672 at the point of connection between the column connector 612 and the wood boards 668, the amount of load transferred between the upper column assembly 602 and the lower column assembly 600 is increased.

In addition, each board 668 also includes a notch 674 defined along opposite ends of each board 668. Each notch is sized and shaped to receive a corresponding flange 642 therein such that a uniform cross-sectional area is defined along the longitudinal axis 604 from the upper column assembly 602 to the lower column assembly 600.

In the illustrated embodiment, the column assembly 100 also includes a splashboard bracket 676 (shown in FIGS. 60-63) that is coupled to the lower column assembly 600 to facilitate coupling a splashboard 677 to the column assembly 100. Each splashboard bracket 676 includes a plate 678 and a flange 680 that extends outwardly from the plate 678 for supporting a splashboard from the plate 678. The lower column assembly 600 includes a plurality of fastener holes that extend through the column outer surface. The openings are positioned in locations that correspond to openings defined though the splashboard bracket 676 to facilitate coupling the splashboard bracket 676 to the lower column assembly 600 with one or more fasteners. In the illustrated embodiment, each fastener hole and splashboard plate openings each include a recessed portion that is sized and shaped to accommodate a head portion of a corresponding fastener such that the fastener may be installed flush with the outer surface of the splashboard plate 678 to accommodate installation of the splashboard.

In the illustrated embodiment, a method of installing the column assembly 100 for use in erecting a building includes excavating a hole to a predetermined depth, providing the lower column 602 including height adjustment assembly 610, and inserting the lower column 602 into the excavated hole such that the bearing plate 541 contacts the bottom of the hole to support the column assembly 100 from the hole bottom. The adjustment tool 632 is inserted into the center tube 620 to engage the rod 525 and to rotate the rod 525 about the centerline axis 626 to adjust the height of the lower column assembly 600 with respect to the hole bottom. Once the desired height of the lower column 602 is achieve, the adjustment tool 632 is removed from the center tube 620 and concrete is poured into the hole and around the lower piling to backfill the hole to a predetermined depth. Once the concrete has set, the center board 670 and outer boards 672 are each coupled to the column connector to coupled the upper column assembly 602 to the lower column assembly 600 to form the column assembly 100. The splashboard bracket 676 is then coupled to the lower column assembly 600, and a splashboard is coupled to the splashboard bracket 676.

Figure 64:
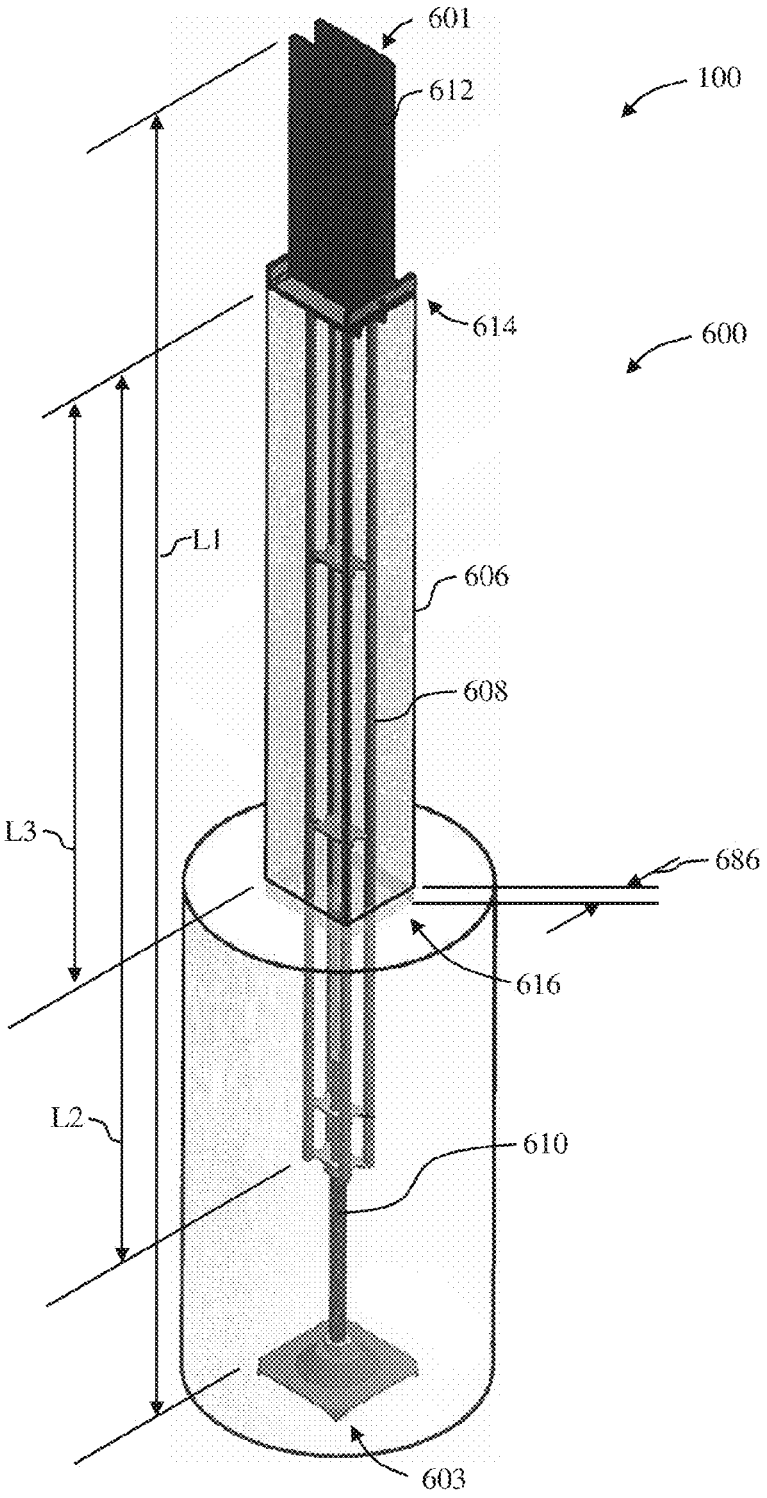
FIG. 64 is another perspective view of the piling assembly, according to an embodiment of the present invention.
Figure 65:
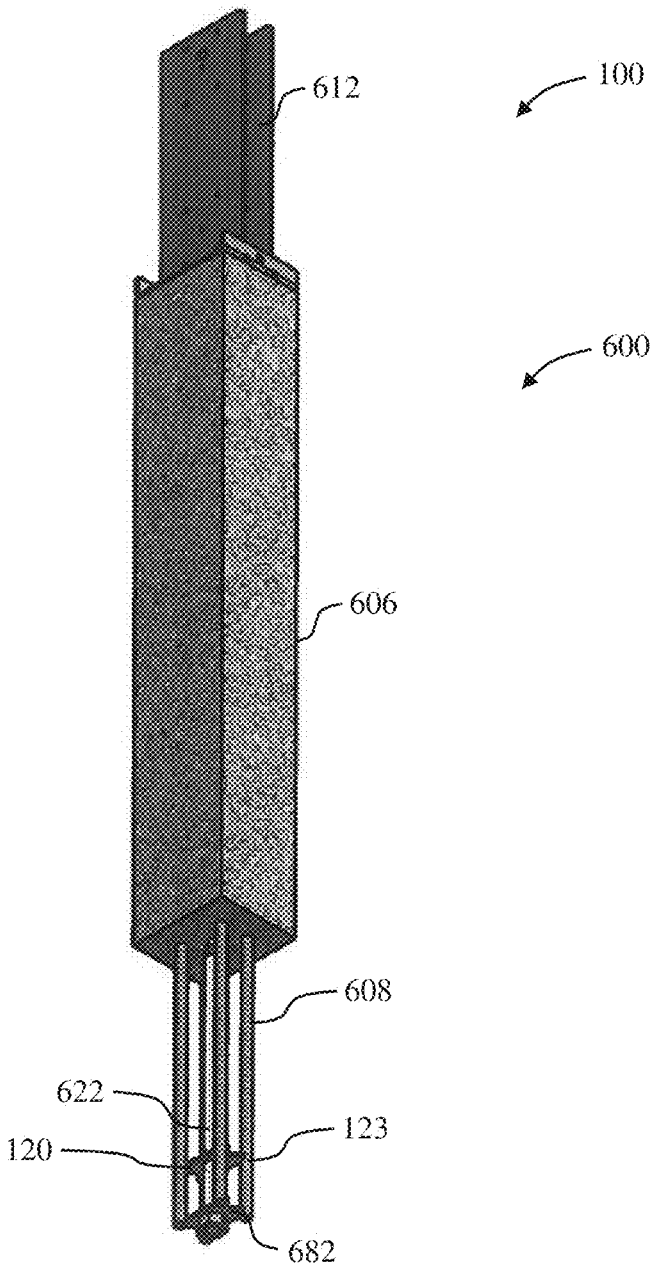
FIG. 65 is a perspective view of a portion of the piling assembly shown in FIG. 64, according to an embodiment of the present invention.
Figure 66:
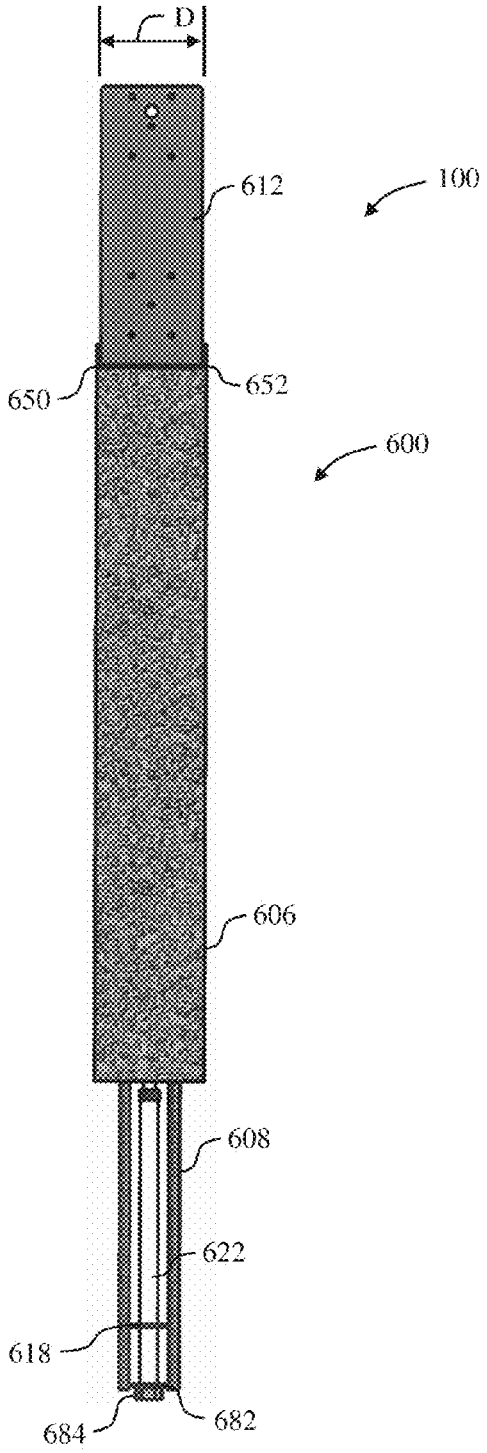
FIG. 66 is a side view of the piling assembly shown in FIG. 65.
Figure 67:
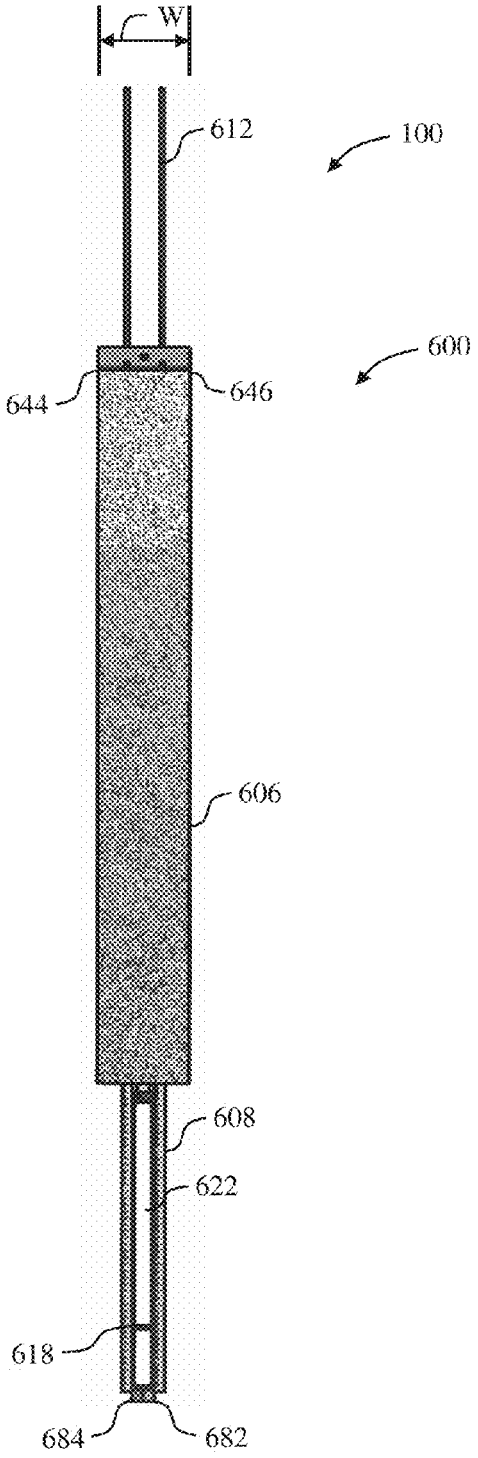
FIG. 67 is a front view of the piling assembly shown in FIG. 65.
Figure 68:
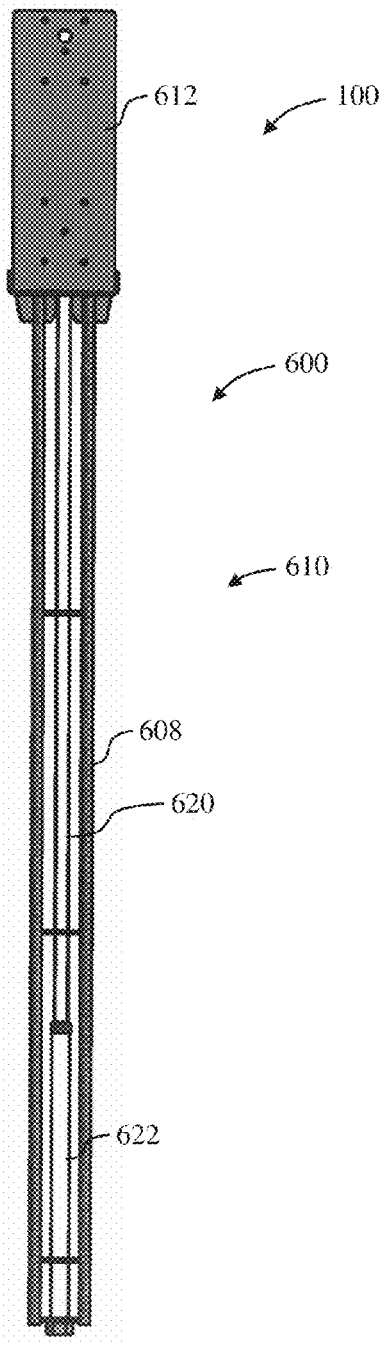
FIG. 68 is a side view of a portion of the piling assembly shown in FIG. 65.
Figure 69:
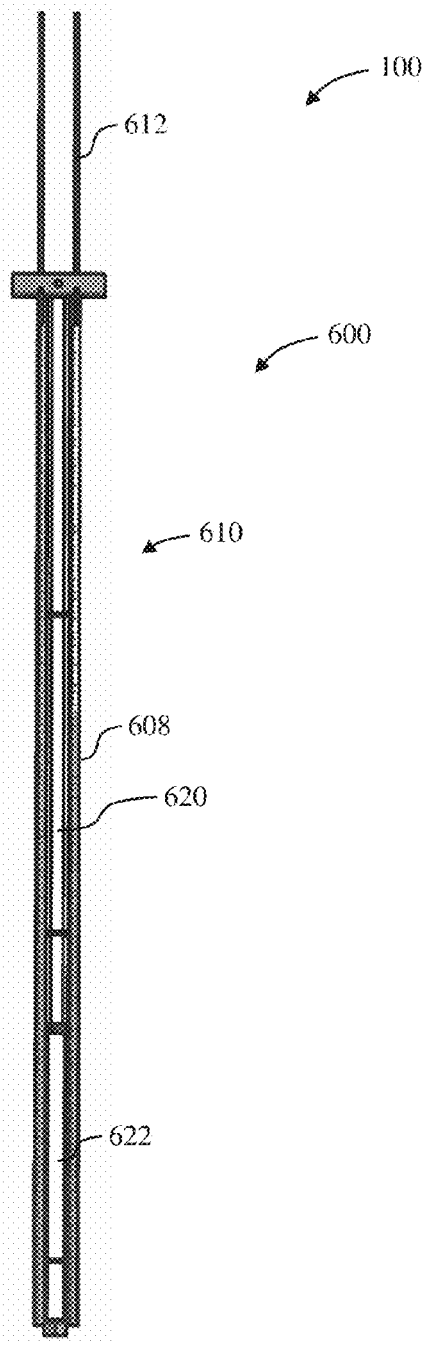
FIG. 69 is a front view of a portion of the piling assembly shown in FIG. 65.
Figure 70:
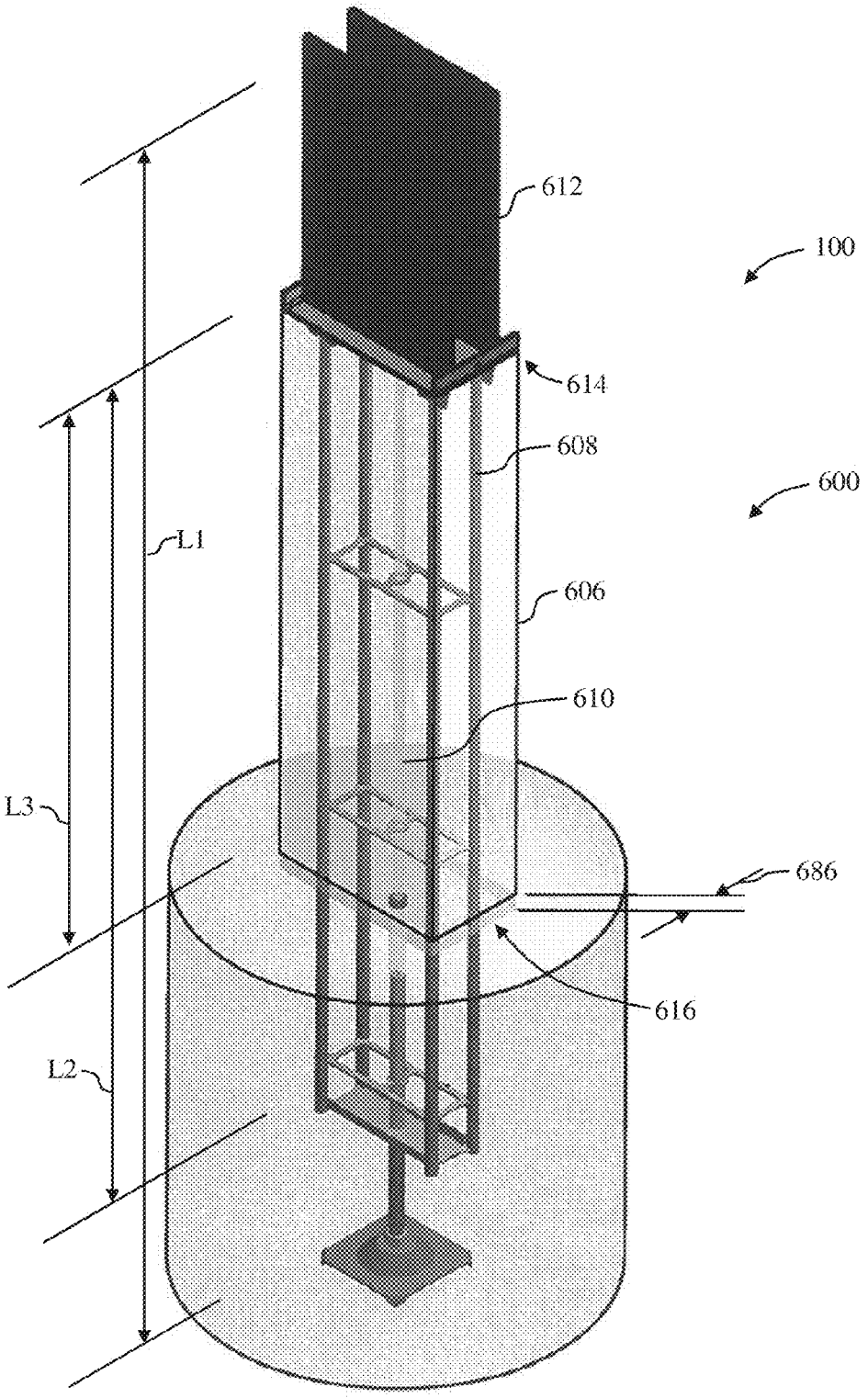
FIG. 70 is another perspective view of the piling assembly, according to an embodiment of the present invention.
Figure 71:
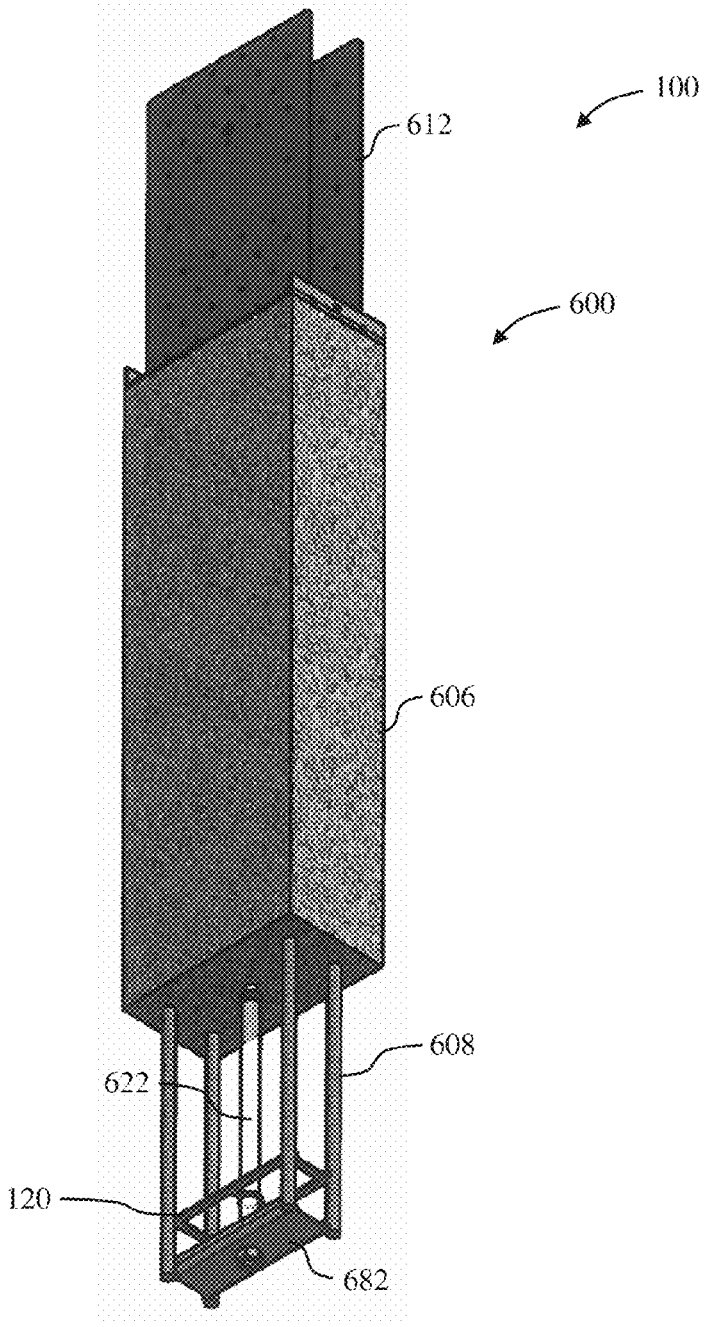
FIG. 71 is a perspective view of a portion of the piling assembly shown in FIG. 70, according to an embodiment of the present invention.
Figure 72:
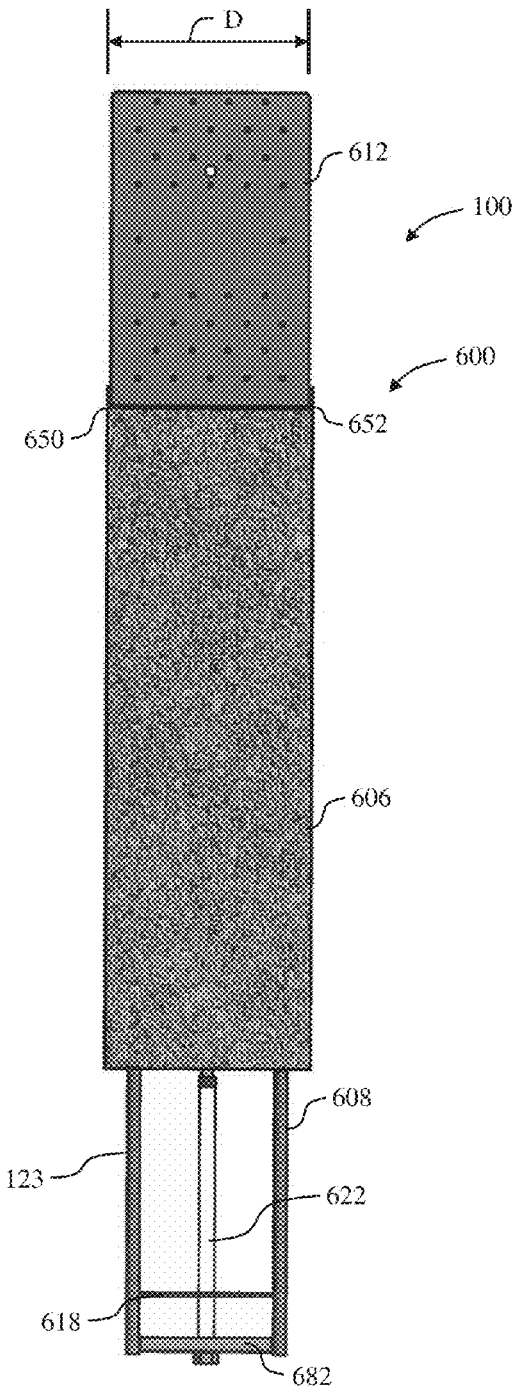
FIG. 72 is a side view of the piling assembly shown in FIG. 70.
Figure 73:
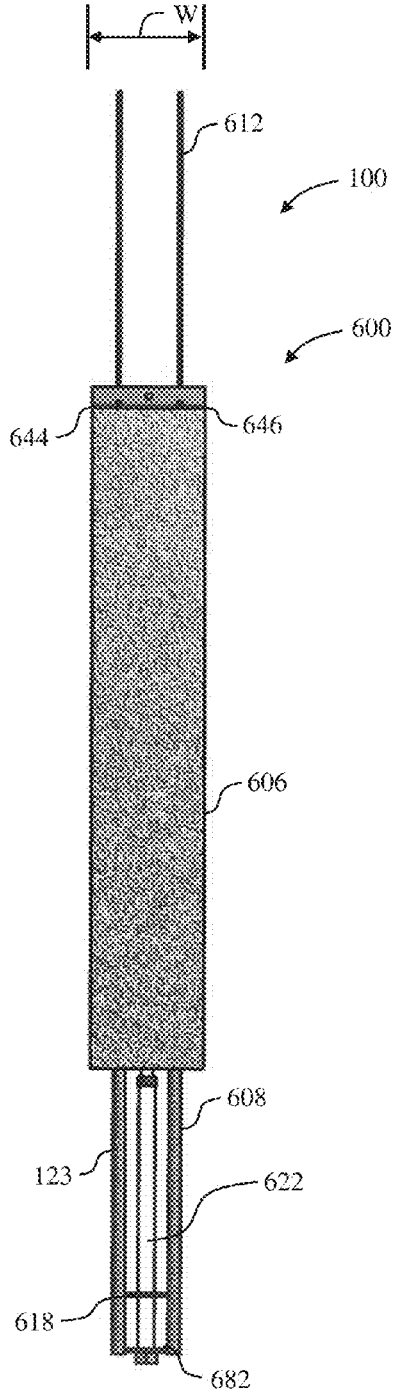
FIG. 73 is a front view of the piling assembly shown in FIG. 70.
Figure 74:
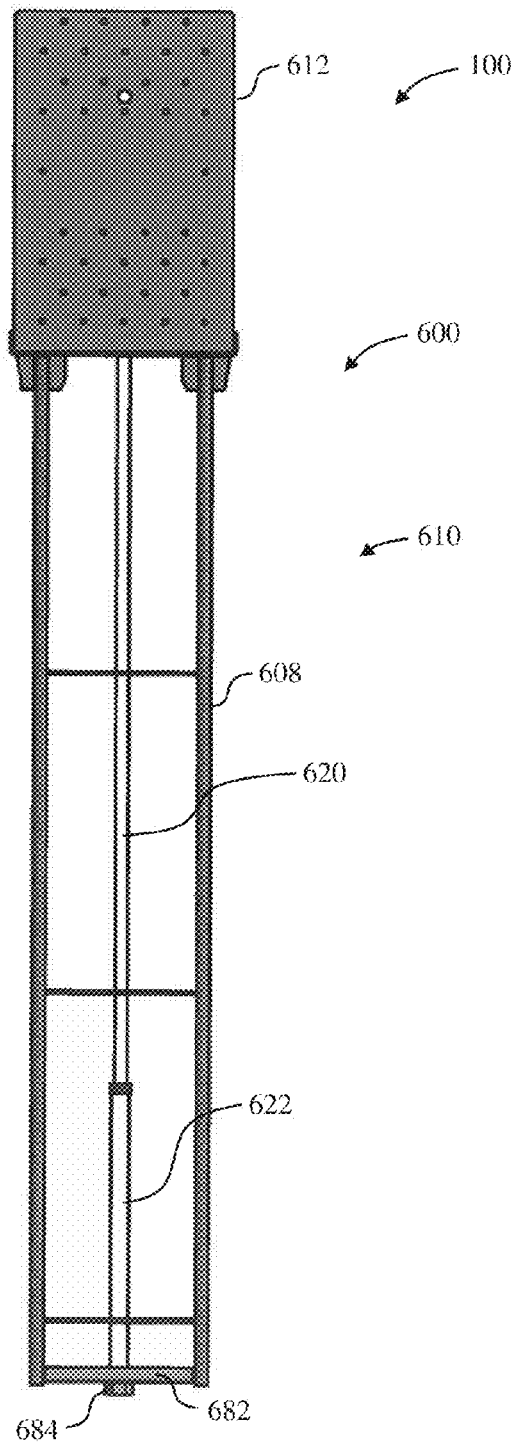
FIG. 74 is a side view of a portion of the piling assembly shown in FIG. 70; and, FIG. 75 is a front view of a portion of the piling assembly shown in FIG. 70.
Figure 75:
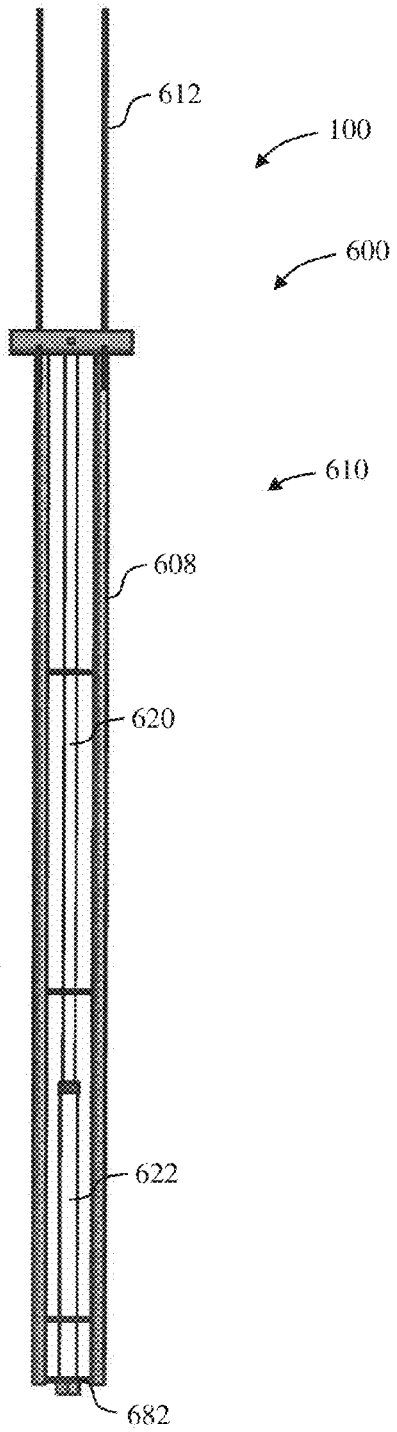

FIG. 64 is another perspective view of the column assembly 100, according to an embodiment of the present invention. FIGS. 65-69 are schematic views of the column assembly 100 shown in FIG. 64. FIG. 70 is another perspective view of the column assembly 100, according to an embodiment of the present invention. FIGS. 71-75 are schematic views of the column assembly 100 shown in FIG. 70. In the illustrated embodiment, the reinforcement assembly 608 includes a lower support plate 682 that is coupled between the bottom portion of the reinforcement members 123 and the height adjustment tube 622. The lower support plate 682 includes an opening that is sized and shaped to receive the height adjustment tube 622 therethrough. In one embodiment, the height adjustment tube 622 may also include an attachment nut 684 to facilitate rotatably coupling the rod assembly 624 to the height adjustment tube 622.

In the illustrated embodiment, the reinforcement assembly 608 includes a length L2 that is larger than the length L3 of the precast concrete portion 606 such that a portion of the reinforcement assembly 608 extends outwardly from the precast concrete portion 606. In addition, a precast/in-situ ready-mix concrete interface zone 686 is defined along a lower portion of the precast concrete portion 606 to facilitate coupling the precast concrete portion 606 to the in-situ cast concrete. The reinforcement members 123 extend outwardly from the concrete portion 606 to allow a portion of the reinforcement members 123 to be embedded in-situ concrete and/or backfill during installation to increase the uplift capacity of the column assembly 100.

In the illustrated embodiment, the threaded height adjusting bracket allows for seamless foundation column height adjustment during construction and gives an aesthetically pleasing interior look for the building. The system starts each column location at a flush and level framing point repetitively. The internal threaded adjustment bracket connects the building to the concrete footing and anchored the building against wind developed uplift loads. In one embodiment, the swaged-threaded tube is removed, the reinforcement bars are straightened and lengthened, a tie plate and a lower support plate are added, and a portion of the precast concrete is removed. By shortening the cast length of the precast lower column and using the re-bar dowels already encased in the member, the uplift capacity is increased and the structural design becomes more effective. This sockets the precast member into the cast-in-place footing better than the previous design and decreases the overall weight of the precast column. This makes handling and shipping easier. In addition, the additional tie-plate has been positioned on the exposed re-bar to further stabilize the threaded adjustment rod and bracket during construction. This new design makes installation of the column assembly easier for the crews by reducing the "wobbliness" of the column before the cast-in-place footing is poured. The lower support plate will have an attached nut or threaded section to connect to the threaded adjustment rods.

Obviously, many modifications and variations of the present invention are possible in light of the above teachings. In addition, the reference numerals in the claims are merely for convenience and are not to be read in any way as limiting.

What is claimed is:

1. A column assembly having an adjustable length for use in a building foundation system, comprising:

a height adjustment assembly for use in adjusting an overall length of the column assembly, the height adjustment assembly including an access tube assembly and a rod assembly, the access tube assembly including an inner surface and an outer surface, the inner surface defining a tube cavity extending between a first end and a second end of the access tube assembly along a longitudinal axis, the access tube assembly including a center tube extending from the first end towards the second end and a height adjustment tube coupled to the center tube and extending from the center tube to the second end, the rod assembly rotatably coupled to the height adjustment tube and extending outwardly from the second end along the longitudinal axis;

a reinforcement assembly coupled to the height adjustment assembly, the reinforcement assembly including at least one reinforcement member extending between a top portion and a bottom portion of the reinforcement assembly and orientated substantially parallel to the longitudinal axis; and a column connector assembly coupled to the reinforcement assembly, the column connector assembly including a baseplate and at least one sideplate extending outwardly from the baseplate, the baseplate coupled to the first end of the access tube assembly and including an opening extending therethrough, the opening being positioned with respect to the access tube assembly to provide access to the tube cavity through the opening, the at least one sideplate including a pair of engagement teeth and a recess defined between the pair of engagement teeth, the recess configured to receive the top portion of the at least one reinforcement member therein to facilitate coupling the reinforcement member to the column connector assembly.

2. A column assembly in accordance with claim 1, the reinforcement assembly including a plurality of reinforcement members, the at least one sideplate including a plurality of pairs of engagement teeth, each pair of the plurality of pairs of engagement teeth being coupled to a corresponding reinforcement member.

3. A column assembly in accordance with claim 1, the baseplate including a slot extending therethrough, the slot configured to receive the pair of engagement teeth therethrough such that the pair of engagement teeth extend through the slot towards the reinforcement assembly.

4. A column assembly in accordance with claim 1, the bottom portion of the at least one reinforcement member including a tapered section that is coupled to the outer surface of the access tube assembly.

5. A column assembly in accordance with claim 1, further comprising:

a concrete section extending from the baseplate towards the second end of the access tube assembly along the longitudinal axis, the concrete section extending across at least a portion of the reinforcement assembly and the height adjustment assembly.

6. A column assembly in accordance with claim 5, the concrete section extending between an upper portion and a lower portion along the longitudinal axis, the upper portion positioned adjacent to the top portion of the at least one reinforcement member, the bottom portion of the at least one reinforcement member extending outwardly from the lower portion of the concrete section.

7. A column assembly in accordance with claim 1, the reinforcement assembly including a plurality of reinforcement ties coupled between the at least one reinforcement member and the access tube assembly, each of the reinforcement ties including an opening that is configured to receive the access tube assembly therethrough.

8. A column assembly in accordance with claim 1, the reinforcement assembly including a lower support plate that is coupled between the bottom portion of the at least one reinforcement member and the access tube assembly, the lower support plate including an opening that is configured to receive the access tube assembly therethrough.

9. A column assembly having an adjustable length for use in a building foundation system, comprising:

an upper column assembly; and a lower column assembly coupled to the upper column assembly, the lower column assembly comprising:

a height adjustment assembly for use in adjusting an overall length of the column assembly, the height adjustment assembly including an access tube assembly and a rod assembly, the access tube assembly including an inner surface and an outer surface, the inner surface defining a tube cavity extending between a first end and a second end of the access tube assembly along a longitudinal axis, the access tube assembly including a center tube extending from the first end towards the second end and a height adjustment tube coupled to the center tube and extending from the center tube to the second end, the rod assembly rotatably coupled to the height adjustment tube and extending outwardly from the second end along the longitudinal axis;

a reinforcement assembly coupled to the height adjustment assembly, the reinforcement assembly including at least one reinforcement member, the at least one reinforcement member extending between a top portion and a bottom portion of the reinforcement assembly and orientated substantially parallel to the longitudinal axis; and a column connector assembly coupled to the reinforcement assembly and the upper column assembly, the column connector assembly including a baseplate and at least one sideplate extending outwardly from the baseplate, the baseplate coupled to the first end of the access tube assembly, the baseplate including an access opening extending therethrough, the opening being positioned with respect to the access tube assembly to provide access to the tube cavity through the access opening, the at least one sideplate including a pair of engagement teeth and a recess defined between the pair of engagement teeth, the recess configured to receive the top portion of the at least one reinforcement member therein to facilitate coupling the reinforcement member to the column connector assembly.

10. A column assembly in accordance with claim 9, the reinforcement assembly including a plurality of reinforcement members, the at least one sideplate including a plurality of pairs of engagement teeth, each pair of the plurality of pairs of engagement teeth being coupled to a corresponding reinforcement member.

11. A column assembly in accordance with claim 9, the baseplate including a slot extending therethrough, the slot configured to receive the pair of engagement teeth therethrough such that the pair of engagement teeth extend through the slot towards the reinforcement assembly.

12. A column assembly in accordance with claim 10, the upper column assembly including an upper column member including a recessed portion that is configured to receive the sideplate therein.

13. A column assembly in accordance with claim 9, the bottom portion of the at least one reinforcement member including a tapered section that is coupled to the outer surface of the access tube assembly.

14. A column assembly in accordance with claim 9, the lower column assembly comprising a concrete section extending from the baseplate towards the second end of the access tube assembly along the longitudinal axis, the concrete section extending across at least a portion of the reinforcement assembly and the height adjustment assembly.

15. A column assembly in accordance with claim 14, the concrete section extending between an upper portion and a lower portion along the longitudinal axis, the upper portion positioned adjacent to the top portion of the at least one reinforcement member, the bottom portion of the at least one reinforcement member extending outwardly from the lower portion of the concrete section.

16. A column assembly in accordance with claim 9, the reinforcement assembly including a plurality of reinforcement ties coupled between the at least one reinforcement member and the access tube assembly, each of the reinforcement ties including an opening that is configured to receive the access tube assembly therethrough.

17. A column assembly in accordance with claim 9, the reinforcement assembly including a lower support plate that is coupled between the bottom portion of the at least one reinforcement member and the access tube assembly, the lower support plate including an opening that is configured to receive the access tube assembly therethrough.

18. A method of assembling a column assembly having an adjustable length, including the steps of:

coupling a sideplate to a baseplate to form a column connector assembly, the sideplate including a pair of engagement teeth and a recess defined between the pair of engagement teeth, the pair of engagement teeth extending through a slot formed in the baseplate, the baseplate including an access opening extending therethrough;

coupling an access tube assembly to the baseplate, the access tube assembly including an inner surface and an outer surface, the inner surface defining a tube cavity extending between a first end and a second end of the access tube assembly along a longitudinal axis, the access tube assembly including a center tube extending from the first end towards the second end and a height adjustment tube coupled to the center tube and extending from the center tube to the second end, the access tube assembly positioned with respect to the access opening to provide access to the tube cavity through the access opening;

coupling a reinforcement member to the sideplate, the reinforcement member extending between a top portion and a bottom portion and orientated substantially parallel to the longitudinal axis, the top portion of the reinforcement member positioned within the recess formed between the pair of engagement teeth to facilitate coupling the reinforcement member to the sideplate; and rotatably coupling a rod assembly to the height adjustment tube such that a rotation of the rod assembly adjusts an overall length of the column assembly.

19. A method in accordance with claim 18, including the steps of forming a concrete section extending from the baseplate towards the second end of the access tube assembly along the longitudinal axis, the concrete section extending across at least a portion of the reinforcement member and the access tube assembly.

20. A method in accordance with claim 18, including the step of coupling an upper column member to the column connector assembly, the upper column member including a recessed portion that is configured to receive the sideplate therein, the upper column member extending outwardly from the baseplate along the longitudinal axis.

* * * * *